US012108851B1

(12) United States Patent
Ciaciuch

(10) Patent No.: US 12,108,851 B1
(45) Date of Patent: Oct. 8, 2024

(54) WRISTWATCH WRAPPER DEVICE

(71) Applicant: James Ciaciuch, Gig Harbor, WA (US)

(72) Inventor: James Ciaciuch, Gig Harbor, WA (US)

( * ) Notice: Subject to any disclaimer, the term of this patent is extended or adjusted under 35 U.S.C. 154(b) by 28 days.

(21) Appl. No.: 18/295,803

(22) Filed: Apr. 4, 2023

(51) Int. Cl.
*A45C 11/00* (2006.01)
*A45C 3/00* (2006.01)
*A45C 11/10* (2006.01)

(52) U.S. Cl.
CPC ..... *A45C 11/10* (2013.01); *A45C 3/001* (2013.01)

(58) Field of Classification Search
CPC ..... A45C 11/00; A45C 3/001; G04B 37/005; A44C 5/00; A44C 5/0053
USPC ..... 206/6.1; 224/164, 170; 386/281
See application file for complete search history.

(56) References Cited

U.S. PATENT DOCUMENTS 2,076,221 A 8/1936 Bradbury
2,249,550 A 7/1939 Williams
2,227,131 A 12/1939 Friedman
2,635,416 A 4/1953 Mietchen
4,916,679 A * 4/1990 Agnello ..... G04B 37/005 368/286
D330,679 S 11/1992 Bland
5,332,135 A * 7/1994 Fletcher ..... G04B 37/005 224/171
6,199,730 B1 * 3/2001 Chisolm ..... A44C 5/0053 224/166
6,213,634 B1 4/2001 Harrington et al.
D491,829 S 6/2004 Selfert
6,799,887 B1 * 10/2004 Kinney ..... A44C 5/00 368/282
7,252,215 B1 * 8/2007 Furnas, II ..... A45C 1/04 224/164
7,393,336 B2 * 7/2008 Sloot ..... A61F 5/0104 602/61
7,430,764 B2 10/2008 Yang
8,677,515 B2 3/2014 Ishihara et al.
9,439,488 B2 9/2016 Davis
10,602,820 B2 * 3/2020 Phipps ..... A45C 11/10
2004/0250933 A1 12/2004 DeMichele
2012/0061430 A1 * 3/2012 Hall ..... A44C 5/00 224/164

(Continued)

OTHER PUBLICATIONS

Jovanovic, et al., Impact of the Elastane Percentage on the Elastic Properties of Knitted Fabrics Under Cyclic Loading, Materials (2022) 15, 6512. https://doi.org/10.3390/ma15196512.

*Primary Examiner* — Steven A. Reynolds
(74) *Attorney, Agent, or Firm* — Elizabeth Reilly; Patentpending, PLLC

(57) ABSTRACT

A wristwatch wrapper device for temporarily storing a wristwatch which includes an anterior material layer, a posterior material layer reinforced with an interior lining material circumventing a tubular open channel with a first elasticized selvage and a second elasticized selvage having a first flexible cuff portion, a second flexible cuff portion with a mounting portion therebetween. In an embodiment, a torus-shaped wristwatch wrapper device is formed with a circumferential ring. In another embodiment, an orbicular shaped wristwatch wrapper device is formed removably coupled with a metal swivel carabiner hinge. In another embodiment, the wristwatch wrapper device includes viewing windows to view a front portion of the wristwatch and to store an identification card when the wristwatch wrapper device is in a folded state.

47 Claims, 19 Drawing Sheets

(56) References Cited

U.S. PATENT DOCUMENTS

2022/0087449 A1 3/2022 Omega

* cited by examiner

WRISTWATCH WRAPPER DEVICE

FIELD OF THE INVENTION

The present invention relates to a wristwatch wrapper device being a transient protective device of a tubular construction to protect a wristwatch when not adorned on a user, more particularly, to protect the face of the watch and the strap or bracelet against external elements, for example, dirt, dust, water, humidity and harm.

BACKGROUND OF THE INVENTION

Wristwatches can be valuable assets and collectables for many people and passionate wristwatch enthusiasts. Wristwatches can be valuable heirlooms holding great value. The wristwatch as an heirloom can remind a current person who owns the wristwatch of all the people who came before him or her who owned the wristwatch. In the case of a family heirloom, that's a living reminder of past generations all tied up in the wristwatch as an active presence of loved ones.

Horologists and designers, also, hold many valuable enforceable utility patents and design patents on the utilitarian elements of the horologist's or designer's wristwatch (es). The most valuable, complex, and high precision wristwatches in the world of horology include the Omega®, Omega® Ladymatik, Patek Philippe® Grandmaster Chime 6300G. High precision timepieces include, Patek Phillipe® Nautilus; Patek Philippe® Nautilus 5980R; Patek Philippe® Nautilus Tiffany & Co.®; Aquanaut Rolex®; vintage Rolex Submariner; Rolex Emperor Bao Dei; Jacob & Co®; Jacob & Co.®; Brilliant Skeleton Northern Lights; Richard Mille RM47; Rolex Paul Newman Daytona; Van Cleef & Arpels®; Cartier®, Tiffany & Co.®, Tiffany & Co., Art Deco; Bulgari®, the value of which can range in the amount of $1,000 to $18,000,00 dollars, and increased amounts in auction.

Even more, a wristwatch gifted as an heirloom from a loved one permeates unmeasurable value. Therefore, there is a need to provide a wristwatch wrapper device to protect the wristwatch when the wristwatch is not adorned on the wrist of the user. In general practice, when the wristwatch is not being worn by the user or owner, the wristwatch is commonly stored in a box, a jewelry box, or a customized wristwatch drawer or closet, displaying the wristwatch or a collection of wristwatches. However, when a person is not wearing his or her wristwatch when they are in transit, and more particularly, travelling through an airport and airport security, the wristwatch is randomly dropped into the airport security tray, or, perhaps, shoved into a temporary holding location, for example, a garment pocket, a purse, a carry-on bag, a shopping bag, without protection and at risk of being scratched, having a cracked crystal, having a dented band, being exposed to liquids, and/or otherwise damaged by extraneous objects within the temporary holding location. For luxury wristwatches, heirloom wristwatches, or collection pieces, made of delicate precious metals like gold, the damage can be remarkable and costly to repair, and, thus, the value of the wristwatch decreases. Wristwatches are known to sustain damage from impact and from contamination as a result of the ingress of humidity, sweat, water, liquids, or other fluids. Such damage may result, for example, in a cracked crystal, scratches on the crystal, dislodgement of the case, lug ends, and crown which can ruin or limit the functionality of the wristwatch. A variety of wristwatches contain sensitive and fragile components, for example, the band, straps, bracelet, hands, bezels, luminous markers, batons or numbers, a camera, a screen. Dropping or inadvertent rough handling of the wristwatch can render these various features unusable. Moreover, the intrinsic value of the wristwatch is, also, reduced over time for the owner as they become more and more used to storing their wristwatches alongside a variety of personal items each day and night.

To avoid the necessity of buckling the wristwatch and its straps or bracelet in a user's pocket of a garment, or roughly thrown in an airport tray without a covering, and the consequent damage which will diminish the quality, appearance and value of the wristwatch, a wristwatch wrapper device is needed. The wristwatch wrapper device provides an uncomplicated mounting of the wristwatch and its straps or bracelet, thereon, the wristwatch wrapper device and an uncomplicated removal of the wristwatch therefrom. In particular, the wristwatch wrapper device provides a device characterized with an ability to retain the wristwatch and its straps or bracelet against inadvertent detachment from the wristwatch wrapper device. In one embodiment, the wristwatch wrapper device is configured with a viewing window where the face of the wristwatch is revealed thereby allowing the user to view the face of the wristwatch.

An object of the present invention is to provide an improved wristwatch holder for a user, especially, when the wristwatch is not currently being worn by the user, or when the wristwatch is being temporarily being stored in a user's drawer, closet, or secured safe.

Another object of the invention is to provide a wristwatch wrapper device comprising a novel and improved type of holder therefor and upon which a wristwatch and its attached straps or bracelet may be readily and securely mounted and readily removed therefrom.

An object is to provide an improved type of wristwatch wrapper device to temporarily contain and safeguard a wristwatch or other article of jewelry while the owner/user is not wearing the wristwatch and is in transit.

An object of the invention is to provide a wristwatch wrapper device comprising a novel and improved type of holder or frame therefor and upon which a wristwatch and its attached bracelet, band, or straps may be readily and securely mounted and readily removed therefrom.

An object of the invention is to provide a wristwatch wrapper device that is shock absorbent, waterproof, and ultraviolet blocking.

An object of the invention is to provide a wristwatch wrapper device provided with a metal ring-spring gate O-ring which is removably integrated into the wristwatch wrapper device. A metal swivel carabiner hinge including a swivel connector is, also, provided, to couple with the metal ring-spring gate O-ring to enable the user to removably couple the wristwatch wrapper device to the user's article of clothing, a pocket, a bag, pocket book, luggage, suit case while travelling wherein the user's wristwatch is contained therein the wristwatch wrapper device.

Thus, there remains a continuing need for new and improved wristwatch wrapper device that provides a protective flexible wrapper to protect the user's wristwatch from damage when not adorned by the user, more particularly, when the user is in transit.

SUMMARY

In one aspect, a wristwatch wrapper device is disclosed. The wristwatch wrapper device, comprises a tubular body having an anterior material layer formed joined to a posterior material layer reinforced with an interior lining material circumventing a tubular open channel having a first open end limited by a first circumferential tubal body edge and a second open end limited by a second circumferential tubal body edge. The interior lining material of the tubular body of the wristwatch wrapper device is imprinted with a design which can include a logo or registered trademark including a trademark plus a stylized design of a manufacturer of the wristwatch, the owner of the wristwatch, or the user of the wristwatch. The tubular body of the wristwatch wrapper device is configured with a lateral direction and circumferential direction.

The tubular body of the wristwatch wrapper device includes a first elasticized selvage which is integrated with the first circumferential tubal body edge of the tubular body and a second elasticized selvage which is integrated with the second circumferential tubal body edge of the tubular body. The first elasticized selvage and the second elasticized selvage of the tubular body are separated by a first flexible cuff portion and a second flexible cuff portion having a mounting portion centrally disposed therebetween the first flexible cuff portion and the second flexible cuff portion. The first flexible cuff portion is configured with a first circumferential cross section, the second flexible cuff portion is configured with a second circumferential cross section equal to the first circumferential cross section, the mounting portion is configured with a third circumferential cross section which is equal to the first circumferential cross section and second circumferential cross section.

The second flexible cuff portion is configured with a housing including a compartment recessed into a portion of the inner posterior lining material that is congruent with the posterior material layer of the second flexible cuff portion of the tubular body wherein the compartment is configured to contain a transferable smart device.

The mounting portion is framed with a first circumferential mounting edge and a second circumferential mounting edge. The first circumferential mounting edge is integrated with a first piping and the second circumferential mounting edge is integrated with a second piping.

In one exemplary embodiment the wristwatch wrapper device is assimilated with a transferable mounting panel. The wristwatch wrapper device can include one or more transferable mounting panels such that if a transferable mounting panel becomes worn it can be replaced by a new transferable mounting panel of the one or more mounting panels. The transferable mounting panel is configured in an annular band. The transferable mounting panel extends perpendicularly to the lateral direction of the tubular body circumventing an anterior face and a posterior face of the mounting portion. The transferable mounting panel is configured with an anterior portion and a posterior portion. The transferable mounting panel includes an anterior gripping application integrated on the anterior portion of the transferable mounting panel, and, similarly, a posterior gripping application is integrated on a posterior portion of the transferable mounting panel. The anterior gripping application integrated on the anterior portion of the transferable mounting panel is configured to comport with a case body of a wristwatch and the proximate portion of the bracelet of the wristwatch being supported by the transferable mounting panel circumventing the mounting portion of the tubular body to prevent slippage of the wristwatch. The posterior gripping application integrated on the posterior portion of the transferable mounting panel is configured to comport with the distal portion of the straps, bands, or bracelet of the wristwatch to further prevent slippage of the wristwatch.

The first flexible cuff portion extends a first length in a first transverse direction from the first piping of the mounting panel to the first elasticized selvage of the first circumferential tubal body edge of the tubular body, and the second flexible cuff portion extends a second length in an opposing transverse direction from the second piping of the mounting panel to the second elasticized selvage of the second circumferential tubal body edge of the tubular body, wherein the first length is equal to the second length. The mounting portion extends a third length from the first piping to the second piping wherein the third length is equal to the first length and the second length.

The wristwatch wrapper can exist in an unfolded state and a folded state. In the folded state wristwatch wrapper device is configured having a torus-shaped wristwatch wrapper device having a gripping ring integrated with a gripping material. To form the torus-shaped wristwatch wrapper configuration the first flexible cuff portion of the tubular body and the second flexible cuff portion of the tubular body are each upturned and reversed inside-out such that a first flexible cuff portion and a second flexible cuff portion are interfaced with each other having the first open end at the first flexible cuff portion oriented facing the second open end of the second flexible cuff portion. The first flexible cuff portion is configured to extend laterally in a first direction enabling the first flexible cuff portion to enclose the wristwatch being mounted and supported on the mounting portion. In this manner a portion of the a first interior lining material portion that is coplanar with the first flexible cuff portion is upturned and reversed inside out bringing the interior lining material to an exterior surface.

The second flexible cuff portion is configured to extend laterally in an opposing direction from the first flexible cuff portion enabling the second flexible cuff portion to envelop the first flexible cuff portion that is wrapped around the wristwatch providing a first circumambient layer wrapped around the wristwatch. Upon the second flexible cuff portion being wrapped around the first flexible cuff portion being upturned and reversed inside-out a second interior lining material portion that is coplanar to the second flexible cuff portion is brought to the exterior surface. The second flexible cuff portion provides a second circumambient layer enveloping the wristwatch whereby a torus-shaped wristwatch wrapper device is formed. Consequently, the second interior lining material portion being upturned reveals a design imprinted on a prefigured area of the interior lining material.

The torus-shaped wristwatch wrapper device is formed circumscribing the gripping ring through which a user's fingers pass such that the user can hold the torus-shaped wristwatch wrapper device. The torus-shaped wristwatch wrapper device is secured around the wristwatch by the first elasticized selvage of the first flexible cuff portion and the second elasticized selvage of the second flexible cuff portion. The gripping ring is bonded with the gripping material to prevent slippage of the user's fingers from the interior of the gripping ring for a secure hold on the wristwatch wrapper device.

In another aspect, a wristwatch wrapper device includes a first closed circumambient layer and a second closed circumambient layer enveloping the wristwatch whereby an orbicular shaped wristwatch wrapper device having a closed dual-seamed channel portion is formed. In this exemplary embodiment, the wristwatch wrapper device is secured around the wristwatch by a first elasticized selvage of the first flexible cuff portion and a second elasticized selvage of the second flexible cuff portion. A metal swivel carabiner hinge includes a swivel connector being removably coupled to the metal ring-spring gate O-ring fixedly attached to the second elasticized selvage is accessible to removably attach to the user's clothing, bag, or luggage. In another embodiment of the orbicular shaped wristwatch wrapper, a second metal swivel carabiner hinge includes a swivel connector being removably coupled to the metal ring-spring gate O-ring fixedly attached to a second elasticized selvage is accessible to removably couple to a cross-body strap.

In another aspect, a wristwatch wrapper device includes a tubular body with a first viewing window, a second viewing window, and a third viewing window. The first viewing window is formed from a first flexible transparent thermoplastic polyurethane sheet is fixed within a first anterior surface cut-out portion of the first flexible cuff portion concordant with a first cut-out portion of the interior lining of the tubular body. The first viewing window is bound by a first framed edge. The second viewing window is formed from a second flexible transparent thermoplastic polyurethane sheet which is fixed within a second anterior surface cut-out portion of the second flexible cuff portion concordant with a second cut-out portion of the interior lining of the tubular body. The second viewing window is bound by a second framed edge. The third viewing window is formed from a third flexible transparent thermoplastic polyurethane sheet which is fixed to a portion of the interior lining material coplanar to the posterior material layer of the second flexible cuff portion of the tubular body. The third viewing window is bound with a third framed edge configured with a slot having a contoured opening to slidably receive one or more personal identification cards therein.

Another embodiment of the wristwatch wrapper device includes providing a kit.

In addition to the aspects described above, further aspects and embodiments will become apparent by reference to the drawings and disclosures of the following detailed description.

Additional advantages will be set forth in part in the detailed description which follows, and in part will be obvious from the description, or can be learned by practice of the aspects described, below. The advantages described, below, will be realized and attained by means of the disclosed structures, compositions, materials, methods, and combinations thereof, particularly pointed out in the appended claims. It is to be understood that both the foregoing general description and the following detailed description are exemplary and are not restrictive of the invention, as claimed.

These and other objects, features, and advantages of the present invention will become more readily apparent from the attached drawings and the detailed description of the preferred embodiments, which follow.

BRIEF DESCRIPTION OF THE DRAWINGS

The drawings are not considered limiting of the scope of the appended claims. The elements shown in the drawings are not necessarily to scale. Reference numerals designate elements of the embodiments of the present disclosure. Exemplary embodiments of the invention will hereinafter be described in conjunction with the appended drawings provided to illustrate and not to limit the invention, where like numeral designations denote like elements, and in which:

DETAILED DESCRIPTION

The present invention can be understood more readily by reference to the following detailed description, embodiments, drawings, and claims. It is to be understood that this disclosure is not limited to the specific or exemplary aspects of a wristwatch wrapper device, and/or methods disclosed unless otherwise specified, as such can, of course, vary. Instead, the present disclosure is directed toward all novel and nonobvious features and aspects of the various disclosed aspects, alone and in various combinations and sub-combinations with one another. The disclosed device is not limited to any specific aspect, feature, or a combination thereof.

The following description of the invention is provided as an enabling teaching of the invention in its best, currently known aspect. To this end, those skilled in the relevant art will recognize and appreciate that many changes can be made to the various aspects of the invention described herein while still obtaining the beneficial results of the present invention. It will, also, be apparent that some of the desired benefits of the present invention can be obtained by selecting some of the features of the present invention without utilizing other features. Accordingly, those of ordinary skill in the pertinent art will recognize that many modifications and adaptations to the present invention are possible and may even be desirable in certain circumstances and are a part of the present invention. Thus, the following description is again provided as illustrative of the principles of the present invention and not in limitation thereof.

The embodiments are described more fully below in sufficient detail to enable those skilled in the art to practice the system and method. The presently disclosed embodiments of the invention are described with reference to the drawings, where like components are identified with the same numerals. The descriptions of the preferred embodiments are exemplary and are not intended to limit the scope of the invention.

Figure 1A:
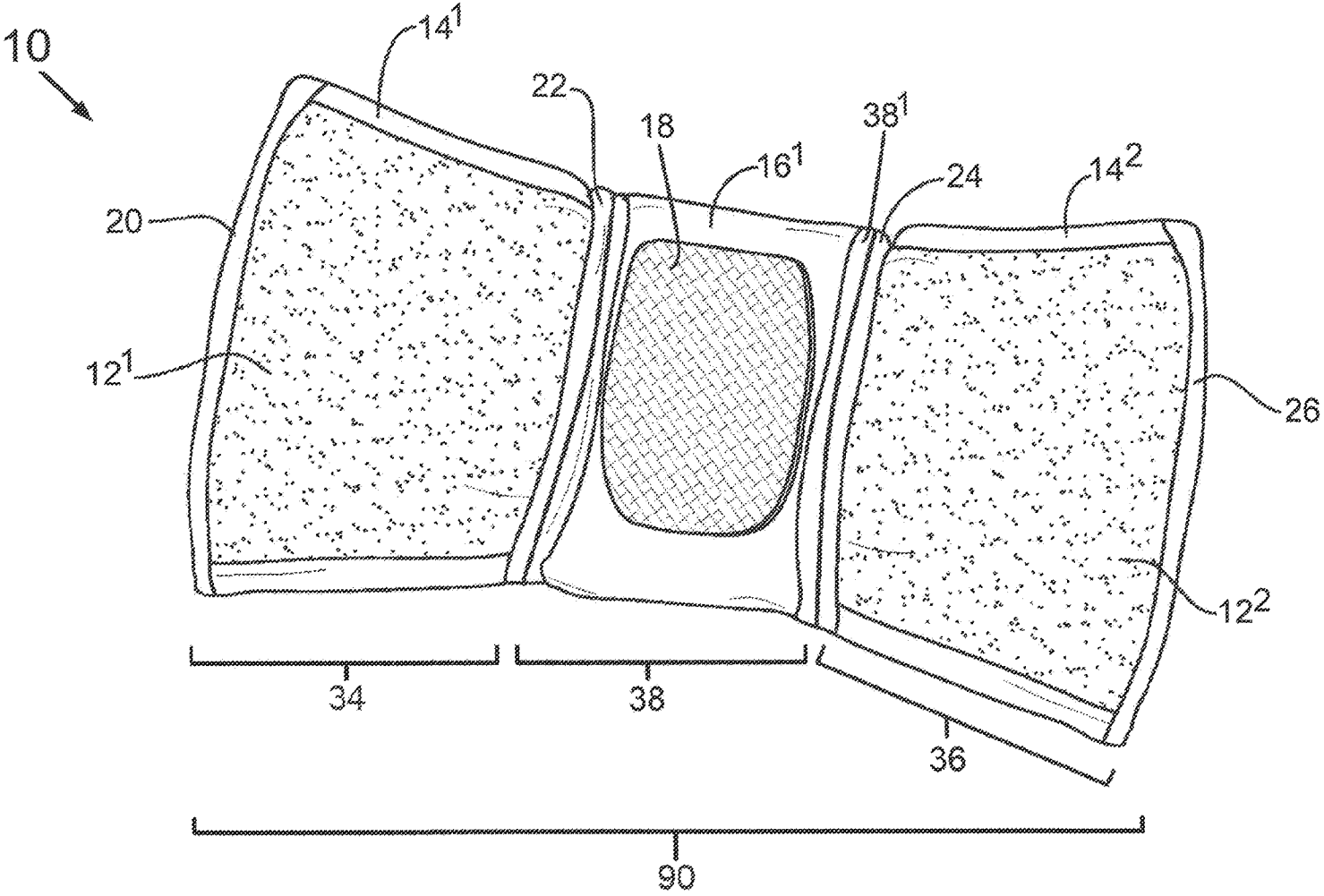
FIG. 1A illustrates a front perspective view of a wristwatch wrapper device, according to an embodiment of the present invention.
Figure 1D:
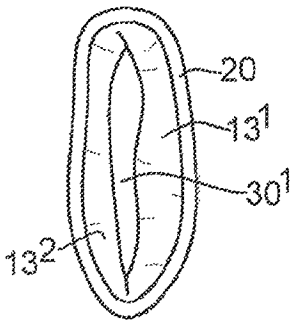
FIG. 1D illustrates a perspective side view of a first open end of the wristwatch wrapper device of FIG. 1B showing an opening therethrough the wristwatch wrapper device, according to an embodiment of the present invention.
Figure 1E:
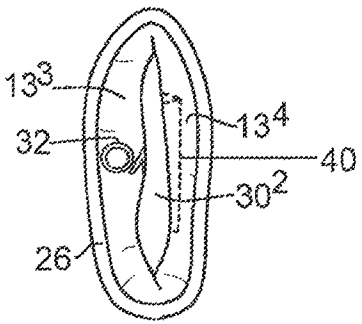
FIG. 1E illustrates a perspective side view of a second open end of the wristwatch wrapper device of FIG. 1B showing an opening therethrough the wristwatch wrapper device, according to an embodiment of the present invention.
Figure 1B:
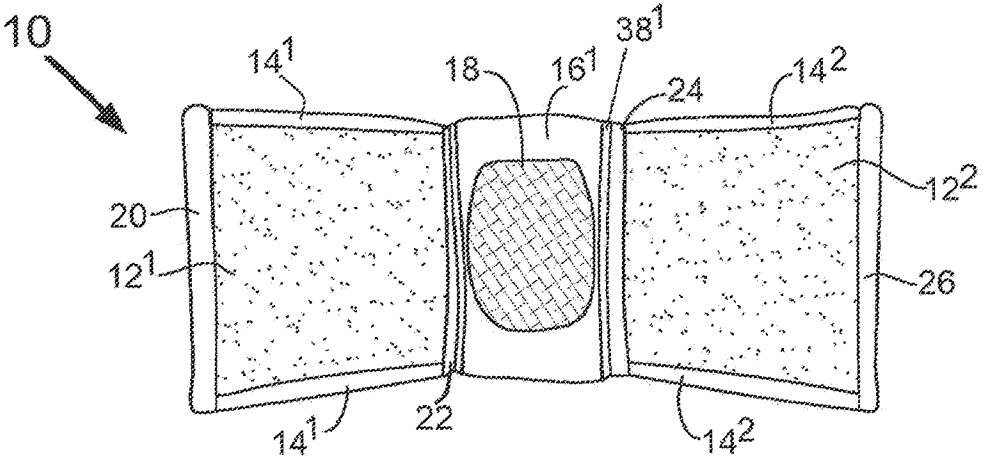
FIG. 1B illustrates a front planar perspective view of the wristwatch wrapper device of FIG. 1A, according to an embodiment of the present invention.
Figure 1C:
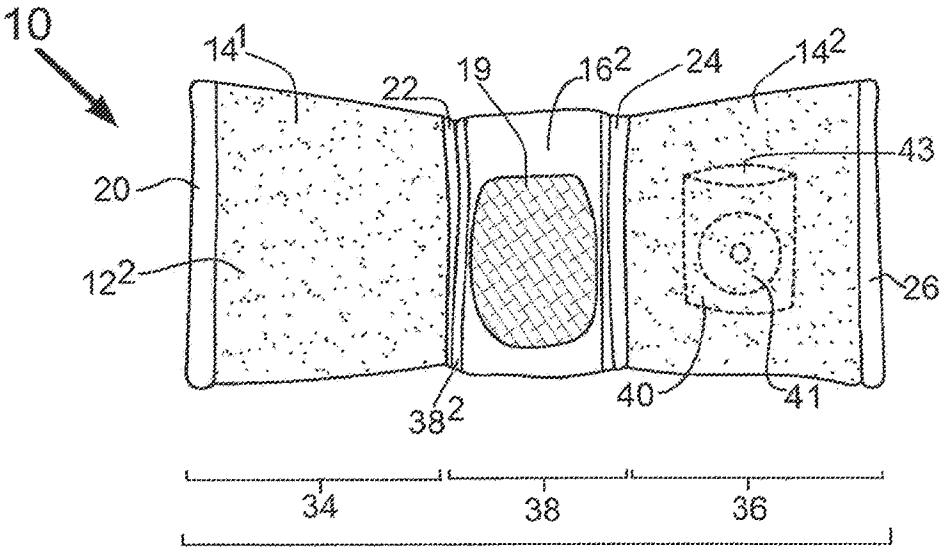
FIG. 1C illustrates a rear perspective view of the wristwatch wrapper device of FIG. 1B showing a housing having a transferrable smart device contained therein, according to an embodiment of the present invention.
Figure 2A:
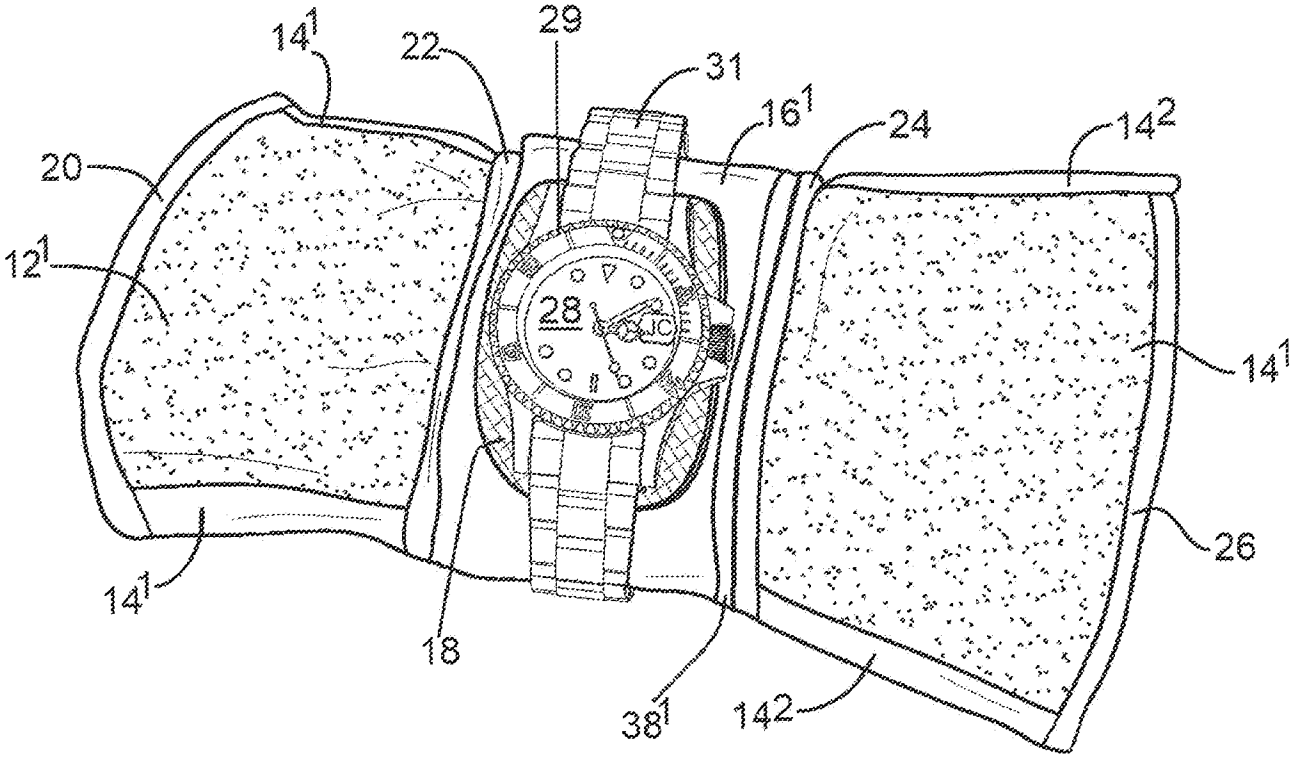
FIG. 2A illustrates a perspective front view of the wristwatch wrapper device of FIG. 1 showing a wristwatch and a proximate portion of a bracelet mounted thereon a transferable mounting panel assimilated with a mounting portion of the wristwatch wrapper device, according to an embodiment of the present invention.
Figure 2B:
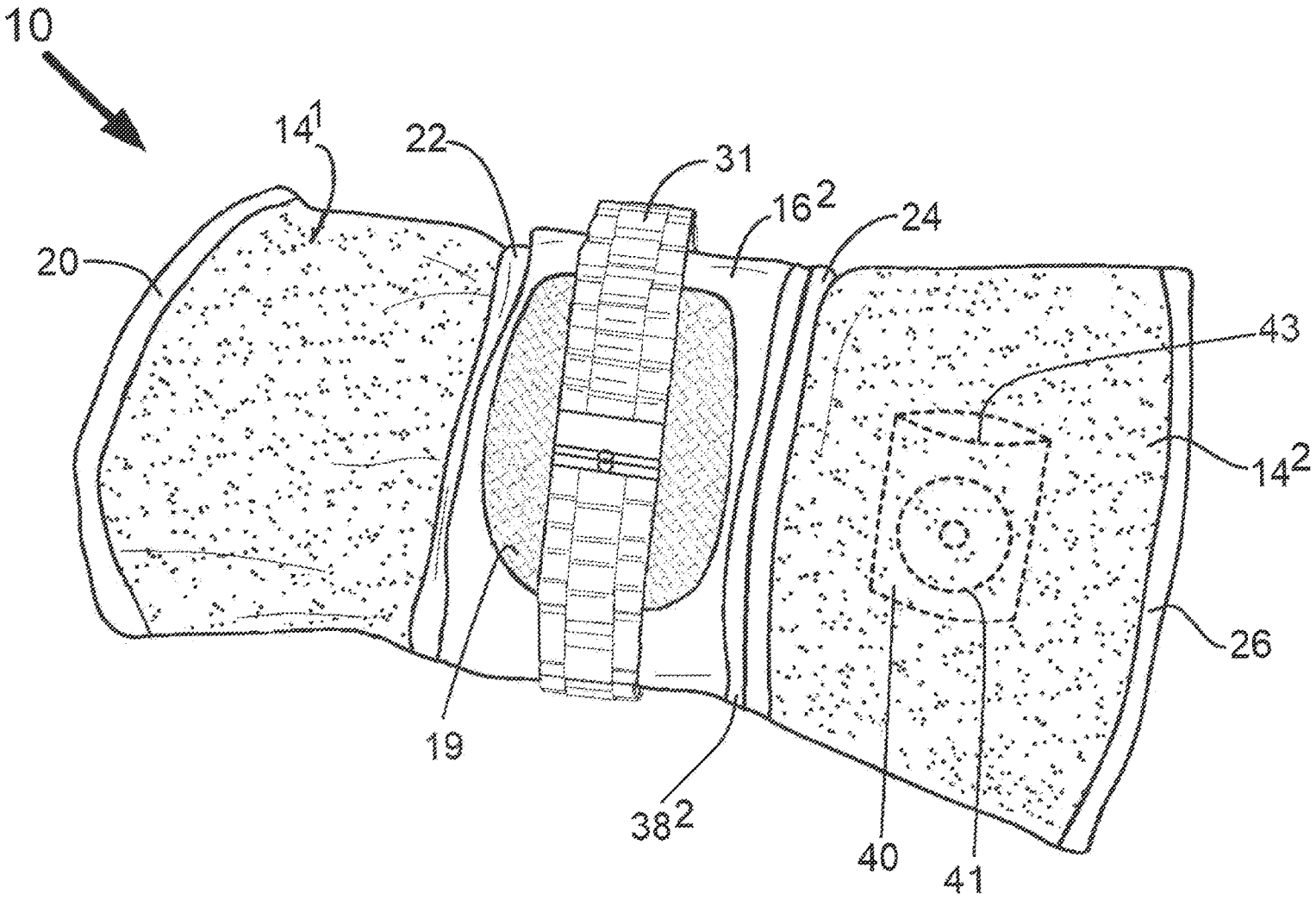
FIG. 2B illustrates a perspective rear view of the wristwatch wrapper device of FIG. 2A showing a distal portion of the wristwatch mounted thereon a posterior portion of the transferable mounting panel assimilated with the mounting portion of the wristwatch wrapper device, and showing a transferrable smart device contained therein a portion of the wristwatch wrapper device, according to an embodiment of the present invention.
Figure 3A:
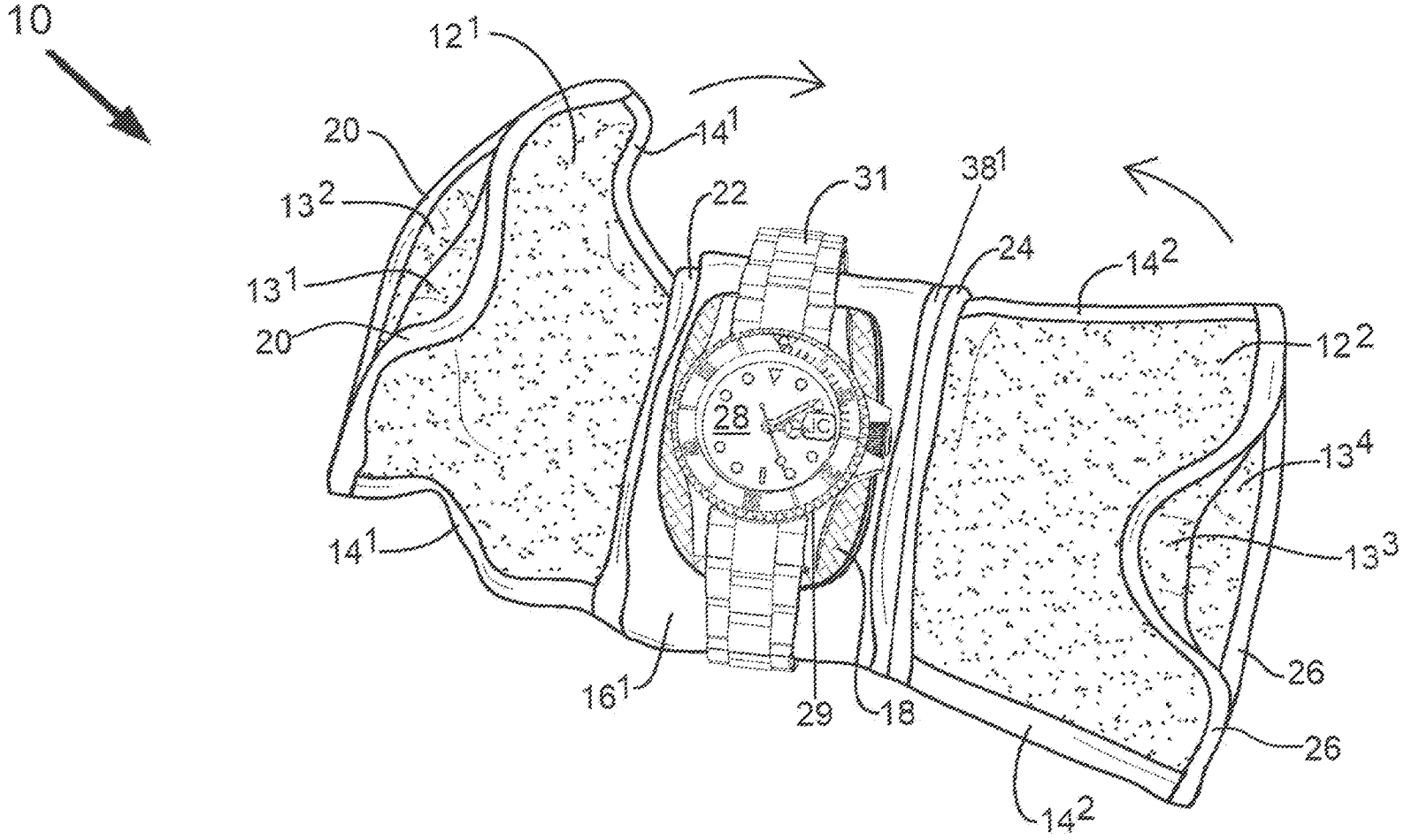
FIG. 3A illustrates a perspective front view of the wristwatch wrapper device of FIG. 2A showing the wristwatch mounted on the transferable mounting panel, a first flexible cuff portion being upturned and a second flexible cuff portion being upturned to interface with each other, according to an embodiment of the present invention.
Figure 3C:
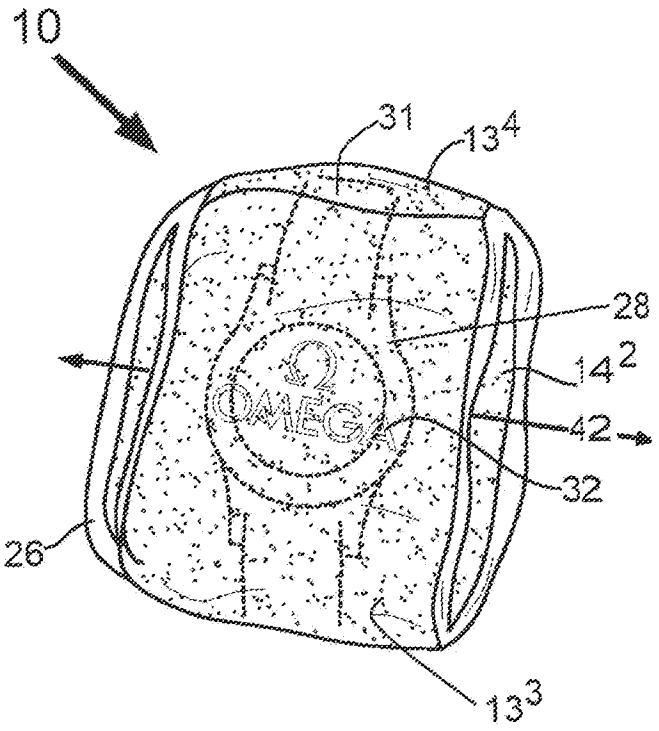
FIG. 3C illustrates a front perspective view of the wristwatch wrapper device of FIG. 3B showing the second flexible cuff portion being upturned and reversed inside-out to envelop the first flexible cuff portion to form a torus-shaped wristwatch wrapper device showing a logo, and the wristwatch, indicated in dotted lines, secured behind the first flexible cuff portion enveloped by the second flexible cuff portion, according to an embodiment of the present invention.
Figure 3B:
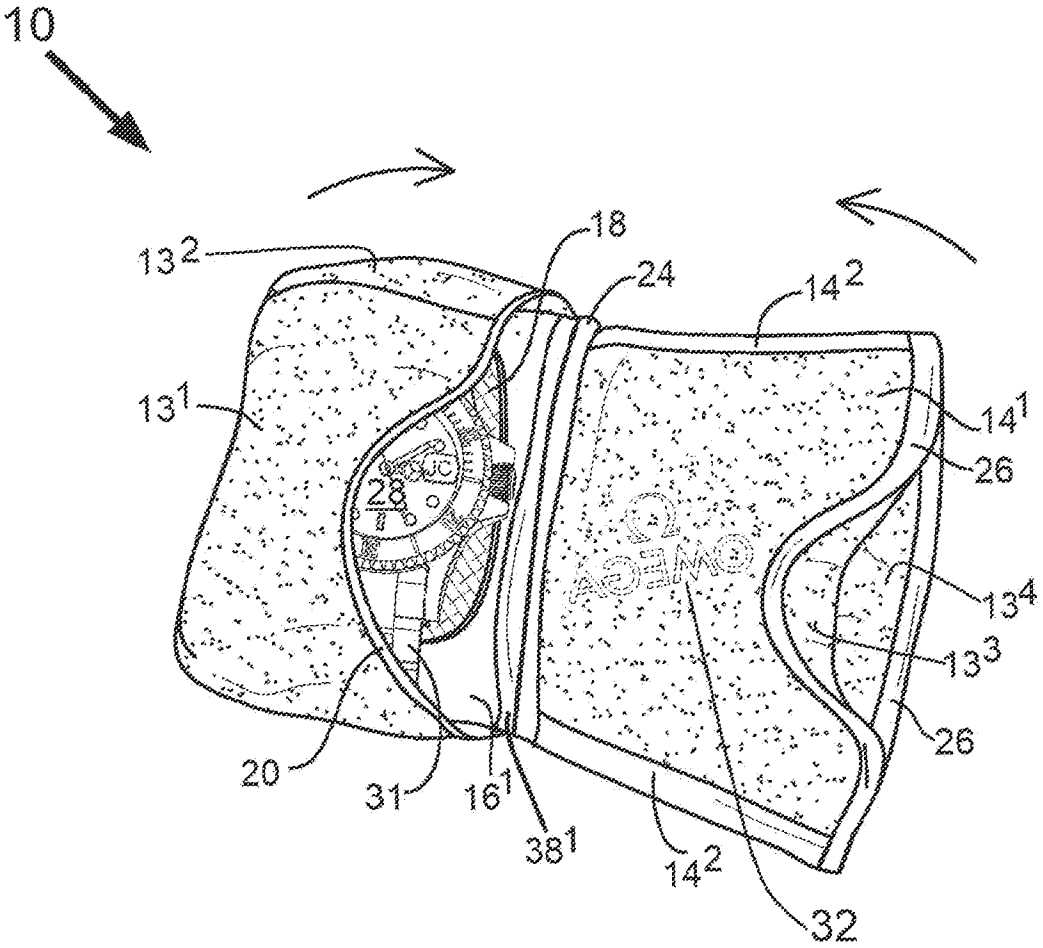
FIG. 3B illustrates a front perspective view of the wristwatch wrapper device of FIG. 3A showing the first flexible cuff portion being upturned and reversed inside-out being enveloped around a front portion of the wristwatch, and a second flexible cuff portion in an unfolded state, according to an embodiment of the present invention.
Figure 3E:
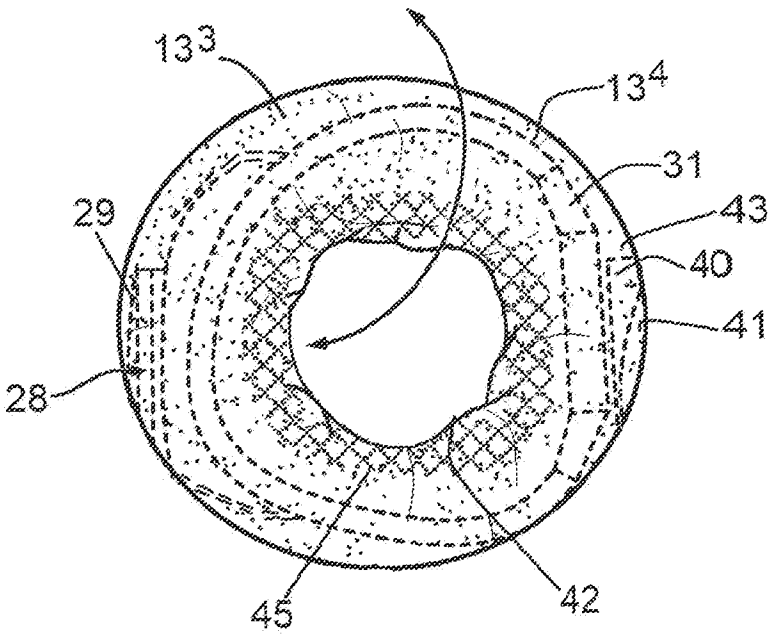
FIG. 3E illustrates a side perspective view of the torus-shape wristwatch wrapper device of FIG. 3C showing a gripping ring, according to an embodiment of the present invention.

FIGS. 1A-3E illustrate a wristwatch wrapper device 10 according to an embodiment and aspects of the present invention. FIGS. 1A-3A, illustrate the wristwatch wrapper device 10 configured in a flattened state wherein FIGS. 2A and 3A-3B show a front perspective of a wristwatch mounted on a mounting portion 38 of the wristwatch wrapper device 10. FIG. 2B shows a rear perspective view of the wristwatch 28 mounted on the mounting portion 38, of FIG. 2A. FIG. 1D shows a side perspective view of a first side of the wristwatch wrapper device of FIGS. 1A and 1B, and FIG. 1C shows a side perspective view of a second side of the wristwatch wrapper of FIGS. 1A and 16. FIG. 3B illustrates the wristwatch wrapper device 10 in a partial folded state wherein the wristwatch 28 is mounted on the mounting portion 38 of the wristwatch wrapper device 10. FIGS. 3C-3E shows the wristwatch wrapper device 10 configured in a torus-shaped wristwatch wrapper device 10 having a gripping ring 42, as depicted in FIG. 3E, and having a design or a logo 32, as shown in FIG. 3C. In particular, FIG. 3C depicts the logo 32 of a wristwatch maker, for example, OMEGA®. The wristwatch wrapper device 10 is implemented as the torus-shaped wristwatch wrapper device 10 for temporarily holding or storing the wristwatch 28, as shown in FIGS. 2A-2B and FIGS. 3A-3E, when a user is not currently wearing the wristwatch 28, particularly, when the user is in transit, for example, as the user is travelling through an airport.

The design or the logo 32 can include a registered trademark including a logo plus a Stylized design owned by the manufacturer of the wristwatch 28 wherein the registered trademark is licensed to the user of the wristwatch 28, or a registered trademark including a mark or trademark plus the stylized design owned by the user of the wristwatch 28 or the owner of the wristwatch 28. A mark or trademark plus the stylized design, hereinafter, means the mark or trademark and a design element including a word, phrase, symbol, design, or a combination thereof that identifies the source of the goods, i.e., the wristwatches.

FIGS. 4A-4G illustrate a wristwatch wrapper device 100, according to another embodiment and aspects of the present invention. The wristwatch wrapper device 100 includes a closed dual-seamed orbicular wristwatch wrapper device 100. The wristwatch wrapper device 100 and the closed dual-seamed orbicular wristwatch wrapper device 100 hereinafter are used interchangeably to mean the same embodiment of the wristwatch wrapper device 100 depicted in FIGS. 4A-4G. The closed dual-seamed orbicular wristwatch wrapper device 100 includes a removably coupled to a first metal ring-spring gate O-ring 80 which is fixedly integrated into a first segment of a second elasticized selvage 26 of a tubular body 90 of the wristwatch wrapper device 100. A first metal swivel carabiner hinge 82 having a first swivel connector 84 is removably coupled to the first metal ring-spring gate O-ring 80. The wristwatch wrapper device 100 having the closed dual-seamed orbicular wristwatch wrapper configuration, includes the first metal ring-spring gate O-ring 80 fixedly integrated into a first segment of the second elasticized selvage 26 of the tubular body 90. The first metal swivel carabiner hinge 82 and its first swivel connector 84 is removably coupled to the first metal ring-spring gate O-ring 80. In another embodiment of the present invention, a second metal ring-spring gate O-ring 96 is removably coupled to a second portion of the second elasticized selvage 26 of the wristwatch wrapper device 100 including a second metal swivel carabiner hinge having a second swivel connector 84 is removably coupled to the second metal ring-spring gate O-ring. In this exemplary embodiment, a cross-body strap 111 is implemented such that the user can carry the wristwatch wrapper device 100 across their upper body.

Figure 4A:
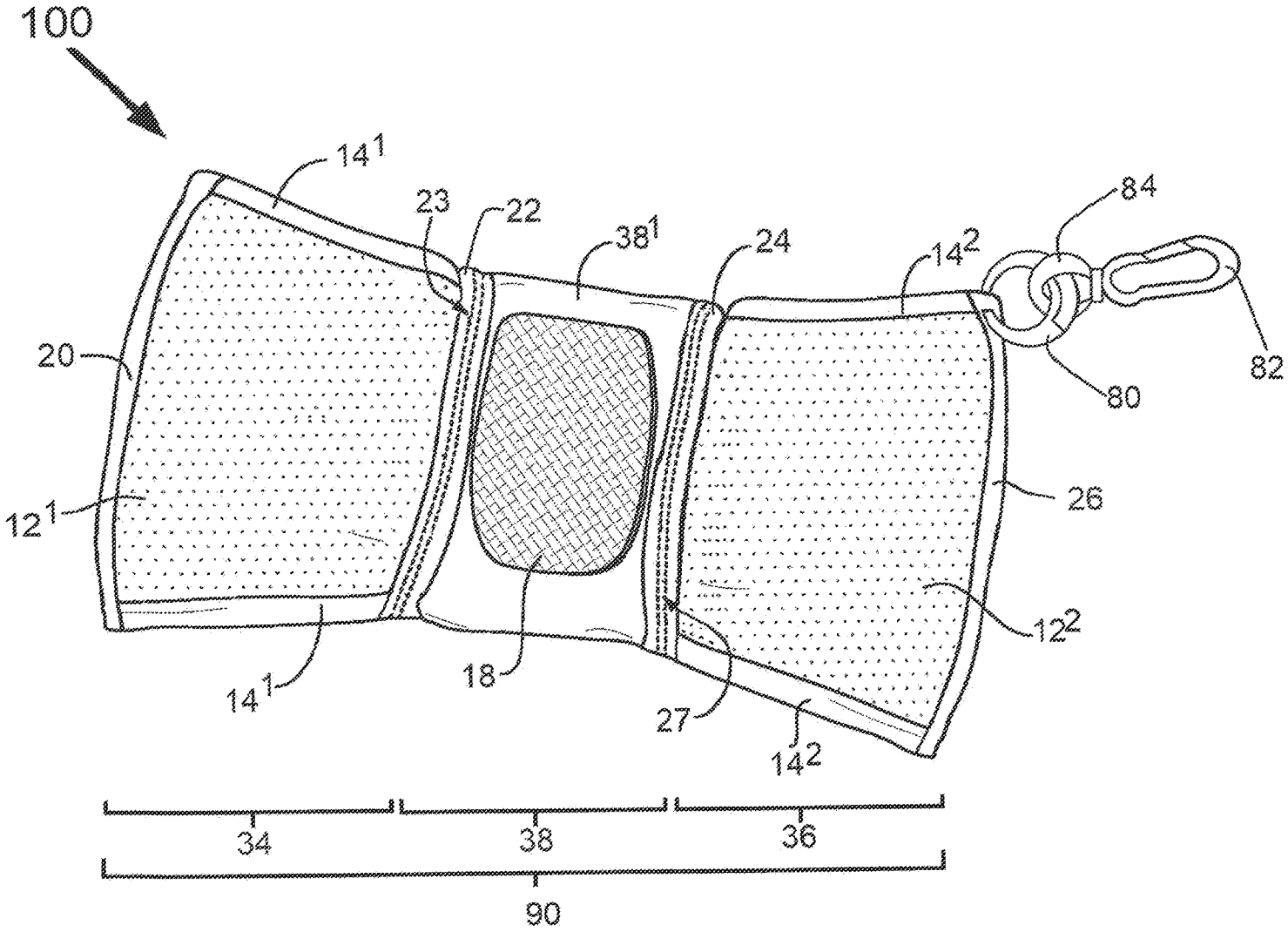
FIG. 4A illustrates a front perspective view of a wristwatch wrapper device showing a mounting portion framed by a stitched piping framework, and a metal ring-spring gate O-ring removably coupled to a second elasticized selvage which is removably coupled to a metal swivel carabiner hinge having a swivel connector, according to an embodiment of the present invention.
Figure 4B:
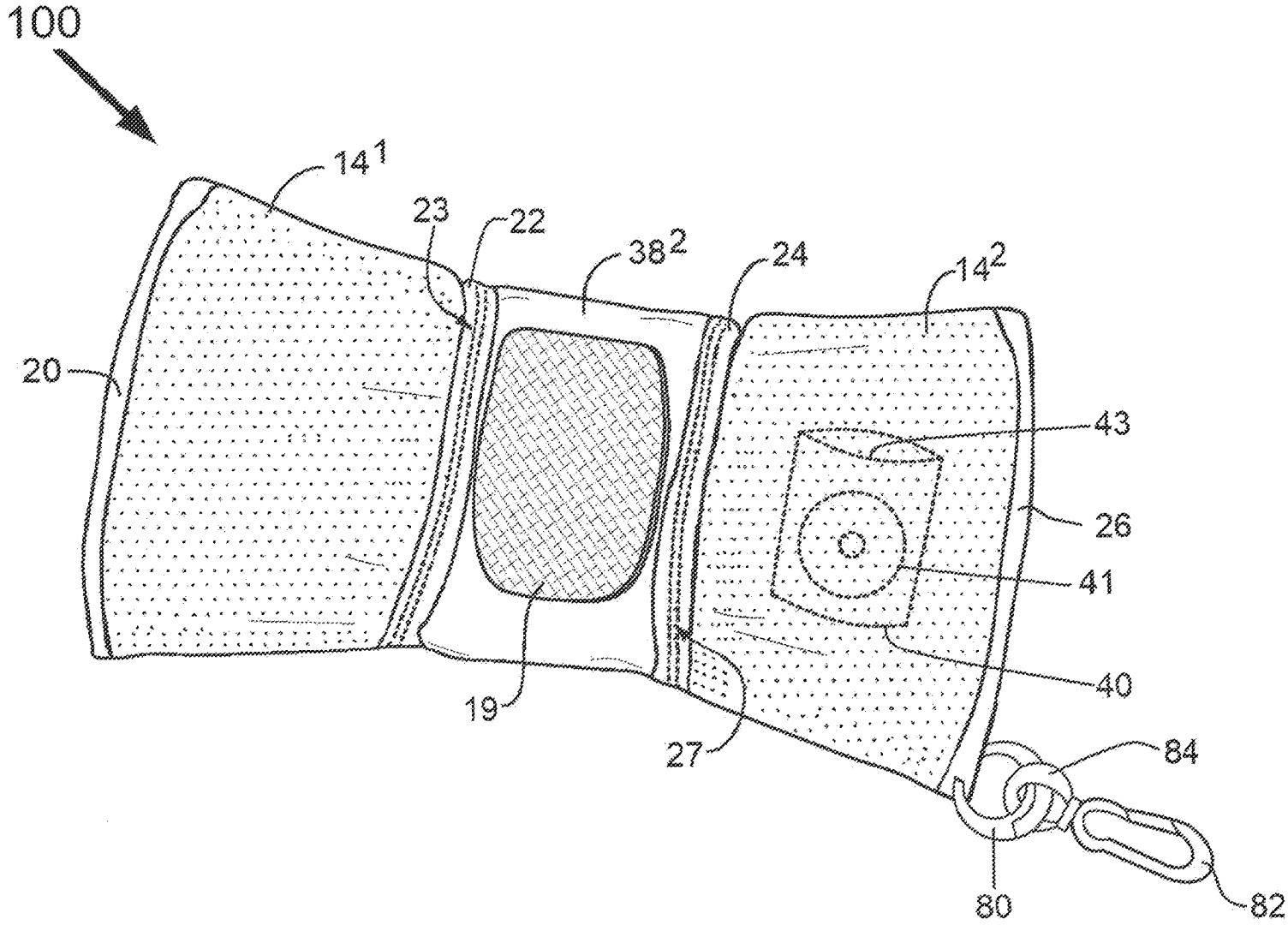
FIG. 4B illustrates a rear perspective view of the wristwatch wrapper device of FIG. 4A, showing the metal ring-spring gate O-ring, the metal swivel carabiner hinge having the swivel connector, and showing a housing having a transferrable smart device contained therein, according to an embodiment of the present invention.
Figure 4C:
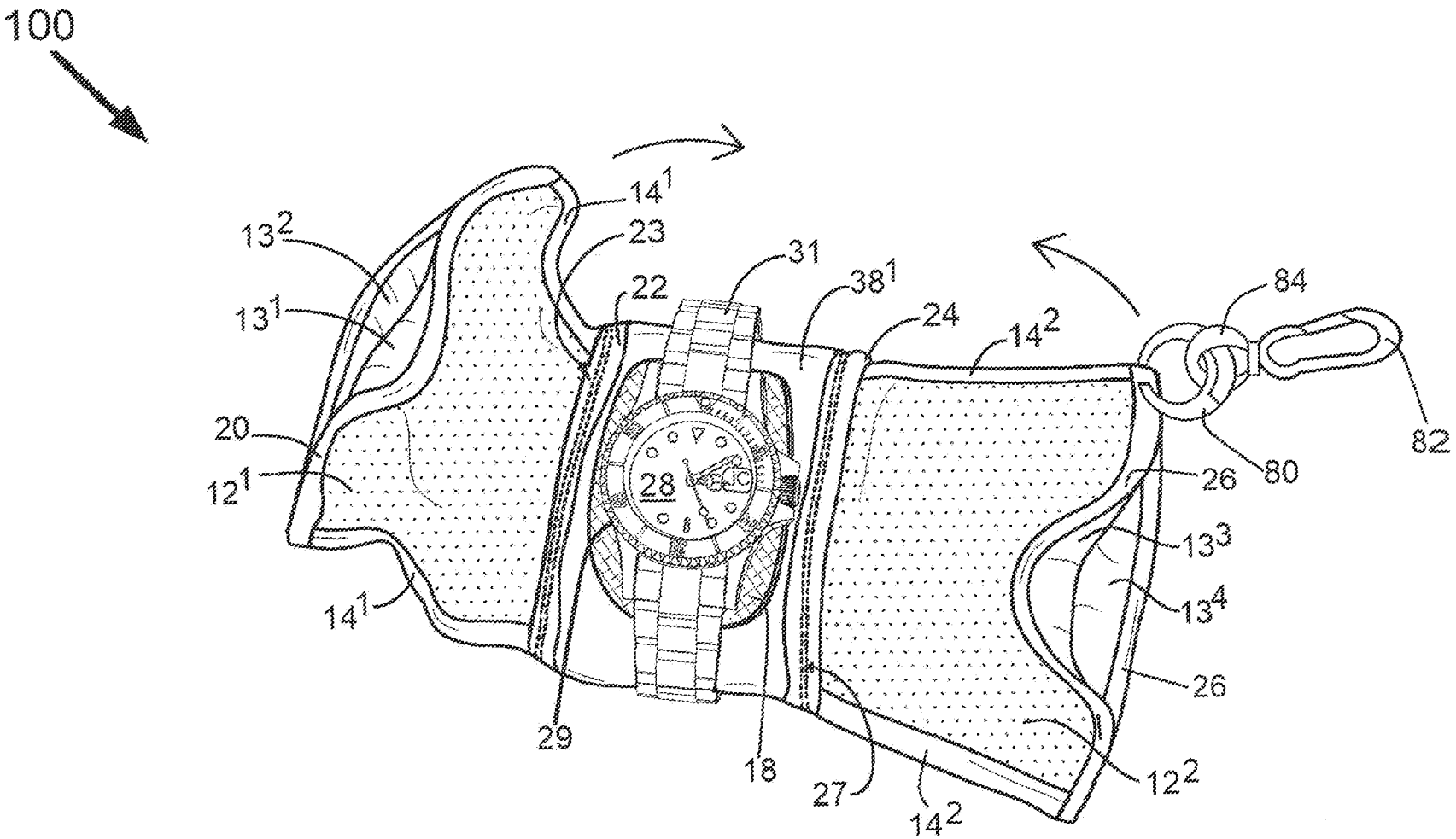
FIG. 4C illustrates a front perspective view of the wristwatch wrapper device of FIG. 4A showing a wristwatch mounted a mounting portion and showing a first flexible cuff portion being upturned and a second flexible cuff portion being upturned towards the first flexible cuff portion, according to an embodiment of the present invention.
Figure 4D:
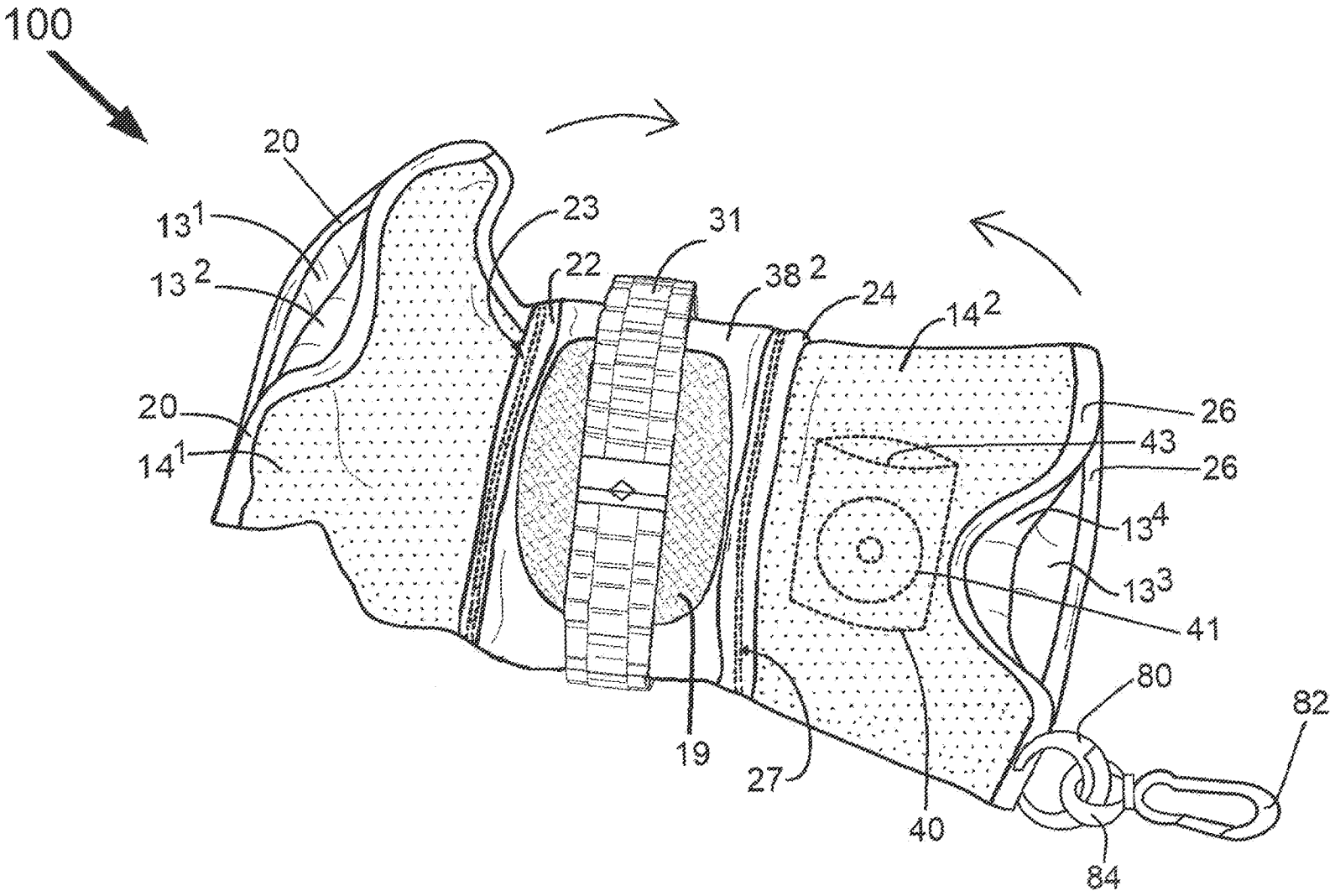
FIG. 4D illustrates a rear perspective view of the wristwatch of FIG. 4C showing the rear view of the wristwatch mounted on the mounting portion showing the first flexible cuff portion being upturned and the second flexible cuff portion upturned towards the first flexible cuff portion, and showing a housing and a transferable smart device therein, according to an embodiment of the present invention.
Figure 4F:
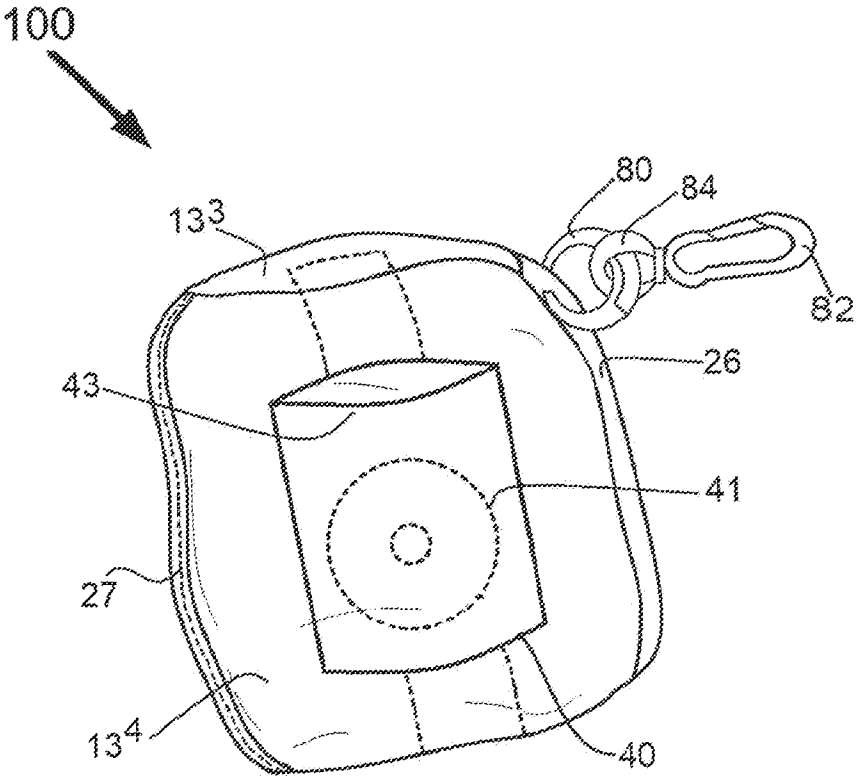
FIG. 4F illustrates a rear perspective view of the wristwatch wrapper device of FIG. 4E showing the closed dual-seamed orbicular wristwatch wrapper device showing a bracelet portion of the wristwatch secured therein, illustrated in dotted lines, showing a housing having a transferable smart device contained therein, illustrated in dotted lines, and showing the metal ring-spring gate O-ring and the metal spring snap link clip, according to an embodiment of the present invention.
Figure 4E:
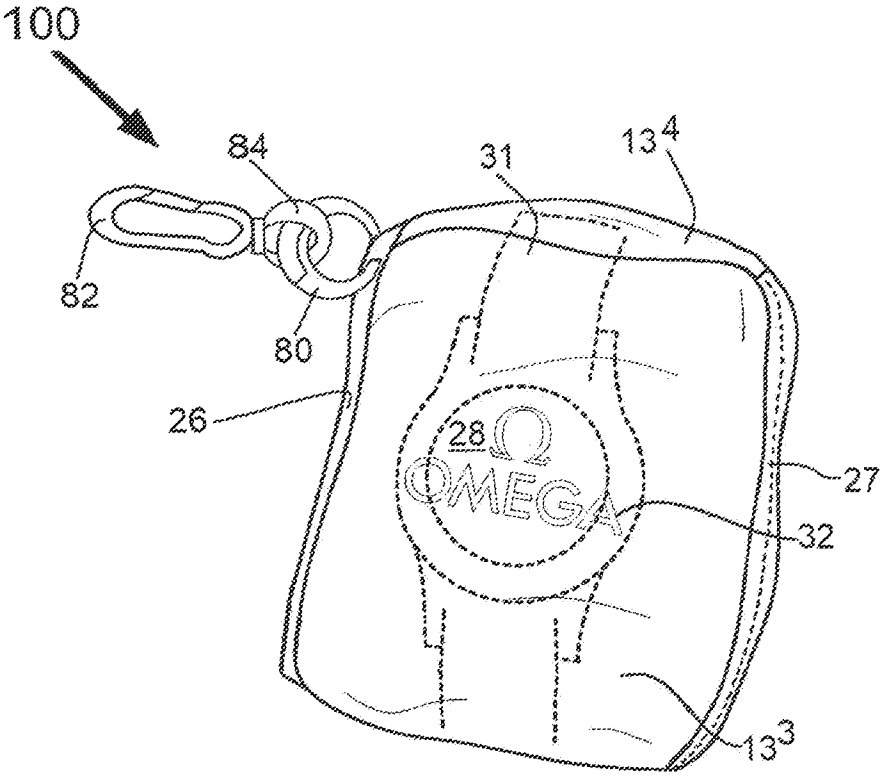
FIG. 4E illustrates a front perspective view of the wristwatch wrapper device of FIG. 4C in a wrapped state showing a closed dual-seamed orbicular wristwatch wrapper device enveloping a wristwatch therein, showing a logo, and the metal ring-spring gate O-ring removably coupled to the metal swivel carabiner hinge having the swivel connector, according to an embodiment of the present invention.
Figure 4G:
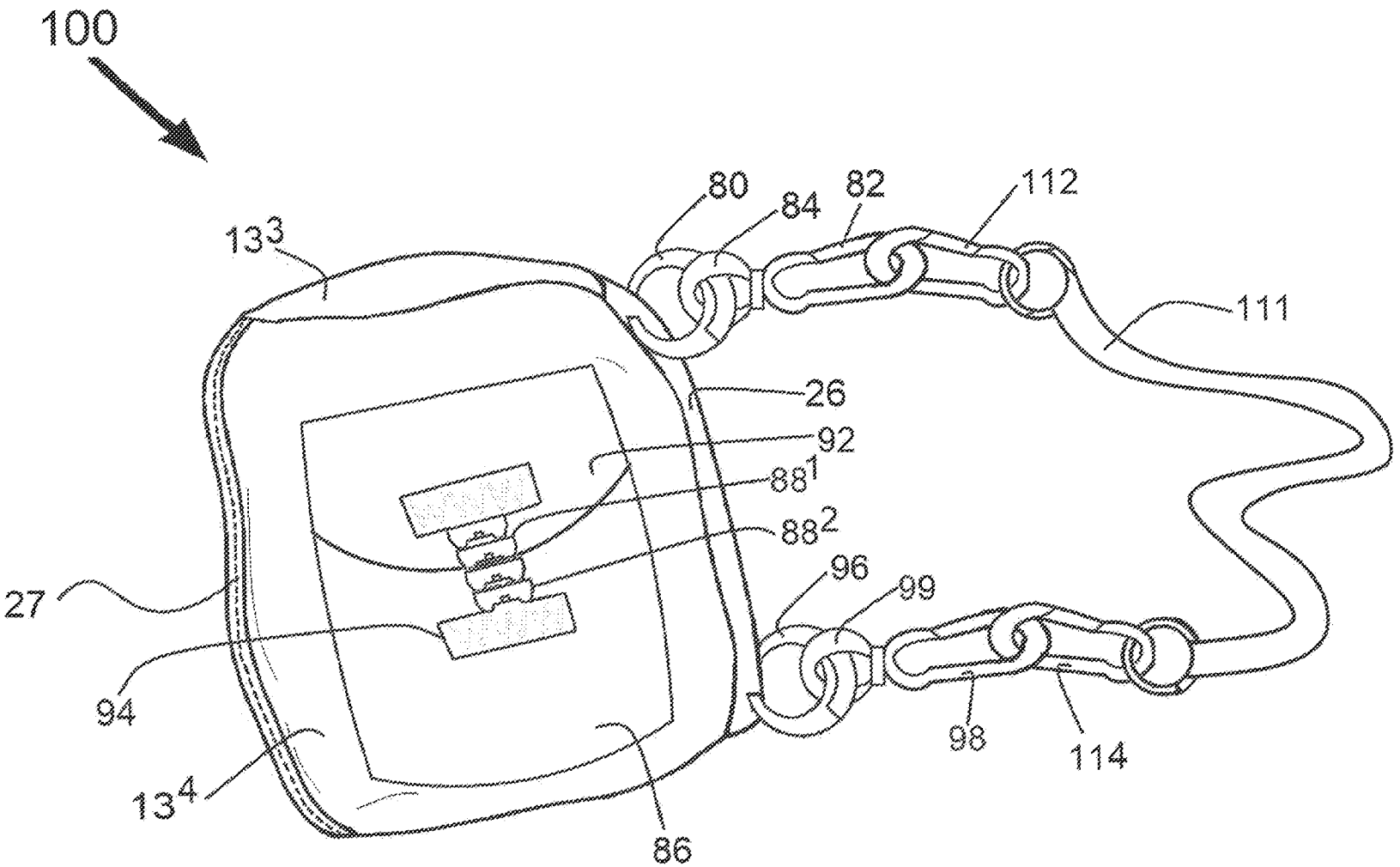
FIG. 4G illustrates a rear perspective view of the wristwatch wrapper device of FIG. 4E, further showing a pocket fixedly attached to a posterior portion of the wristwatch wrapper device including a flap and a decorative latch, and a cross-body strap, according to another embodiment of the present invention.

The wristwatch wrapper device 100 in an exemplary embodiment of the present invention, also, includes a pocket 86 having a flap 92 configured with a decorative latch 88, as shown in FIG. 4G.

Figure 5A:
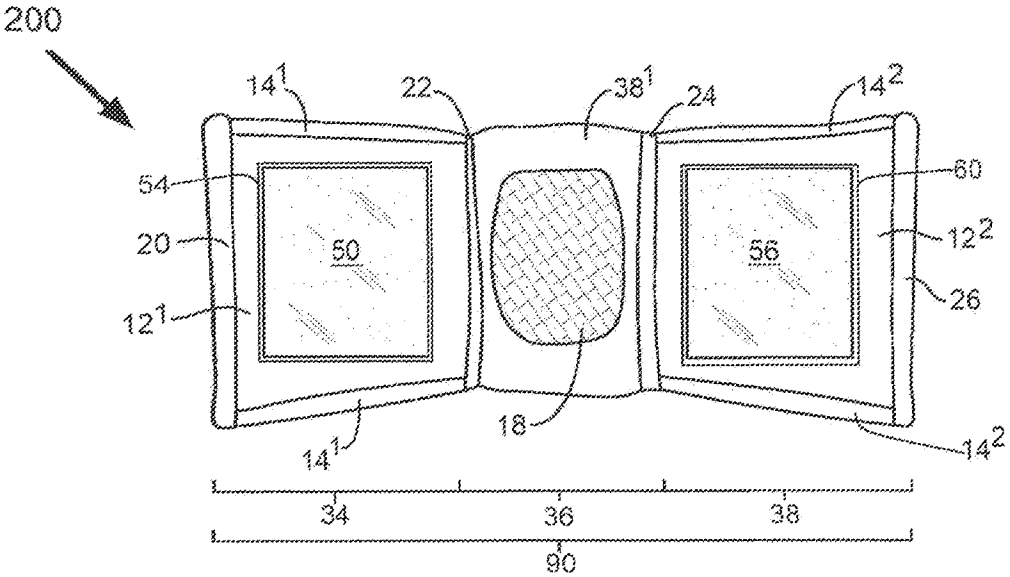
FIG. 5A illustrates a front perspective view of a wristwatch wrapper device showing a first flexible cuff portion, a second flexible cuff portion, and a central mounting portion therebetween, having a first viewing window disposed at the first flexible cuff portion and a second viewing window disposed at the second flexible cuff portion, according to an embodiment of the present invention.
Figure 5B:
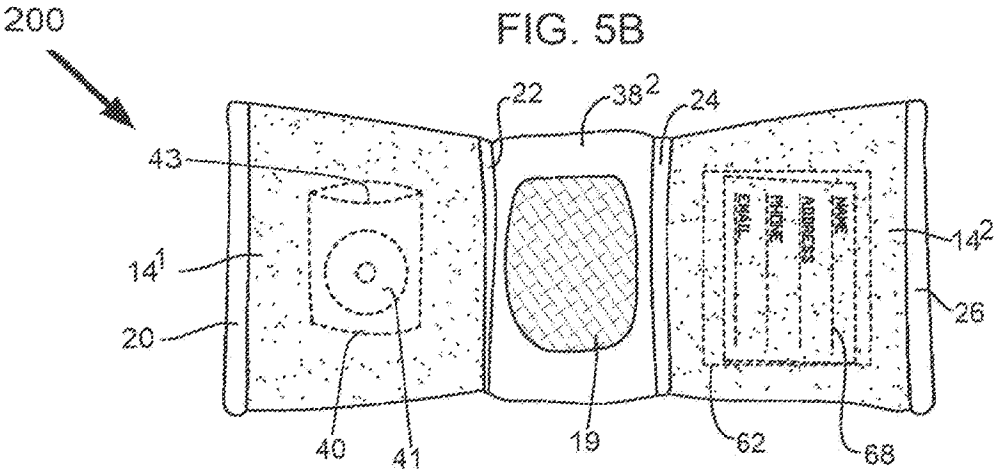
FIG. 5B illustrates a rear perspective view of the wristwatch wrapper device of FIG. 5A showing a third viewing window containing an identification card, illustrated with dotted lines, disposed therein, and showing a housing having a transferable smart device contained therein, indicated by dotted lines, contained therein the first flexible cuff portion, according to an embodiment of the present invention.
Figure 5C:
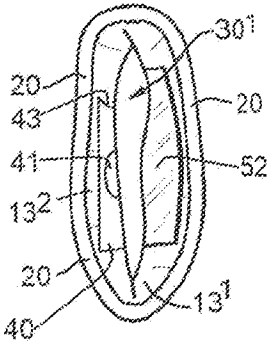
FIG. 5C is a perspective view of a first side of the wristwatch wrapper device of FIG. 5A, showing a first open end, according to an embodiment of the present invention.
Figure 5D:
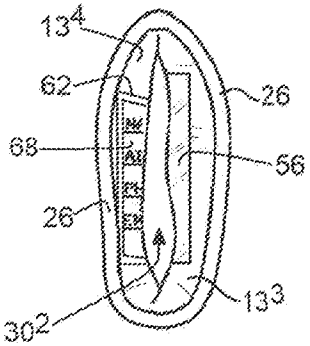
FIG. 5D is a perspective view of a second side of the wristwatch wrapper device of FIG. 5A showing a second open end, according to an embodiment of the present invention.
Figure 5F:
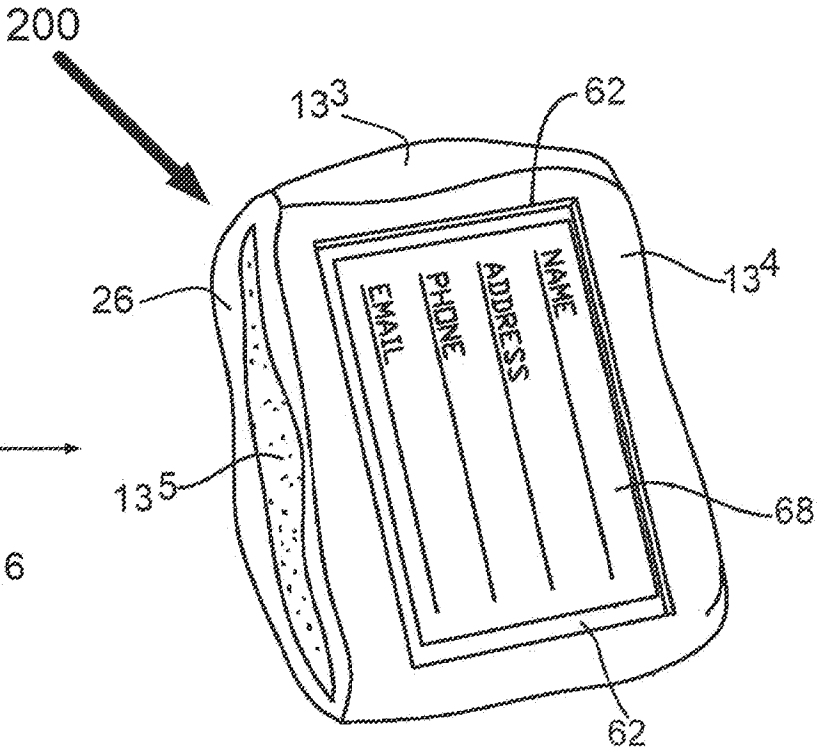
FIG. 5F is a rear perspective view of the wristwatch wrapper device of FIG. 5E showing the third viewing window having an identification card therein, according to an embodiment of the present invention.
Figure 5E:
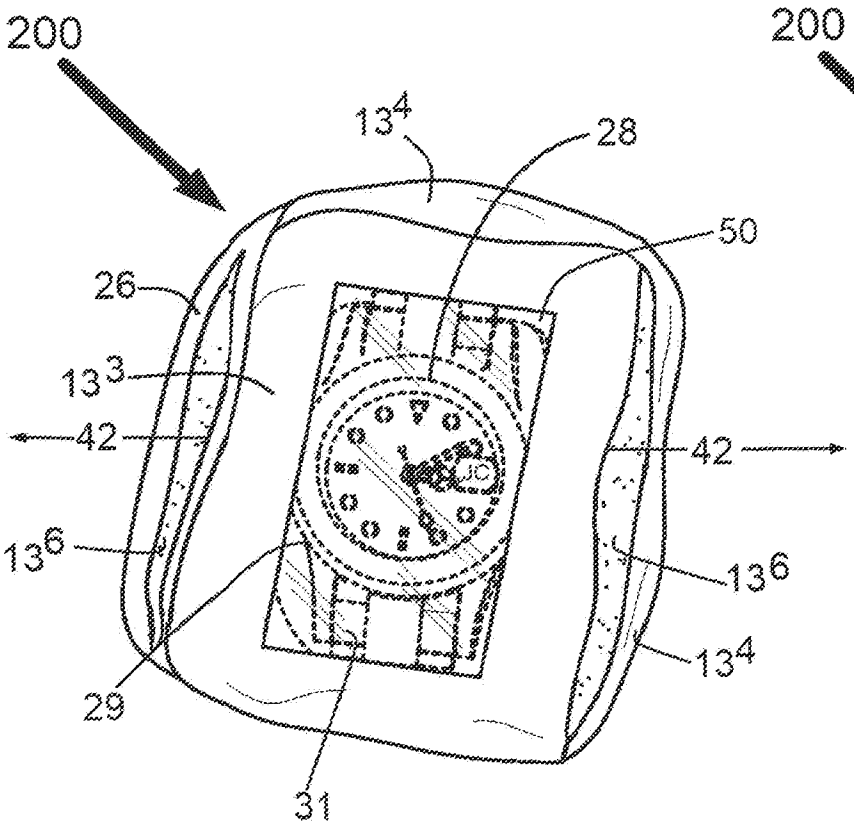
FIG. 5E is a perspective view of the wristwatch wrapper device of FIG. 5A folded in a torus-shaped wristwatch wrapper device having a gripping ring and showing a wristwatch therethrough the second viewing window overlaying the first viewing window, according to an embodiment of the present invention.
Figure 5G:
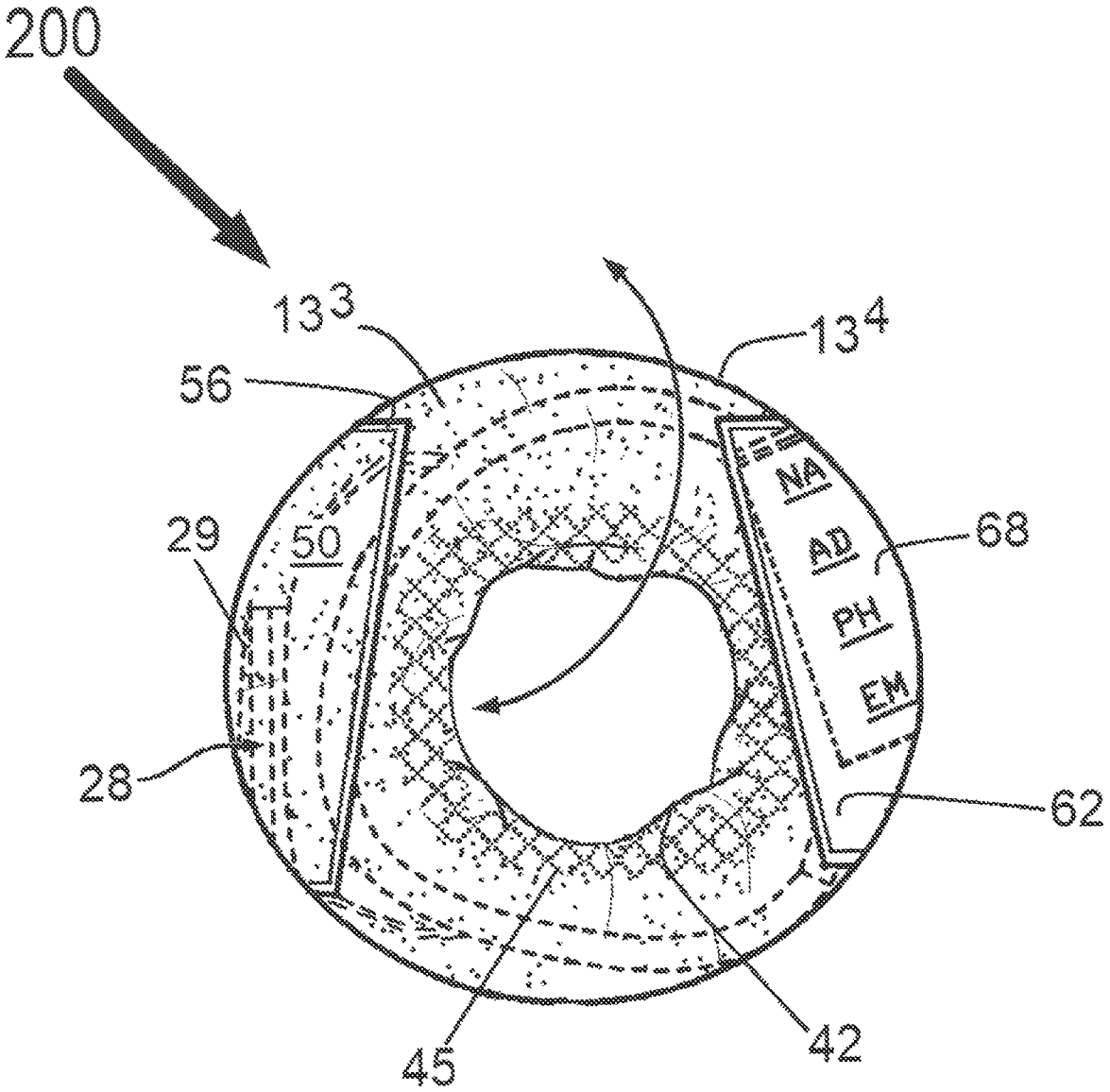
FIG. 5G is a side perspective view of the wristwatch wrapper device of FIG. 5E showing the torus-shaped wristwatch shaped wrapper device having the gripping ring, according to an embodiment of the present invention.

FIGS. 5A-5G illustrate another embodiment of a wristwatch wrapper device 200 including a first viewing window 50, a second viewing window 56, a third viewing window 62. The wristwatch wrapper device 200 in a folded state is configured in a torus-shaped wristwatch wrapper device 200 configuration having a gripping ring 42, as shown in FIG. 5G. A wristwatch 28 mounted on a mounting portion 38 can be viewed therethrough the first viewing window 50 and the second viewing window 56. One or more of the identification cards 68 is slidably inserted into a cavity of the third viewing window 62.

Turning to FIGS. 1A-3E, a wristwatch wrapper device is shown, according to an exemplary embodiment of the present invention. FIG. 1A shows a front perspective view of a wristwatch wrapper device designated at 10, in an unfolded or flattened state. FIG. 1B illustrates a front planar perspective view of the wristwatch wrapper device 10 in an unfolded or flattened state. FIG. 1C illustrates a rear perspective view of the wristwatch wrapper device 10. FIG. 1C shows a rear perspective view of the wristwatch wrapper device 10 showing a transferrable smart device 41 contained therein. FIG. 1D, with reference to FIGS. 1A and 1B, shows a perspective side view of a first open end $\mathbf{30}^1$ of the wristwatch wrapper device 100 showing a tubular open channel 30 therethrough the wristwatch wrapper device 10. FIG. 1E, with reference to FIGS. 1A and 16, shows a perspective side view of a second open end $\mathbf{30}^2$ of the tubular open channel 30 of the wristwatch wrapper device 10 showing the opening therethrough the wristwatch wrapper device 10.

With reference to FIGS. 1A-1E, FIG. 2A-2B, and FIG. 3A, the wristwatch wrapper device 10 includes a tubular body 90 configured having a lateral direction and a circumferential direction. The tubular body 90 includes an anterior material layer 12 formed joined to a posterior material layer 14 reinforced with an interior lining material 13, as shown in FIGS. 1D, 1E, 3A-3C circumventing a tubular open channel 30. The interior lining material is shown having a first interior lining material portion $\mathbf{13}^1$, a second interior lining material portion $\mathbf{13}^2$, a third interior lining material portion $\mathbf{13}^3$, and a fourth interior lining material portion $\mathbf{13}^4$.

FIGS. 1A-1E shows the tubular open channel 30 includes a first open end $\mathbf{30}^1$ limited by a first circumferential tubal body edge, and a second open end $\mathbf{30}^2$ limited by a second circumferential tubal body edge. FIG. 1D together with FIG. 1E illustrates a side perspective view of the tubular body 90 of the wristwatch wrapper device 10 including the tubular open channel 30 of the wristwatch wrapper device 10 demonstrating the tubular open channel 30 of the tubular body 90 extending therethrough to the first open end $\mathbf{30}^1$ of the tubular body 90 to the second open end $\mathbf{30}^2$ of the tubular body 90 of the wristwatch wrapper device 10.

FIGS. 1A-3A, shows the tubular body 90 of the wristwatch wrapper device 10 includes a first elasticized selvage 20 integrated with the first circumferential tubal body edge circumventing the first open end $\mathbf{30}^1$ of the tubular open channel 30 of the tubular body 90 and a second elasticized selvage 26 is integrated with the second circumferential tubal body edge circumventing the second open end $\mathbf{30}^2$ of the tubular body 90 of the wristwatch wrapper device 10. The first elasticized selvage 20 provides for flexibility and a secure wrapping mechanism when a first flexible cuff portion 34 of the tubular body 90 of the wristwatch wrapper device 10 is upturned and reversed inside-out and is wrapped around the wristwatch 28 mounted on the mounting portion 38 of the wristwatch wrapper device 10 as shown in FIGS. 2A-3E. The second elasticized selvage 26 provides for flexibility and a secure wrapping mechanism when the second flexible cuff portion 36 is upturned and reversed inside-out and wrapped around the first flexible cuff portion 34 to secure and safeguard the wristwatch 28 mounted on the mounting portion 38 of the tubular body 90 of the wristwatch wrapper device 10, as shown in FIGS. 2A-3E, according to the exemplary embodiment of the present invention.

As shown in FIGS. 1A-1C, FIGS. 2A and 2B, and FIG. 3A, the first elasticized selvage 20 and the second elasticized selvage 26 of the tubular body 90 are separated by a first flexible cuff portion 34 and a second flexible cuff portion 36 having a mounting portion 38 centrally disposed therebetween the first flexible cuff portion 34 and the second flexible cuff portion 36. The mounting portion 38 includes an anterior face $\mathbf{38}^1$, as shown in FIGS. 1A-1B, 2A, 3A-3B, and a posterior face $\mathbf{38}^2$, as shown in FIGS. 1C and 2B. The mounting portion 38 is framed with a first circumferential mounting edge and a second circumferential mounting edge wherein the first circumferential mounting portion edge is integrated with a first piping 22 and the second circumferential mounting portion edge is integrated with a second piping 24. The first piping 22 and the second piping 24 circumvents the tubular body 90 at each of the first circumferential mounting portion edge and the second circumferential mounting portion edge of the mounting portion 38 as depicted in a front perspective view of the wristwatch wrapper device 10 in FIG. 1A and a front planar view of the wristwatch wrapper device 10 in FIG. 1B, and as depicted in the rear perspective view of the wristwatch wrapper device 10 in FIGS. 1C and 2B.

Referring to FIGS. 1A-3B, in the exemplary embodiment of the present invention, the first elasticized selvage 20 and the second elasticized selvage 26 can include elastomeric bands that extend continuously and circumferentially around the first open end $\mathbf{30}^1$ and the second open end $\mathbf{30}^2$, respectively, of the tubular open channel 30 of the tubular body 90 of the wristwatch wrapper device 10. As shown in FIGS. 3A-3B, the first elasticized selvage 20 provides the first flexible cuff portion 34 with an elasticized seal as the first flexible cuff portion 34 is upturned and reversed inside-out and wrapped around the wristwatch 28 being mounted on the mounting portion 38 of the tubular body 90 of the wristwatch wrapper device 10. Similarly, as shown in FIGS. 3B-3D, the second elasticized selvage 26 provides a seal around the first flexible cuff portion 34 as the second flexible cuff portion 36 is upturned and reversed inside-out and wrapped around the first flexible cuff portion 34 to secure the wristwatch wrapper device 10 in a torus-shaped wristwatch wrapper device 10 configuration, as shown in FIGS. 3C-3D, thereby, securing and safeguarding the wristwatch 28 mounted on the mounting portion 38 of the tubular body 90 of the wristwatch wrapper device 10. The torus-shaped wristwatch wrapper device 10 includes a gripping ring 42, as shown in FIGS. 3C-3E. In this exemplary embodiment, the gripping ring 42 provides a mechanism for the user to insert the user's fingers therein to hold the wristwatch wrapper device 10. The gripping ring 42 includes a gripping material 45 to prevent the wristwatch wrapper device 10 from slipping from the user's fingers and hold on the wristwatch wrapper device 10.

The first elasticized selvage 20 and the second elasticized selvage 26 provide a secure elasticized seal to protect and safeguard the wristwatch 28 being mounted on the mounting portion 38 of the tubular body of the wristwatch wrapper device 10. In this manner, the wristwatch wrapper device 10 protects the wristwatch 28 against the intrusion of moisture, dust, ultraviolet rays, and damage. The first elasticized selvage 20 and the second elasticized selvage 26 are configured with a high amount of friction to hold the relevant portion of the first flexible cuff portion 34 and the relevant portion of the second flexible cuff portion 36 in place while, simultaneously, providing the elasticized seal enveloping the wristwatch 28.

The first elasticized selvage 20 and the second elasticized selvage 26 can be made of a polyurethane based elastomeric material, a silicone-based elastomeric material, or a combination thereof, that provides a high elastic modulus at the first open end $\mathbf{30}^1$ and the second open end $\mathbf{30}^2$ of each of the first flexible cuff portion 34 and the second flexible cuff portion 36, respectively, as shown in FIGS. 1A-3D. Thereby, increasing the tightness of the first flexible cuff portion 34 being upturned and reversed inside-out and wrapped around the wristwatch 28 and the second flexible cuff portion 36 is upturned and reversed inside-out and wrapped around the first flexible cuff portion 34 to secure and safeguard the wristwatch 28. The first elasticized selvage 20 and the second elasticized selvage 26 can have a width between 2.00 mm and 10.00 mm.

With a close inspection of FIGS. 1A-1B, 2A, 3A-3B, the first flexible cuff portion 34 includes a first portion of the anterior material layer $\mathbf{12}^1$. The first portion of the anterior material layer $\mathbf{12}^1$ of the first flexible cuff portion 34 is formed with a first top borderline portion which includes a first overlapping portion of the first portion of the posterior material layer $\mathbf{14}^1$. Similarly, the first portion of the anterior material layer $\mathbf{12}^1$ of the first flexible cuff portion 34 includes a second overlapping portion of the first portion of the posterior material layer $\mathbf{14}^1$ at a first bottom borderline portion of the first portion of the anterior material layer $\mathbf{12}^1$ of the first flexible cuff portion 34 of the tubular body 90 of the wristwatch wrapper device 10. Similarly, the second flexible cuff portion 36 includes a second portion of the anterior material layer $\mathbf{12}^2$ wherein a third overlapping portion of a second portion of the posterior material layer $\mathbf{14}^2$ forms a second top borderline portion of the second portion of the anterior material layer $\mathbf{12}^2$, and a fourth overlapping portion of the second portion of the posterior material layer $\mathbf{14}^2$ forms a second bottom borderline portion of the second portion of the anterior material layer $\mathbf{12}^2$ of the second flexible cuff portion 36 of the tubular body 90 of the wristwatch wrapper device 10.

In this manner, the posterior material layer 14 provides a visual borderline of material formed from the posterior material layer 14 disposed on the top and bottom rims of the first flexible cuff portion 12 and the second flexible cuff portion 36. In an embodiment of the anterior material layer 12 being made from a different material or a different color than that of the posterior material layer 14, the posterior material layer 14 provides a decorative ornamental visual aspect to the presentation of the anterior material layer 12 of the first flexible cuff portion 34 and the second flexible cuff portion 36 of the wristwatch wrapper device 10 to the user and to third parties viewing the wristwatch wrapper device 10.

The anterior material layer 12, the posterior material layer 14, and the interior lining portion 13, and the mounting portion 38, the one or more transferable mounting panels $\mathbf{16}^{1+N}$ of the wristwatch wrapper device 10 can each be made with a fabric including polyester, spandex, and neoprene, and any combinations thereof. In addition, anterior material layer 12, the posterior material layer 14, and the interior lining portion 13, and the mounting portion 38, the one or more transferable mounting panels $\mathbf{16}^{1+N}$ can each be made with a fabric having a smooth surfaced ballistic nylon having shock absorbing characteristics.

As shown in FIGS. 1D-1E and FIGS. 3A-3D, the tubular body 90 of the wristwatch wrapper device 10 includes the interior lining material 13 which is integrated within the tubular body 90 being coplanar to the anterior material layer 12 and the posterior material layer 14 of the tubular body 90. With a close inspection of the interior lining material 13 the interior lining material 13 is apportioned with a first interior lining material portion $\mathbf{13}^1$ which is coplanar with a first portion of the anterior material layer $\mathbf{12}^1$ of the first flexible cuff portion 34 of the tubular body 90 of the wristwatch wrapper device 10; a second interior lining material portion $\mathbf{13}^2$ that is coplanar with the first portion of the posterior material layer $\mathbf{14}^1$ of the first flexible cuff portion 34 of the tubular body 90 of the wristwatch wrapper device 10; a third interior lining material portion $\mathbf{13}^3$ coplanar to a second portion of the anterior material layer $\mathbf{12}^2$ of the second flexible cuff portion 36 of the tubular body 90 of the wristwatch wrapper device 10; a fourth interior lining material portion $\mathbf{13}^4$ coplanar with a second portion of the posterior material layer $\mathbf{14}^2$ of the second flexible cuff portion 36 of the tubular body 90 of the wristwatch wrapper device 10; a fifth interior lining material portion $\mathbf{13}^5$ coplanar with the anterior face $\mathbf{38}^1$ of the mounting portion 38 of the tubular body 90 of the wristwatch wrapper device 10; a sixth interior lining material portion $\mathbf{13}^6$ is coplanar with a posterior face $\mathbf{38}^2$ of the mounting portion 38 of the tubular body 90 of the wristwatch wrapper device 10.

Figure 3D:
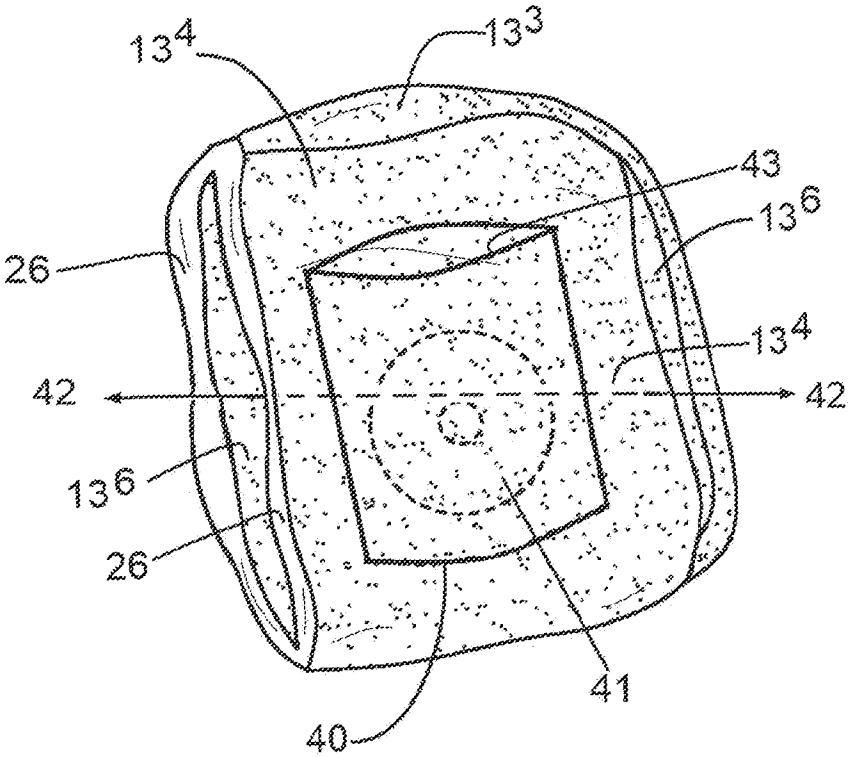
FIG. 3D illustrates a rear perspective view of the torus-shaped wristwatch wrapper device of FIG. 3C showing a housing and a transferrable smart device enclosed therein, indicated by the dotted lines, according to an embodiment of the present invention.

FIGS. 3B-3C and 1E shows a prefigured area of the interior lining material 13 is configured with a design or logo 32. The preconfigured area is selected to be on the third interior lining material portion $\mathbf{13}^3$ that is coplanar with the second portion of the anterior material layer $\mathbf{12}^2$ of the second flexible cuff portion 36 of the tubular body 90 of the wristwatch wrapper device 10. In this manner, when the wristwatch wrapper device 10 is manipulated and implemented for use, as shown in FIGS. 3A-3C, to form the wristwatch wrapper device 10 having a torus-shaped wristwatch wrapper device 10 configuration having a gripping ring 42, as depicted in FIGS. 3D and 3E, the design or logo 32 is revealed. In particular, FIG. 3C depicts the design or logo 32 of a watch maker, for example, OMEGA® on an anterior face of the torus-shaped wristwatch wrapper device 10. The design can be a logo, a user's logo, a manufacturer's logo, a registered trademark plus a stylized design of the user, a registered trademark plus a stylized design of the manufacturer of the wristwatch 28 wherein the use of the registered trademark plus a stylized design can be licensed to the user or owner of the wristwatch.

A second preconfigured area of the interior lining material 13 is configured with a housing 40. As shown in FIGS. 1C, 1E, 2B and FIG. 3D, the fourth interior lining material portion $\mathbf{13}^4$ that is congruent with the second portion of the posterior material layer $\mathbf{14}^2$ of the second flexible cuff portion 36 of the tubular body 90 of the wristwatch wrapper device 10 includes a housing 40 having a compartment configured with a retractable elasticized closure 43 recessed into the fourth interior lining material $\mathbf{13}r$ of the tubular body 90 of the wristwatch wrapper device 10. The housing 40 includes the compartment which is configured to contain a transferable smart device 41 therein. The housing 40 includes a retractable elasticized closure 43 capable of being expanded to easily insert and retrieve the transferable smart device 41 thereinto and therefrom when the user needs to replace the transferable smart device 41.

The transferable smart device 41 can include, a wireless tracking device, a short-wave wireless fidelity device, a wristwatch battery, a universal serial bus charger adapter. In an exemplary embodiment of the present invention, the transferable smart device 41 can include software to wirelessly connect to the user's smart phone, smart watch, iWatch, iPad, or connected computing personal smart device. The transferable smart device 41 is built with a microcontroller with short range wireless fidelity (bluetooth) microchip to wirelessly connect with a user's smart device to generate information on a location of the user's wristwatch 28. The user's smart device can comprise any one of a smart phone, smart wristwatch, laptop, iPad, computing device.

The first flexible cuff portion 34 of the tubular body 90 of the wristwatch wrapper device 10 is configured with a first circumferential cross section and the second flexible cuff portion 36 is configured with a second circumferential cross section equal to the first circumferential cross section, and the mounting portion 38 is configured with a third circumferential cross section which is equal to the first circumferential cross section and second circumferential cross section.

As depicted in FIGS. 1A-1C, the mounting portion 38 includes an anterior face $\mathbf{38}^1$ and a posterior face $\mathbf{38}^2$. With close inspection of FIGS. 1A-1C, the anterior face $\mathbf{38}^1$ of the mounting portion 38 is disposed immediately below and coplanar to an anterior portion of a transferable mounting panel $\mathbf{16}^1$ of the one or more mounting panels $\mathbf{16}^{1+N}$. FIG. 1A shows a front perspective view of the wristwatch wrapper device 10 and FIG. 1B shows a front planar view of the wristwatch wrapper device 10, and FIG. 1C shows a rear perspective view of the wristwatch wrapper device 10. FIG. 1A shows an anterior face $\mathbf{38}^1$ of the mounting portion 38 disposed between the first flexible cuff portion 34 and the second flexible cuff portion 36. FIG. 1C shows the posterior face $\mathbf{38}^2$ of the mounting portion 38 disposed between the first flexible cuff portion 34 and the second flexible cuff portion 36.

The wristwatch wrapper device 10 includes one or more transferable mounting panels $\mathbf{16}^{1+N}$ configured with an annular configuration. As shown in FIGS. 1A-1C and FIG. 2A, a transferable mounting panel 16 of the one or more transferable mounting panels $\mathbf{16}^{1+N}$ is assimilated with the mounting portion 38. The transferable mounting panel 16 extends perpendicularly to the lateral direction of the tubular body 90 circumventing the anterior face $\mathbf{38}^1$ and the posterior face $\mathbf{38}^2$ of the mounting portion 38. The transferable mounting panel 16 is configured in a circumferential panel having a circumferential perimeter, a diameter, a width dimensioned appropriate with the mounting portion 38 of the tubular body 90. The transferable mounting panel 16 is made having elasticity.

The transferable mounting panel 16 can be slipped over either the first flexible cuff portion 34 or the second flexible cuff portion 36 of the tubular body 90 and positioned coplanar with the mounting portion 38. The transferable mounting panel 16 includes an anterior portion of the transferable mounting panel $\mathbf{16}^1$ and a posterior portion of the transferable mounting panel $\mathbf{16}^2$. FIGS. 1A-1C and FIG. 2A, shows an anterior portion of the transferable mounting panel $\mathbf{16}^1$ being mounted coplanar with the anterior face $\mathbf{38}^1$ of the mounting portion 38 extending circumferentially around the anterior face $\mathbf{38}^1$ of the mounting portion 38 and circumvents the posterior face $\mathbf{38}^2$ of the mounting portion 38. FIG. 1C, in particular shows the posterior portion of the transferable mounting panel $\mathbf{16}^2$ coplanar with the posterior face $\mathbf{38}^2$ of the mounting portion 38. Such that, the transferable mounting panel 16 includes an anterior portion of the transferable mounting panel $\mathbf{16}^1$ and a posterior portion of the transferable mounting panel $\mathbf{16}^2$, wherein the anterior portion of the transferable mounting panel $\mathbf{16}^1$ is coplanar with the anterior face $\mathbf{38}^1$ of the mounting portion 38 and the posterior portion of the transferable mounting panel $\mathbf{16}^2$ is coplanar with the posterior face $\mathbf{38}^2$ of the mounting portion 38. It is advantageous for the one or more transferable mounting panels $\mathbf{16}^{1+N}$ to be transferable because when an implemented mounting panel becomes worn, the worn transferable mounting panel 16 of the one or more transferable mounting panels $\mathbf{16}^{1+N}$ can be replaced with a new transferable mounting panel 16 of the one or more transferable mounting panels $\mathbf{16}^{1+N}$.

In an exemplary embodiment of the present invention, the mounting portion 38 can be assimilated with one or more transferable mounting panels $\mathbf{16}^{1+N}$. The one or more transferable mounting panels $\mathbf{16}^{1+N}$ can include a material to provide increased padding and shock absorbency to the mounting portion 38 to aid as an impact absorbing material in the protection of the wristwatch 28 against damage. The anterior material layer 12, the posterior material layer 14, the interior lining material 13, one or more transferable mounting panels $\mathbf{16}^{1+N}$ can be made with a variety of materials including, knitted fabric, weaved fabric, neoprene fabric, open cell neoprene fabric, closed cell neoprene fabric, ethylene vinyl acetate fabric, polyurethane fabric, polystyrene fabric, perforated marine vinyl fabric, marine vinyl fabric, a clear vinyl, which is mold, mildew resistant integrated with an elastomer fiber. In addition, the anterior material layer 12, the posterior material layer 14, the interior lining material 13, the one or more transferable mounting panels $\mathbf{16}^{1+N}$ can be formed from a fabric that is characterized by resistance to moisture absorption, and mold/mildew resistance, whereby the fabric is an elasticized wicking fabric. The elasticized wicking fabrics are available as DRITEX at Dri-Tex/Moisture Wicking Performance Fabric I Rex Fabrics.

In an exemplary embodiment of the present invention, the anterior material layer 12, the posterior material layer 14, the interior lining material 13, one or more transferable mounting panels $\mathbf{16}^{1+N}$ can be made with an ultraviolet blocking fabric. Any one of the fabrics can be integrated with an elastomer to provide elasticity.

As shown in FIGS. 1A-1B and FIG. 2A, the anterior portion of the transferable mounting panel portion $\mathbf{16}^1$ of the one or more of the one or more transferable mounting panels $\mathbf{16}^{1+N}$ is assimilated with an anterior gripping application 18 integrated on the exterior surface of the anterior portion of the transferable mounting panel $\mathbf{16}^1$. Particularly, as shown in FIGS. 2A-3B, the anterior gripping application 18 integrated on the anterior portion of the transferable mounting panel $\mathbf{16}^1$ is configured to comport with a case body 29 of a wristwatch 28 and a proximal portion of the bracelet 31, straps, or band of the wristwatch 28 being supported by the mounting portion 38 of the tubular body 90 of the wristwatch wrapper device 10 to prevent slippage of the case body 29 of the wristwatch 28.

The anterior gripping application 18 of the anterior portion of the transferable mounting panel $\mathbf{16}^1$ can include a silicone, a non-slip material, a neoprene material, elasticized threads, yarns, or filaments, having a laser cut pattern, or an imprinted design or a bonded design, thereon. The anterior gripping application 18 provides a friction coefficient that provides protection against sliding of the case body 29 of the wristwatch 28 and the proximate bracelet portion of the wristwatch 28 positioned on the anterior portion of the transferable mounting panel $\mathbf{16}^1$ of the transferable mounting panel 16. Silicone is characterized with a coefficient of friction (CoF) which describes how hard it is to slide the silicone along a surface. Silicone is naturally quite tacky, with a coefficient of friction of approximately 1.0.

The anterior gripping application 18 can be configured using elasticized threads, yarns, or filaments knitted or weaved into the anterior portion of the transferable mounting panel $\mathbf{16}^1$ in a raised netting pattern as shown in FIGS. 1A-1B, 2A, and partially in FIGS. 3A and 3B applied by way of the circular knitting machine enabling the anterior gripping application 18 to be devoid of adhesives in the application thereof. In another exemplary embodiment, the anterior gripping application 18 can be flush with the exterior surface of the anterior face $\mathbf{38}^1$ of the anterior portion of the transferable mounting portion $\mathbf{16}^1$.

The anterior gripping application 18 of the anterior portion of the transferable mounting portion $\mathbf{16}^1$ can be configured in a variety of patterns including, a pattern of discrete raised gripping surfaces wherein the pattern can be selected from any one of a shape comprising a circle, a rectangle, an oval, a star shape, a heart shape, letters, numbers, dates, a logo, a vanity moniker, name, indicia, vanity initials, face of a watch, hands of a watch, a logo, a registered trademark plus design of the manufacturer of the wristwatch 28, a registered trademark plus design of the user or owner of the wristwatch 28.

The anterior gripping application 18 of the anterior portion $\mathbf{38}^1$ can be integrated with the exterior surface of the anterior portion of the transferable mounting panel $\mathbf{16}^1$ by way of bonding the anterior gripping material 18 with heat, bonding, imprinting, and fusion.

FIG. 1C and FIG. 2B shows a rear perspective view of the wristwatch wrapper device 10. The wristwatch wrapper device 10 includes the posterior material layer 14 that is formed joined with the anterior material layer 12, as shown in FIGS. 1A-1B. The anterior material layer 12 can be seamlessly joined to the posterior material layer 14 and the interior lining material 13 by way of a circular sewing machine including anyone of a circular knitting machine, a circular weaving machine, a circular hosiery machine, as discussed in more detail below.

The posterior material layer 14 provides the first portion of the posterior material layer $\mathbf{14}^1$ of the first flexible cuff portion 34 and the posterior material layer 14 provides the second portion of the posterior material layer $\mathbf{14}^2$ of the second flexible cuff portion 36, as shown in FIGS. 1C and 2B. The posterior face $\mathbf{38}^2$ of the mounting portion 38 is shown layered with the posterior portion of the mounting panel $\mathbf{16}^2$ wherein the posterior portion of the transferable mounting panel $\mathbf{16}^2$ includes the posterior gripping application 19. As shown in FIG. 1C, the first portion of the posterior material layer $\mathbf{14}^1$ of the first flexible cuff portion 34 is limited by the first elasticized selvage 20 which circumvents the first open end $\mathbf{30}^1$ of the tubular open channel 30 of the tubular body 90 which, also, provides a first open end of the first flexible cuff portion 34, as shown in FIGS. 1A-1B and 1D, of the wristwatch wrapper device 10. The posterior material layer 14 of the second flexible cuff portion 36 is limited by the second elasticized selvage 26 which circumvents the second open end $\mathbf{30}^2$ of the tubular open channel 30 of the tubular body 90, which, also, provides a second open end of the second flexible cuff portion of the wristwatch wrapper device 10, as shown in FIGS. 1C and 1E.

As shown in FIG. 1C and FIG. 2B, the posterior face $\mathbf{38}^2$ of the mounting portion 38 is assimilated with the posterior portion of the mounting panel $16^2$ of the transferable mounting panel 16. The posterior mounting panel portion $16^2$ includes a posterior gripping application 19. The posterior gripping application 19 integrated on the posterior portion of the mounting panel $16^2$ of the transferable mounting panel 16 is configured to comport with the distal portion of the bracelet 31, straps, bands, of the wristwatch 28 to prevent slippage of the wristwatch 28 that is mounted on the posterior portion of the transferable mounting panel $16^2$ which is coplanar to the posterior face $38^2$ of the mounting portion 38 of the wristwatch wrapper device 10.

The posterior gripping application 19 of the posterior portion of the transferable mounting panel $16^2$ can include a silicone, a non-slip material, a neoprene material, elasticized threads, yarns, or filaments, having a lazar cut pattern, or an imprinted design or a bonded design, thereon.

The posterior gripping application 19 can be configured using elasticized threads, yarns, or filaments knitted or weaved into the posterior portion of the mounting panel $16^2$ in a raised netting pattern as shown in FIGS. 1C and 2B, applied by way of the circular knitting machine enabling the posterior gripping application 19 to be devoid of adhesives in the application thereof. In another exemplary embodiment, the posterior gripping application 19 can be flush with the exterior surface of the posterior face $38^2$ of the mounting portion 38.

The posterior gripping application 19 of the exterior surface of the posterior face $38^2$ of the mounting portion 38 can be configured in a variety of patterns including, comprises a pattern of discrete raised gripping surfaces wherein the pattern can be selected from any one of a shape comprising a circle, a rectangle, an oval, a star shape, a heart shape, letters, numbers, dates, a logo, a vanity moniker, name, indicia, vanity initials, face of a watch, hands of a watch, a logo, a registered trademark plus design of the manufacturer of the wristwatch 28 or a registered trademark plus design of the user or owner of the wristwatch 28.

As shown in FIGS. 1C, 1E, 2B and 3D, the fourth interior lining material portion $13^4$ that is congruent with the second portion of the posterior material layer $14^2$ of the second flexible cuff portion 36 of the tubular body 90 of the wristwatch wrapper device 10 includes the housing 40 recessed into the fourth interior lining material portion $13^4$ of the interior lining material 13. The housing 40 includes a retractable elasticized closure 43 wherein the user can maneuver the retractable elasticized closure 43 to insert therein or remove therefrom the transferable smart device 41. In this manner, wherein when the first flexible cuff portion 34 and the second flexible cuff portion 36 is each manipulated and upturned and reversed inside-out the fourth inner lining material portion $13^4$ is brought to the exterior surface, and, consequently, the housing 40 containing the transferable smart device is exposed. In this manner, the user is enabled access to the transferrable smart device 41.

The transferable smart device 41 can include, a wireless tracking device, a short-wave wireless fidelity device, a wristwatch battery, a universal serial bus charger adapter. The transferable smart device 41 can be built with a microprocessor with short range wireless fidelity (bluetooth) microchip to wirelessly connect to the user's smart phone, smart watch, iWatch, iPad, or connected computing personal smart device. The transferable smart device 41 can be configured to wirelessly connect with a user's smart device to generate information on a location of the user's wristwatch 28. The transferable smart device 41 can easily be replaceable when required or at will by the user. The user's smart device can include a smart phone, an iWatch, an iPad, a personal computing smart device.

As shown in FIGS. 1A-1C, 2A, and 3A-3B, the first flexible cuff portion 34 extends a first length in a first transverse direction from the first piping 22 of the mounting portion 38 to the first elasticized selvage 20 of the first circumferential tubal body edge of the first open end $30^1$ of the tubular open channel 30 of the tubular body 90, and the second flexible cuff portion 36 extends a second length in an opposing transverse direction from the second piping 24 of the mounting portion 38 to the second elasticized selvage 26 of the second circumferential tubal body edge of the second open end $30^2$ of the tubular open channel 30 of the tubular body 90, wherein the first length is equal to the second length. The mounting portion 38 includes a third length measured from the first piping 22 disposed circumferentially on the first circumferential mounting portion edge of the mounting portion 38 to the second piping 24 disposed circumferentially on the second circumferential mounting portion edge of the mounting portion 38. The third length is equal to the first length of the first flexible cuff portion and the second length of the second flexible cuff portion. The first flexible cuff portion 34, the mounting portion 38, and the second flexible cuff portion, each can be dimensioned with at least 3.50 inches height, at least 2.50 inches length, and the tubular open channel is dimensioned having a diameter of at least 4.0 inches therethrough.

FIG. 2A shows a perspective front view of the wristwatch wrapper device 10 showing the wristwatch mounted upon the anterior face $38^1$ of the mounting portion 38 of the tubular body 90 of the wristwatch wrapper device 10 wherein the mounting portion 38 is disposed between the first flexible cuff portion 34 and the second flexible cuff portion 36. The mounting panel 16 is straddled around the mounting portion 38 of the tubular body 90. The anterior portion of the transferable wrapper panel $16^1$ of a transferable wrapper panel 16 of the one or more wrapper panels $16^{1+N}$ is shown assimilated with the anterior face $38^1$ of the mounting portion 38. The anterior portion of the transferable wrapper panel $16^1$ is coplanar with the anterior face $38^1$ of the mounting portion 38. The anterior portion of the transferable wrapper panel $16^1$ is integrated with the anterior gripping application 18.

As shown in FIGS. 2A, and FIGS. 3A, the anterior gripping application 18 integrated on the anterior portion of the transferable mounting panel $16^1$ of the tubular body 90 of the wristwatch wrapper device 10. The anterior gripping application 18 is configured to comport with a case body 29 of the wristwatch 28 and a proximate portion of the bracelet 31, strap, or band of the wristwatch 28 being supported by the mounting portion 38 of the tubular body 90 of the wristwatch wrapper device 10. The anterior gripping application 18 provides a material having a frictional coefficient against which the case body 29 of the wristwatch comes in contact with to prevent slippage of the case body 29 and the proximate portion of the bracelet 31, strap, or band of the wristwatch 28 from slipping and falling away from the mounting portion 38.

FIG. 2B shows a rear perspective view of the wristwatch wrapper device 10 including the posterior material layer 14 of the tubular body 90 that is formed with the anterior material layer 12, as shown in FIG. 1A, of the tubular body 90 of the wristwatch wrapper device 10. The mounting portion 38 of the tubular body 90 is disposed between the first flexible cuff portion 34 and the second flexible cuff portion 36. The posterior portion of the transferable wrapper panel $16^2$ of the wrapper panel 16 is shown associated with the posterior face $38^2$ of the mounting portion 38. The posterior portion of the transferable wrapper panel $16^2$ is positioned coplanar with the posterior face $38^2$ of the mounting portion 38. The posterior portion of the transferable wrapper panel $16^2$ is assimilated with the posterior gripping application 19. As shown in the rear perspective view of the wristwatch wrapper device 10 in FIG. 2B, the first elasticized selvage 20 and the second elasticized selvage 26 including the elastomeric bands extend, continuously, and circumferentially around the first open end $30^1$ and the second open end $30^2$, respectively, of the tubular open channel 30 of the tubular body 90 of the wristwatch wrapper device 10. The first elasticized selvage 20, circumventing the first open end $30^1$, also, serves as the first open end $30^1$ to the first flexible cuff portion 34 of the tubular body 90 of the wristwatch wrapper device 10, and, similarly, the second open end $30^2$, also, serves as the second open end $30^2$ to the second flexible cuff portion 36 of the tubular body 90 of the wristwatch wrapper device 10. The first elasticized selvage 20 and the second elasticized selvage 36 can have a width between 2.0 mm and 10.0 mm.

FIG. 2B shows a rear perspective view of the wristwatch wrapper device 10 including the posterior material layer 14 of the tubular body 90 including the posterior material layer 14 that is formed with the anterior material layer 12, as shown in FIG. 1A, of the tubular body 90 of the wristwatch wrapper device 10. The mounting portion 38 of the tubular body 90 is disposed between the first flexible cuff portion 34 and the second flexible cuff portion 36. The posterior wrapper panel portion $16^2$ of the transferable wrapper panel 16 is shown associated with the posterior face $38^2$ of the mounting portion 38. The posterior wrapper panel portion $16^2$ is positioned coplanar with the posterior face $38^2$ of the mounting portion 38. The posterior wrapper panel portion $16^2$ is integrated with the posterior gripping application 19.

As shown in FIG. 2B, the posterior gripping application 19 integrated on the posterior mounting panel portion $16^2$ is configured to comport with the distal portion of the bracelet 31, strap, or band, of the wristwatch 28 being supported by the mounting portion 38, more particularly, the posterior face $38^2$ of the mounting portion 38, of the tubular body 90 of the wristwatch wrapper device 10. The posterior gripping application 19 provides a material against which the distal portion of the bracelet 31, strap or band, of the wristwatch 28 comes in contact with to prevent slippage of the bracelet 31, straps, or band of the wristwatch 28 from slipping and falling away from the posterior portion of the transferable mounting panel $16^2$ assimilated with the posterior face $38^2$ of the mounting portion 38.

The posterior gripping application 19 of the posterior mounting panel portion $16^2$ can include a silicone, polyurethane, synthetic rubber, natural rubber, a non-slip material, a neoprene material, elasticized filaments, having a lazar cut pattern, or an imprinted design or a bonded design thereon. The posterior gripping application 19 provides a friction coefficient that provides protection against sliding of the distal portion of the bracelet 31, strap, or band, of the wristwatch 28 positioned on the posterior portion of the transferable mounting panel $16^2$.

The anterior gripping application 18 of the anterior portion of the transferable mounting panel $16^1$ and the posterior gripping application 19 of the posterior portion of the transferable mounting panel $16^2$ can be configured in a variety of patterns including a pattern of discrete raised gripping surfaces wherein the pattern can be selected from any one of a shape comprising a circle, a rectangle, an oval, a star shape, a heart shape, letters, numbers, dates, a logo, a vanity moniker, name, indicia, vanity initials, face of a watch, hands of a wristwatch, a logo, a registered trademark plus design of the manufacturer of the wristwatch 28, or a registered trademark plus design of the user or owner of the wristwatch 28.

In addition, the anterior gripping application 18 of the anterior portion of the transferable mounting panel $16^1$ and the posterior gripping application 19 of the posterior portion of the transferable mounting panel $16^2$ can be configured in a pattern of raised gripping surfaces comprising a series of raised linear lines oriented in a longitudinal direction, a lateral direction, or a circular direction.

In addition, the anterior gripping application 18 of the anterior portion of the transferable mounting panel $16^1$ and the posterior gripping application 19 of the posterior portion of the transferable mounting panel $16^2$ can be configured in a pattern of raised gripping surfaces comprising dots, bumps, pods, nodules, comprising a material including one or more of a combination of a gripping yarn including, silicone filaments, polyurethane filaments, synthetic rubber filaments, natural rubber filaments, polyamide filaments, silicone coated filaments which can be integrated into each of the anterior gripping application 18 of the anterior portion of the transferable mounting panel $16^1$ and the posterior gripping application 19 of the posterior portion of the transferable mounting panel $16^2$ by way of any one of the circular sewing machines, including the circular knitting machine, the circular weaving machine, the circular hosiery knitting machine.

FIG. 3D shows the housing 40, as discussed above, recessed into the fourth interior lining material portion $13^4$ of the interior lining material 13 that is congruent with the second portion of the posterior material layer portion $14^2$ of the second flexible cuff portion 36 of the tubular body 90 of the wristwatch wrapper device 10. The housing 40 includes the compartment having the retractable elasticized closure 43. The compartment is configured to contain the transferable smart device 41, as shown in FIGS. 1C and 3D, as discussed above. FIG. 3A illustrates the front perspective view of the wristwatch wrapper device 10 in use where the wristwatch 28 is being supported by the mounting portion 38 of the wristwatch wrapper device 10. The tubular body 90 includes the first flexible cuff portion 34 and the second flexible cuff portion 36 with the mounting portion 38 assimilated with the transferable mounting panel 16 disposed therebetween the first flexible cuff portion 34 and the second flexible cuff portion 36. In particular, the anterior face $38^1$ of the mounting portion 38 is shown supporting the anterior wrapping panel portion $16^1$ of the transferable wrapping panel 16. The anterior wrapping panel portion $16^1$ is integrated with the anterior gripping application 18.

As shown in FIGS. 3A-3E, the user can manipulate the wristwatch wrapper device 10 to wrap the wristwatch 28 therein to protect and safeguard the wristwatch 28. FIG. 3A shows the first flexible cuff portion 34 of the tubular body 90 being upturned to be reversed inside-out. As the first flexible cuff portion 34 is being upturned to be reversed inside-out, the user starts at the first elasticized selvage 20 and folds the first flexible cuff portion 34 at the first piping 22 of the first circumferential mounting portion edge of the mounting portion 38. The first flexible cuff portion 34 is wrapped around the wristwatch 28 which is mounted on the transferable mounting panel 16 associated with the mounting portion 38. As the first flexible cuff portion 34 is being upturned and reversed inside-out, the first interior lining material portion $13^1$ that is coplanar with the first portion of the anterior material layer $12^1$ of the first flexible cuff portion 34 and the second interior lining material portion $13^2$ that is coplanar to the first portion of the posterior material layer $14^1$ of the first flexible cuff portion 34 of the tubular body 90 of the wristwatch wrapper device 10 are both being upturned and reversed inside-out to come to the exterior surface, as shown in FIG. 3B. Concomitantly, a surface of the first portion of the first anterior material layer $12^1$ of the first flexible cuff portion 34 comes in contact with the crystal and crown 33 of the wristwatch 28 and the proximate portion of the bracelet 31, strap or band, of the wristwatch 28, and a surface of the first portion of the posterior material layer $14^1$ of the first flexible cuff portion 34 comes in contact with the distal portion of the bracelet 31, strap or band, of the wristwatch 28. In this manner, the first flexible cuff portion 34 provides a first circumambient layer enveloping the wristwatch 28.

Consequentially, a first interior lining material portion $13^1$ of the interior lining material 13 that is coplanar with the first portion of the anterior material layer $12^1$ of the first flexible cuff portion 34 provides an anterior facing material layer of the first circumambient layer wrapped around the wristwatch 28, and a second interior lining material portion $13^2$ of the interior lining material that is coplanar with the first portion of the posterior material layer $14^1$ of the first flexible cuff portion 34 provides a posterior facing material layer of the first circumambient layer wrapped around the wristwatch 28 wherein the first circumambient layer around the wristwatch is secured by the first elasticized selvage 20, as shown in FIG. 3B.

Subsequently, as shown in FIGS. 3B-3C, the user can manipulate the second flexible cuff portion 36 to wrap over the first flexible cuff portion 34 of the tubular body 90 of the wristwatch wrapper device 10. As the second flexible cuff portion 36 is being upturned to be reversed and inside-out, the user starts at the second elasticized selvage 26 and folds the second flexible cuff portion 36 at the second piping 24 of the second circumferential mounting portion edge of the mounting portion 38. The second flexible cuff portion 36 is wrapped around the first flexible cuff portion 34 having the wristwatch 28 being held, therein. As the second flexible cuff portion 36 is being reversed and upturned inside-out, the third interior lining material portion $13^3$ that is coplanar with the second portion of the anterior material layer $12^2$ of the second flexible cuff portion 36 and the fourth interior lining material portion $13^4$ that is coplanar to the second portion of the posterior material layer $14^2$ of the second flexible cuff portion 36 tubular body 90 of the wristwatch wrapper device 10 are both being upturned and reversed inside-out to come to the exterior surface as shown in FIGS. 3B-3D. Concomitantly, a surface of the second portion of the second anterior material layer $12^2$ of the second flexible cuff portion 36 comes in contact with a surface of the first interior lining material portion $13^1$ of the first flexible cuff portion 34, and a surface of the second portion of the posterior material layer $14^2$ of the second flexible cuff portion 36 comes in contact with a surface of the second interior lining material portion $13^2$ of the first flexible cuff portion 34. In this manner, the second flexible cuff portion 34 provides a second circumambient layer enveloping the wristwatch 28 whereby a torus-shaped wristwatch wrapper device 10 is formed to secure and protect the wristwatch 28, as shown in FIGS. 3C-3D. The third interior lining material portion $13^3$ that is coplanar with the second portion of the anterior material layer $12^2$ of the second flexible cuff portion 36 provides an anterior facing cover for the wristwatch wrapper device 10, and the fourth interior lining material portion $13^4$ that is coplanar with the second portion of the posterior material layer $14^2$ of the second flexible cuff portion 36 provides a posterior facing cover for the wristwatch wrapper device 10.

The torus-shaped wristwatch wrapper device 10 is formed circumscribing a gripping ring 42 through which a user's fingers passes so that the user can take hold of the torus-shaped wristwatch wrapper device 10 which is securing and protecting the user's wristwatch 28. The torus-shaped wristwatch wrapper device 10 is secured around the wristwatch 28 by the first elasticized selvage 20 of the first flexible cuff portion 34 at the first circumambient layer and the second elasticized selvage 26 of the second flexible cuff portion 36 is secured around the first circumambient layer to secure the torus-shaped wristwatch wrapper device 10 as a unit whereby the wristwatch 28 is temporarily stored and protected, as shown particularly in FIGS. 3B-3E.

It is beneficial and strategic to wrap the first flexible cuff portion 34 enveloping the wristwatch 28 prior to wrapping the second flexible cuff portion 36 around the wristwatch 28 so that the design or logo 32 is revealed, more particularly, the design "OMEGA" as shown in FIG. 3C, when the torus-shaped wristwatch wrapper device 10 is formed, as shown in FIGS. 3B-3E. In addition, it is strategic to wrap the first flexible cuff portion 34 prior to wrapping the second flexible cuff portion 36 around the wristwatch 28 so that the housing 40 recessed into the fourth interior lining material portion $13^4$ of the interior lining 13 is revealed when the second flexible cuff portion 36 is turned inside-out. In this manner, the transferable smart device 41 contained in the housing 40 is readily available to the user, as shown in FIG. 3D.

FIG. 3C is a front perspective view of the torus-shaped wristwatch wrapper device 10 having the wristwatch 28 temporarily stored therein. In addition, FIG. 3C shows the design 32 imprinted on the third interior lining material portion 13, wherein the third interior lining material lining material portion $13^4$ now being upturned and reversed inside-out the design is brought to the anterior facing cover of the torus-shaped wristwatch wrapper device 10. FIG. 3C shows the wristwatch 28 wrapped and secured within the torus-shaped wristwatch wrapper device 10 circumventing the gripping ring 42, as indicated by the arrow at 42 and, particularly, as shown in FIG. 3E.

FIG. 3D is a rear perspective view of the torus-shaped wristwatch wrapper device 10. The second cuff portion 36 of the tubular body 90 of the wristwatch wrapper device 10 being upturned and reversed inside-out causes the fourth interior material layer $13^1$ of the interior lining material 13 to provide a posterior facing cover of the torus-shaped wristwatch wrapper device 10 protecting the wristwatch 28. In this manner the housing 40 containing the transferable smart device 41 is accessible to the user, as discussed above.

FIG. 3E shows the wristwatch wrapper device 10 in use having the wristwatch wrapper device 10 formed in the torus-shaped wristwatch wrapper device 10 configuration whereby the wristwatch 28 being mounted on the transferable mounting panel 16 assimilated with the mounting portion 38 is temporarily stored and protected. The torus-shaped wristwatch wrapper device 10, as a result of, the strategic wrapping of the first flexible cuff portion 34 over the wristwatch 28 being mounted on the mounting portion 38 and the subsequent wrapping of the second flexible cuff portion 36 over the first flexible cuff portion 34 causes the formation of the gripping ring 42, as shown in FIG. 3E. The gripping ring 42 provides a means for the user to slip the user's fingers therethrough to hold onto the wristwatch wrapper device 10.

The gripping ring 42 provides a means for the user to pass the user's fingers therethrough to personally carry the wristwatch wrapper device 10 having the wristwatch 28 enveloped therein. The gripping ring 42 includes a gripping material 45 to prevent the user's fingers from slipping away from the gripping ring 42. The gripping material 45 can include a silicone material, a non-slip material, a neoprene material, elasticized threads, yarns, or filaments, having a lazar cut pattern, or an imprinted design or a bonded design thereon.

In another embodiment, the gripping material 45 can be configured using elasticized threads, yarns, or filaments knitted or weaved into the gripping ring 42 in a raised netting pattern, as shown in FIG. 3E, applied by way of the circular knitting machine enabling the gripping ring 42 to be devoid of adhesives in the application thereof. In another exemplary embodiment, the gripping material 45 can be flush with the exterior surface of the gripping ring 42 of the torus-shaped wristwatch wrapper device 10.

The gripping material 45 of the gripping ring 42 can be configured in a variety of patterns including, a pattern of discrete raised gripping surfaces wherein the pattern can be selected from any one of a shape comprising a circle, a rectangle, an oval, a star shape, a heart shape, letters, numbers, dates, a logo, a vanity moniker, name, indicia, vanity initials, face of a watch, hands of a watch, a logo, a registered trademark plus design of the manufacturer of the wristwatch 28, or a registered trademark plus design of the user or owner of the wristwatch 28. In another embodiment the gripping material 45 of the gripping ring 42 can be bonded to the circumferential surface area of the gripping ring 42 with heat.

In another exemplary embodiment of the present invention, the gripping material 45 of the gripping ring 42 of the wristwatch wrapper device 10, can be made from any one of materials selected from the group comprising an elastomer, spandex, natural rubber, rubber, synthetic rubber, vinyl, polyvinyl, thermoplastic, silicone, or a non-slip material. The gripping material 45 of the gripping ring 42 can be applied as a non-slip coating adhered to a circumferential surface of the gripping ring 42 by way of bonding, laminating, melting, curing, spraying, or fusing.

In another exemplary embodiment of the present invention, the gripping material 45 of the of the gripping ring 42 of the torus-shaped wristwatch wrapper 10 can be configured in a pattern of raised gripping surfaces comprising dots, bumps, pods, nodules, and/or the like comprising a gripping material including one or more of a combination of silicone, polyurethane, synthetic rubber, natural rubber, polyamide yarn, silicone coated yarn.

The anterior material layer 12 can be formed from a first material and the posterior material layer 14 can be formed from a second material, the interior lining material 13 can be formed from a third material, and the one or more transferable mounting panels $\mathbf{16}^{1+N}$, can be formed from a fourth material. The first material, the second material, the third material, the fourth material, can be formed from a fabric material that is knitted material or a weaved material wherein the knitted material and the weaved material include an elasticized fiber for stretchability. The anterior material layer 12, the posterior material layer 14, the interior lining material 13, and the one or more transferable mounting panels $\mathbf{16}^{1+N}$, can be a knitted textile including nylon, polyester, polypropylene, synthetic thread, yarn or filaments with at least 10% elastomeric yarn content. The knitted textile fabric can include a jersey, tricot, interlock, and any combination thereof.

The anterior material layer 12, the posterior material layer 14 and the interior lining material 13, and the one or more transferable mounting panels $\mathbf{16}^{1+N}$ can each comprise a knitted fabric, or a woven fabric, or a nonwoven material made from natural or synthetic fibers, neoprene, recycled materials, recycled jean material, recycled plastic bottle material commercially available as REPREVE®, available at REPREVE® Sustainable Certifiable Recycled High-quality.

The anterior material layer 12, the posterior material layer 14, the interior lining material 13, and the one or more transferable mounting panels $\mathbf{16}^{1+N}$ can include a textile composite formed to provide reduced water absorbency, add thickness, protection against impact and abrasion protection, and/or thermal insulation to the wristwatch 28. In an exemplary embodiment, the textile composite can be constructed of a neoprene foam and a textile laminate or laminate each with a moisture vapor impermeable and substantially liquid impermeable membrane or membrane coating. In still other embodiments, the textile composite can additionally or alternatively include an outer textile laminate selected to be highly resistant to abrasion, so as, to provide improved durability to the wristwatch wrapper device 10. The textile laminate or the laminate is selected from the group comprising, polymers, viscoelastic polymers, rubber, silicone, and neoprene.

In another exemplary embodiment of the wristwatch wrapper devices 10, and 100, 200, as described below, the anterior material layer 12, the posterior material layer 14, the interior lining material 13 and the one or more transferable mounting panels $\mathbf{16}^{1+N}$ can be formed from a fireproof material.

In another exemplary embodiment of the wristwatch wrapper devices 10, and 100, 200, as described below, each of the anterior material layer 12, the posterior material layer 14, the interior lining material 13, the one of the one or more transferable mounting panels $\mathbf{16}^{1+N}$, includes a thickness of at least 0.20 mm.

In addition, in another exemplary embodiment of the wristwatch wrapper devices 10, and 100, 200, as described below, the anterior material layer 12, is made from a first fabric, the posterior material layer 14 is made from a second fabric, and the interior lining material 13 is made from a third fabric, wherein the first fabric is different from the second fabric and the third fabric is different from each of the first fabric and the second fabric. The one or more transferable mounting panels $\mathbf{16}^{1+N}$ can be made with a fourth fabric that is different from the first fabric, the second fabric, and the third fabric.

Similarly, in another exemplary embodiment of the wristwatch wrapper devices 10, and 100, 200, as described below, the anterior material layer 12, is made from a first fabric, the posterior material layer 14 is made from a second fabric, and the interior lining material 13 are each formed with a variety of colored fabrics wherein the anterior material layer 12 is formed with a first colored fabric, the posterior material layer 14 is formed with a second colored fabric, and the interior lining material 13 is formed with a third colored fabric, and the one or more transferable mounting panels $\mathbf{16}^{1+N}$ is formed with a fourth colored fabric, wherein the first colored fabric is different from the second colored fabric, and the third colored fabric is different from the first colored fabric and the second colored fabric, and the fourth colored fabric is different from the first colored fabric, the second colored fabric, and the third colored fabric.

FIGS. 4A-4G show a wristwatch wrapper device 100 according to another embodiment and aspects of the present invention. As related to the wristwatch wrapper device at 10 depicted in FIGS. 1A-3E, the like numeral designations denote like elements as recited in the detailed description and the drawings for the wristwatch wrapper at 10 will be repeated in the following detailed description for the wristwatch wrapper device at 100 and its accompanying drawings depicted in FIGS. 4A-4F, for brevity and clarity. The wristwatch wrapper device 100 is referred to as a closed dual-seamed orbicular shaped wristwatch wrapper device 100 when the wristwatch wrapper device in a wrapped state. Hereinafter, the two terms wristwatch wrapper device 100 can be used interchangeably with the closed dual-seamed orbicular shaped wristwatch wrapper device 100.

In the exemplary embodiment, the wristwatch wrapper device 100 includes a closed dual-seamed orbicular shape to secure and protect a wristwatch 28, therein, as shown in FIGS. 4E-4G. In the exemplary embodiment, the wristwatch wrapper device 100 is removably coupled to a first metal ring-spring gate O-ring 80 which is removably coupled to a first segment of a second elasticized selvage 26 of a tubular body 90 of the closed dual-seamed orbicular wristwatch wrapper device 100. The first metal ring-spring gate O-ring 80 is removably coupled to a first metal swivel carabiner hinge 82 having a first swivel connector 84, as shown in FIGS. 4E-4G.

In another exemplary embodiment of the wristwatch wrapper device 100 having the closed dual seamed orbicular shape, a second metal ring-spring gate O-ring 96 is removably coupled to a second segment of the second elasticized selvage 26 of the tubular body 90, as shown in FIG. 4G. A second metal swivel carabiner hinge 98 having a second swivel connector 99 is removably coupled to the second metal ring-spring gate O-ring 96. A cross-body strap 111 can be removably coupled to the first metal swivel carabiner hinge 82 and the second metal swivel carabiner hinge 98, such that a user can place the cross-body strap 111 over the user's torso or the user's waist to carry and wear the closed dual seamed orbicular wristwatch wrapper device 100, as discussed in more detail, below.

Generally, FIGS. 4A-4D, shows the wristwatch wrapper device 100 in an unfolded state. FIGS. 4E-4G shows the wristwatch wrapper device 100 in a wrapped state wrapped around a wristwatch 28 being mounted therein. The wristwatch wrapper device 100 is implemented to temporarily holding or storing a wristwatch 28, as shown in FIGS. 4C-4G when a user is not currently wearing the wristwatch 28, particularly, when the user is in transit as the user is travelling through an airport.

Returning to FIG. 4A, the wristwatch wrapper device 100 is shown in a front perspective view wherein the wristwatch wrapper device is designated at the numeral 100, according to an exemplary embodiment of the present invention. FIG. 4B shows a rear perspective view of the wristwatch wrapper device 100 of FIG. 4A. FIGS. 4A-4D, shows the wristwatch wrapper device 100 includes a tubular body 90 configured having a lateral direction and a circumferential direction. The tubular body 90 includes an anterior material layer 12 formed joined to a posterior material layer 14 reinforced with an interior lining material 13, as shown in FIGS. 4A and 4B, wherein the interior lining material 13 circumvents a tubular open channel 30 inherent within the tubular body 90.

FIGS. 4A-4D, with particularity to FIGS. 4C and 4D, the wristwatch wrapper device 100 includes the tubular body 90 having a tubular open channel 30 including a first open end $\mathbf{30}^1$ limited by a first circumferential tubal body edge, and a second open end $\mathbf{30}^2$ limited by a second circumferential tubal body edge. The tubular body 90 includes a first elasticized selvage 20 integrated with the first circumferential tubal body edge circumventing the first open end $\mathbf{30}^1$ of the tubular open channel 30 of the tubular body 90 and a second elasticized selvage 26 is integrated with the second circumferential tubal body edge circumventing the second open end $\mathbf{30}^2$ of the tubular body 90 of the wristwatch wrapper device 100.

As shown in FIGS. 4A-4D, the first elasticized selvage 20 and the second elasticized selvage 26 of the tubular body 90 are separated by the first flexible cuff portion 34 and the second flexible cuff portion 36 having a mounting portion 38 centrally disposed therebetween the first flexible cuff portion 34 and the second flexible cuff portion 36. The mounting portion 38 is framed with a first circumferential mounting edge and a second circumferential mounting edge wherein the first circumferential mounting portion edge is integrated with a first piping 22 and the second circumferential mounting portion edge is integrated with a second piping 24, as depicted in a front perspective view of the wristwatch wrapper device 100 in FIG. 4A.

Referring to FIG. 4A, in the exemplary embodiment of the present invention, the first elasticized selvage 20, also, provides the first elasticized selvage 20 to the first open end $\mathbf{30}^1$ concomitant to the first flexible cuff portion 34, and the second elasticized selvage 26, also, provides, the second elasticized selvage 26 to the second open end $\mathbf{30}^1$ concomitant to the second flexible cuff portion 36. In addition, the first elasticized selvage 20 and the second elasticized selvage 26 can include elastomeric bands that extend, continuously, and circumferentially, around the first open end $\mathbf{30}^1$ and the second open end $\mathbf{30}^2$, respectively, of the tubular open channel 30 of the tubular body 90 of the wristwatch wrapper device 100. As shown in FIGS. 4C-4G, the first elasticized selvage 20 provides the first flexible cuff portion 34 with an elasticized seal as the first flexible cuff portion 34 is upturned and reversed inside-out and wrapped around the wristwatch 28 being mounted on the mounting portion 38 of the tubular body 90 of the wristwatch wrapper device 100. Similarly, as shown in FIGS. 4C-4F, particularly, FIGS. 4E and 4F, the second elasticized selvage 26 provides an elasticized seal around the first flexible cuff portion 34 as the second flexible cuff portion 36 is upturned and reversed inside-out and wrapped around the first flexible cuff portion 34 to secure the wristwatch wrapper device 10 therein the wristwatch wrapper device 100 as shown in FIGS. 4E and 4F. In this manner, the wristwatch wrapper device 100 securely safeguards the wristwatch 28 mounted on the mounting portion 38 of the tubular body 90 of the wristwatch wrapper device 100.

The first elasticized selvage 20 provides for flexibility and a secure wrapping mechanism when a first flexible cuff portion 34 of the tubular body 90 of the wristwatch wrapper device 100 is upturned and reversed in-side-out, and, subsequently, when the first flexible cuff portion 34 is wrapped around the wristwatch 28 mounted on the mounting portion 38 of the wristwatch wrapper device 100. The second elasticized selvage 26 provides for flexibility and a secure wrapping mechanism when the second flexible cuff portion 36 is upturned and reversed in-side-out and wrapped around the first flexible cuff portion 34 to secure and safeguard the wristwatch 28 mounted on the mounting portion 38 of the tubular body 90 of the wristwatch wrapper device 100, as shown in FIGS. 4E and 4F, according to the exemplary embodiment of the present invention.

The first elasticized selvage 20 and the second elasticized selvage 26 are configured with a high amount of friction to hold the relevant portion of the first flexible cuff portion 34 and the relevant portion of the second flexible cuff portion 36 securely in-place while the first flexible cuff portion 34 and the second flexible cuff portion 36 when folded form the wristwatch wrapper device 100 in the closed dual-seamed orbicular shape, as shown in FIGS. 4E-4G.

The first elasticized selvage 20 and the second elasticized selvage 26, the first piping 22, the second piping 24, of the tubular body 90 of the wristwatch wrapper device 100, as well as the wristwatch wrapper device 10, as described above, and the wristwatch wrapper device 200 described, below, can be made of a polyurethane based elastomeric material, a silicone-based elastomeric material, or a combination thereof, that provides a high elastic modulus at the first open end $\mathbf{30}^1$ and the second open end $\mathbf{30}^2$ of the tubular open channel 30 at each of the first flexible cuff portion 34 and the second flexible cuff portion 36, respectively, and, thereby, increasing the tightness of the first flexible cuff portion 34 being upturned and reversed inside-out and wrapped around the wristwatch 28 and the second flexible cuff portion 36 being upturned and reversed in-side-out and wrapped around the first flexible cuff portion 34 to secure and safeguard the wristwatch 28. The first elasticized selvage 20 and the second elasticized selvage 36 can have a width between 2.0 mm and 10.0 mm.

As shown in FIGS. 4A-4D, the first elasticized selvage 20 and the second elasticized selvage 26 of the tubular body 90 are separated by a first flexible cuff portion 34 and a second flexible cuff portion 36 having a mounting portion 38 centrally disposed therebetween the first flexible cuff portion 34 and the second flexible cuff portion 36. The mounting portion 38 is framed with a first circumferential mounting edge and a second circumferential mounting edge wherein the first circumferential mounting edge is integrated with a first piping 22 and the second circumferential mounting edge is integrated with a second piping 24. The mounting portion 38 can be multi-layered. In an exemplary embodiment the mounting portion 38 includes at least one or more layers of material and/or one or more layers of fabric, or a combination thereof.

As shown in FIGS. 4A-4C, the first flexible cuff portion 34 extends a first length in a first transverse direction from the first piping 22 of the mounting portion 38 to the first elasticized selvage 20 of the first circumferential tubal body edge of the first open end $\mathbf{30}^1$ of the tubular open channel 30 of the tubular body 90, and second flexible cuff portion 36 extends a second length in an opposing transverse direction from the second piping 24 of the mounting portion 38 to the second elasticized selvage 26 of the second circumferential tubal body edge of the second open end $\mathbf{30}^2$ of the tubular open channel 30 of the tubular body 90, wherein the first length is equal to the second length. The mounting portion 38 includes a third length measured from the first piping 22 to the second piping 24. The third length of the mounting portion 38 is equal to the first length and the second length.

As shown in FIGS. 4A-4C, an anterior portion of the mounting portion 38 includes an anterior face $\mathbf{38}^1$. Similarly, as shown in a rear perspective view of FIG. 4B, a posterior portion of the mounting portion 38 includes a posterior face $\mathbf{38}^2$. The anterior face $\mathbf{38}^1$ is colinear with the anterior material layer 12 of the tubular body and the posterior face $\mathbf{38}^2$ is colinear with the posterior material layer 14 of the tubular body 90. The mounting portion 38 is framed with a first circumferential edge and a second circumferential edge wherein the first circumferential edge is integrated with a first piping 22 and the second circumferential edge is integrated with a second piping 24.

As shown in FIGS. 4A-4C, a stitched piping framework, wherein the first piping 22 is fixedly attached at the first circumferential edge of the mounting portion 38 being stitched therethrough the anterior material layer 12, the interior lining material 13, and the posterior material layer 14 forming a first stitched seam 23 of the stitched piping framework, congruent to the first piping 22. Similarly, the second piping 24 is fixedly attached at the second circumferential edge being stitched therethrough the anterior material layer 12, the interior lining material 13, and the posterior material layer 14 forming an opposing second stitched seam 27 of the stitched piping framework, congruent to the second piping 24. FIG. 4A shows a front perspective view of the first stitched seam 23 congruent to the first piping 22 of the anterior face $\mathbf{38}^1$ of the mounting portion 38 and the second stitched seam 27 congruent to the second piping 24 providing the stitched piping framework to the mounting portion 38.

In this manner, the first stitched seam 23 congruent to the first piping 22 and the second stitched seam 27 congruent to the second piping 24 forms a bind-off of the tubular open channel 30, in a transverse plane, of the tubular body 90 at the first piping adjacent to the mounting portion 38 and at the second circumferential edge of the mounting portion 38, respectively.

The first piping 22 and the second piping 24 can be fixedly attached at each side of the mounting portion 38 therethrough the anterior material layer 12, the posterior material layer 14, and the interior lining material 13 by way of a double stitched seam. The double stitched seam can have a flat seam stitching construction, including a double stitched seam stitching construction, as shown in FIGS. 4A-4D. The seam can, also, be constructed using a folded seam construction, or a fused seam construction, a flatlock stitching, a blind stitch, overlook stitching, zig-zag stitching, cover stitching. The double stitched seam can be sewn with water resistant thread, yarn, or filaments to provide a water-tight seal.

As shown in FIGS. 4A and 4B, the first flexible cuff portion 34 is configured with a first circumferential cross section and the second flexible cuff portion 36 is configured with a second circumferential cross section equal to the first circumferential cross section, and the mounting portion 38 is configured with a third circumferential cross section which is equal to the first circumferential cross section and second circumferential cross section.

As depicted in FIGS. 4A and 4C, a front perspective view of the wristwatch wrapper device 100 the mounting portion 38 includes an anterior face $\mathbf{38}^1$ and, as shown in FIGS. 4B and 4D, a rear perspective view of the wristwatch wrapper device 100, the mounting portion 38 includes a posterior face $\mathbf{38}^2$. FIG. 1A shows the mounting portion 38 disposed between the first flexible cuff portion 34 and the second flexible cuff portion 36. As shown in FIGS. 4A and 4C the mounting portion 38 includes an anterior gripping application 18 assimilated on the anterior face $\mathbf{38}^1$ of the mounting portion 38. Particularly, as shown in FIGS. 4A and 4C, the anterior gripping application 18 is assimilated on the anterior face $\mathbf{38}^1$ of the mounting portion 38 which is configured to comport with a case body 29 of a wristwatch 28 and a proximate portion of a bracelet 31, strap, or band of the wristwatch 28 being supported by the mounting portion 38 of the tubular body 90 of the wristwatch wrapper device 100 to prevent slippage of the case body 29 of the wristwatch 28.

The anterior gripping application 18 and can be configured using elasticized threads, yarns, or filaments knitted or weaved into the anterior face $\mathbf{38}^1$ of the mounting portion 38 in a raised netting pattern as shown in FIGS. 4A and 4C, applied by way of the circular knitting machine enabling the anterior gripping application 18 to be devoid of adhesives in the anterior gripping application 18 thereof. In another exemplary embodiment, the anterior gripping application 19 can be flush with the exterior surface of the anterior face 38$^1$ of the mounting portion 38.

The anterior gripping application 18 of the anterior face 38$^1$ of the mounting portion 38 can be configured in a variety of patterns including, comprises a pattern of discrete raised gripping surfaces wherein the pattern can be selected from any one of a shape comprising a circle, a rectangle, an oval, a star shape, a heart shape, letters, numbers, dates, a logo, a vanity moniker, name, indicia, vanity initials, face of a watch, hands of a watch, a logo, a registered trademark including a trademark plus a stylized design of the manufacturer of the wristwatch 28, or a registered trademark including a trademark plus a stylized design of the user or owner of the wristwatch 28.

The anterior gripping application 18 of the anterior face 38$^1$ of the mounting portion 38 can include a silicone, a non-slip material, a neoprene material, elasticized threads, yarns, or filaments, having a lazar cut pattern, or an imprinted design or a bonded design, thereon. The anterior gripping application 18 provides a friction coefficient that provides protection against sliding of the case body 29 of the wristwatch 28 and the proximate bracelet portion of the wristwatch 28 positioned on the anterior face 38$^1$ of the mounting portion 38.

FIGS. 4B and 4D show a rear perspective view of the wristwatch wrapper device 100. The wristwatch wrapper device 100 includes the posterior material layer 14 that is formed joined with the anterior material layer 12, where the anterior material layer is shown in FIGS. 4A-4C. FIG. 4B shows the posterior material layer 14 includes a first portion of the posterior material layer 14$^1$ integrated within the first flexible cuff portion 34, and a second portion of the posterior material layer 14$^2$ integrated within the second flexible cuff portion 36 of the tubular body 90. The mounting portion 38 is disposed between the first flexible cuff portion 34 and the second flexible cuff portion 36. The mounting portion 38 includes a posterior face 38$^2$.

As shown in FIGS. 4B and 4D, the posterior face 38$^2$ of the mounting portion 38 is assimilated with a posterior gripping application 19. The posterior gripping application 19 is configured to comport with the distal portion of the bracelet 31 straps, or band, of the wristwatch 28 to prevent slippage of the wristwatch 28 that is mounted on the mounting portion 38 of the wristwatch wrapper device 100, as shown in FIG. 4D. Referring to FIG. 4D, a rear perspective view of FIG. 4C is shown, depicting the rear perspective view of the wristwatch 28 mounted on the mounting portion 38 of the tubular body 90 of the wristwatch wrapper device 100. FIG. 4D shows the distal portion of the bracelet 31 of the wristwatch 28 mounted against the posterior gripping application 19 assimilated with the posterior face 38$^2$ of the mounting portion 38.

The posterior gripping application 19 and can be configured using elasticized threads, yarns, or filaments knitted or weaved into the posterior face 38$^2$ of the mounting portion 38 in a raised netting pattern as shown in FIGS. 4B and 4D applied by way of the circular knitting machine enabling the posterior gripping application 19 to be devoid of adhesives in the application thereof. In another exemplary embodiment, the posterior gripping application 19 can be flush with the exterior surface of the posterior face 38$^2$ of the mounting portion 38.

The posterior gripping application 19 of the posterior face 38$^2$ of the mounting portion 38 can be configured in a variety of patterns including, a pattern of discrete raised gripping surfaces wherein the pattern can be selected from any one of a shape comprising a circle, a rectangle, an oval, a star shape, a heart shape, letters, numbers, dates, a logo, a vanity moniker, name, indicia, vanity initials, face of a watch, hands of a watch, a logo, a registered trademark plus a stylized design of the manufacturer of the wristwatch 28, or a registered trademark plus a stylized design of the user or owner of the wristwatch.

The posterior gripping application 19 of the posterior face 38$^2$ can include a silicone, a non-slip material, a neoprene material, elasticized threads, yarns, or filaments, having a lazar cut pattern, or an imprinted design or a bonded design thereon. The posterior gripping application 19 provides a friction coefficient that provides protection against sliding of the distal portion of the bracelet 31, strap or band, of the wristwatch 28.

In another exemplary embodiment, the anterior face 38$^1$ of the mounting portion 38 is assimilated with the anterior gripping application 18 and the posterior face 38$^2$ of the mounting portion 38 is assimilated with the posterior gripping application 19 wherein each of the anterior gripping application 18 and the posterior gripping application 19 is transferable, or replaceable, such that the anterior gripping application 18 that is worn and/or the posterior gripping application 19 that is worn can be replaced with a replacement anterior gripping application 18 that is new, or a replacement posterior gripping application 19 that is new, respectively.

With close inspection of FIG. 4C, the interior lining material 13 includes a first interior lining material portion 13$^1$ of the interior lining material 13 that is coplanar with a first portion of the anterior material layer 12$^1$ of the first flexible cuff portion 34 and a second interior lining material 13$^2$ that is coplanar with a first portion of the posterior material layer 14$^1$ of the first flexible cuff portion 34 of the tubular body 90 of the wristwatch wrapper device 100. The interior lining material 13, also, includes a third interior lining material portion 13$^3$ that is coplanar with a second portion of the anterior material layer 12$^2$ of the second flexible cuff portion 36, and a fourth interior lining material portion 13$^4$ that is coplanar with a second portion of the posterior material layer 14$^2$ of the second flexible cuff portion 36 of the tubular body 90 of the wristwatch wrapper device 100.

A prefigured area of the interior lining material 13 is configured with a design 32 or logo. The preconfigured area is selected to be on the third interior lining material portion 13$^3$ that is coplanar with the second portion of the anterior material layer 12$^2$ of the second flexible cuff portion 36 of the tubular body 90 of the wristwatch wrapper device 100. In this manner, when the wristwatch wrapper device 100 is implemented for use, wherein the second flexible cuff portion 36 is upturned and reversed inside-out, as shown in FIGS. 4C-4D, to form the wristwatch wrapper device 100 having the closed dual-seamed orbicular shape, as depicted in FIGS. 4D, the design or logo 32 is revealed. In particular, FIG. 4E depicts the logo of a watch maker, for example, OMEGA®. The design can be a logo, a user's logo, a manufacturer's logo, a registered trademark including a trademark plus stylized design of the user or owner of the wristwatch 28, a registered trademark including a trademark plus stylized design of the manufacturer of the wristwatch 28.

A second preconfigured area of the interior lining material 13 is configured with the housing 40. As shown in FIGS. 4B, 4D and 4F, the fourth interior lining material portion 13$^4$ that is congruent with the second posterior material layer portion 14$^2$ of the second flexible cuff portion 36 of the tubular body 90 of the wristwatch wrapper device 100 includes the housing 40 having a compartment recessed into the fourth interior lining material portion 13$^4$ wherein the compartment is configured to contain a transferable smart device 41. The housing 40 includes a retractable elasticized closure 43 that can be manipulated so that the user can readily insert and retrieve the transferable smart device 41.

The transferable smart device 41 can include, a wireless tracking device, a short-wave wireless fidelity device, a wristwatch battery, a universal serial bus charger adapter which can be contained in the housing 40 of the wristwatch wrapper device 100. The transferable smart device 41 can be built with a microprocessor with short range wireless fidelity microchip to wirelessly connect to the user's smart phone, smart watch, iWatch, iPad, or connected computing personal smart device. The transferable smart device 41 is configured to wirelessly connect with a user's smart device to generate information on a location of the user's wristwatch 28. The transferable smart device 41 can be readily replaced as needed or at the will of the user.

As shown in FIGS. 4A-4F, a first metal ring-spring gate O-ring 80 is removably coupled to a first segment of the second elasticized selvage 26 of the second flexible cuff portion 36 of the tubular body 90. A first metal swivel carabiner hinge 82 having a first swivel connector 84 is removably coupled to the first metal ring-spring gate O-ring 80. In this manner, when the wristwatch wrapper device 100 having the closed dual-seamed orbicular shape, as shown in FIGS. 4E-4G, is implemented protecting, securing, and storing the user's wristwatch 28, the first metal swivel carabiner hinge 82 enables the user to temporarily removably couple the wristwatch wrapper device 100 to a user's article of clothing, a pocket, a bag, pocket book, luggage, suit case while not wearing the wristwatch 28, especially while travelling, for example, through airport security.

The first metal ring-spring gate O-ring 80 and the first metal swivel carabiner hinge 82 and the first swivel connector 84 can each be made with a precious metal selected from the group comprising 8K gold, 14K gold, 18K gold, 24K gold, a rose gold, a white gold, a platinum, a copper, a sterling silver, silver, silver plated with 8K-24K gold, silver, sterling silver, black plated gold, or platinum, iron, cast iron, gun metal, and with a combination of gems, and/or integrated with precious gems.

FIG. 4B is a rear perspective view of the wristwatch wrapper device 100 in the flattened state. FIG. 4F is a perspective view is a rear perspective view of the wristwatch wrapper device 100 in the closed dual-seamed orbicular shape having the wristwatch 28 mounted on the mounting portion 38 enclosed therein. FIG. 4C shows the wristwatch wrapper device 100 in a flattened state showing the front portion of the wristwatch 28 mounted on the anterior face 38$^1$ of the mounting portion 38 of the tubular body 90 of the wristwatch wrapper device 100. With close inspection of FIG. 4C, the anterior gripping application 18 is shown integrated with the anterior portion of the mounting portion 38$^1$ wherein the anterior gripping application 18 is configured to comport with a case body 29 of a wristwatch 28 and a proximate portion of the bracelet 31 of the wristwatch 28 being supported by the mounting portion 38 of the tubular body 90 of the wristwatch wrapper device 100 to prevent slippage of the case body 29 of the wristwatch 28. The first flexible cuff portion 34 and the second flexible cuff portion 36 are shown being upturned at the first elasticized selvage 20 of the first flexible cuff portion 34 and at the second elasticized selvage 26 second flexible cuff portion 36.

FIG. 4D shows a rear perspective view of FIG. 4C showing the distal portion of the bracelet 31 of the wristwatch 28 mounted on the posterior face 38$^2$ of the mounting portion 38 of the wristwatch wrapper device 100. With a close inspection of FIG. 4D, the posterior gripping application 19 is shown supporting the distal portion of the wristwatch 28 whereby the posterior gripping application 19 prevents slippage of the wristwatch 28.

As shown in FIGS. 4B and 4F, another exemplary embodiment of the present invention includes a housing 40, with reference to FIGS. 4C and 4D, the fourth interior lining material portion 13$^4$ that is congruent with the second portion of the posterior material layer 14$^2$ of the second flexible cuff portion 36 of the tubular body 90 of the wristwatch wrapper device 100 includes a housing 40 having a compartment having a retractable elasticized closure 43 recessed into the fourth interior lining material portion 13$^4$ wherein the compartment is configured to contain a transferable smart device 41, as shown in FIGS. 4B, 4D and 4F. In this manner, when the first flexible cuff portion 34 and the second flexible cuff portion 14 is each manipulated and upturned and reversed inside-out the third interior lining material portion 13$^3$ that is coplanar to the second portion of the anterior material layer 12$^2$ of the second flexible cuff portion 36 is brought to the anterior exterior surface of the wristwatch wrapper device 100 having the closed dual-seamed orbicular shape. Consequently, the fourth interior lining material portion 13$^4$ that is coplanar with the second portion of the posterior material layer 14$^2$ of the second flexible cuff portion 36 is brought to the posterior exterior surface of the wristwatch wrapper device 100 having the closed dual-seamed orbicular shape. In this manner, the housing 40 recessed into the fourth interior lining material portion 13$^4$ is reveled and provides the user with access to the transferable smart device 41 contained in the compartment of the housing 40.

FIGS. 4C-4F show the wristwatch wrapper device 100 and manipulation of the wristwatch wrapper device 100 to envelop and protect the wristwatch 28 being mounted on the anterior gripping application 18 assimilated with the anterior face 38$^1$ of the mounting portion 38 and the posterior gripping application 19 assimilated with the posterior face 38$^2$ of the mounting portion 38.

FIG. 4C illustrates the manipulation of the first flexible cuff portion 34 and the second flexible cuff portion 36 of the tubular body 90 of the wristwatch wrapper device 100 to wrap around the wristwatch 28 to form the closed dual-seamed orbicular wristwatch wrapper device 100 having the orbicular shape enveloping the wristwatch 28, as shown in FIGS. 4E-4F, whereby the wristwatch 28 is temporarily stored, secured, and protected.

As shown in FIGS. 4C and 4D, the interior lining material 13 of the tubular body 90 of the wristwatch wrapper device 100 includes a first interior lining material portion 13$^1$ that is congruent with a first portion of the first anterior material layer 12$^1$ of the first flexible cuff portion 34 and a second interior lining material portion 13$^2$ that is congruent with a first portion of the posterior material layer 14$^1$ of the first flexible cuff portion 34 of the tubular body 90. Similarly, the interior lining material 13 includes a third interior lining material portion 13$^3$ that is coplanar with a second portion of the anterior material layer 12$^2$ of the second flexible cuff portion 34 of the tubular body 90 of the wristwatch wrapper device 100, and the interior lining material 13 includes a fourth interior lining material portion $13^4$ that is coplanar with a second portion of the posterior material layer $14^2$ of the second flexible cuff portion 36 of tubular body 90 of the wristwatch wrapper device 100.

FIG. 4C illustrates the front perspective view of the wristwatch wrapper device 100, in use, wherein the wristwatch 28 is being supported by the mounting portion 38 of the wristwatch wrapper device 100. The tubular body 90 includes the first flexible cuff portion 34 and the second flexible cuff portion 36 with the mounting portion 38 disposed therebetween. In particular, the anterior face $38^1$ of the mounting portion 38 is shown supporting the case body 29 of the wristwatch 28 and the proximate portion of the bracelet 31 of the wristwatch 28. The anterior gripping application 18 assimilated with the anterior face $38^1$ of the mounting portion 38 which provides a friction coefficient that provides protection against sliding of the case body 29 of the wristwatch 28 and the proximate bracelet portion of the wristwatch 28 positioned on the anterior face $38^1$ of the mounting portion 38. Similarly, the posterior gripping application 19, as shown in FIG. 4D, is assimilated with the posterior face 38 of the mounting portion 38 which provides a friction coefficient that provides protection against sliding of the distal portion of the bracelet 31 of the wristwatch 28 positioned on the posterior face $38^1$ of the mounting portion 38.

As shown in FIGS. 4C and 4E, the user can manipulate the wristwatch wrapper device 100 into the closed dual-seamed orbicular wristwatch wrapper shape to wrap the wristwatch 28 therein to protect and safeguard the wristwatch 28 from moisture, dust, shock, breakage, and other environmental elements. FIG. 4C shows the first flexible cuff portion 34 of the tubular body 90 being upturned and reversed inside-out. As the first flexible cuff portion 34 is being upturned and reversed inside-out, the user starts at the first elasticized selvage 20 and folds the first flexible cuff portion 34 at the first stitched seam 23 of the first piping 22 of the first circumferential mounting portion edge of the mounting portion 38. The first flexible cuff portion 34 is wrapped around the wristwatch 28 which is mounted on the anterior face $38^1$ of the mounting portion 38 of the tubular body 90 of the wristwatch wrapper device 100. As the first flexible cuff portion 34 is being upturned and reversed inside-out, the first interior lining material portion $13^1$ that is coplanar with the first portion of the anterior material layer $12^1$ of the first flexible cuff portion 34 and the second interior lining material portion $13^2$ that is coplanar to the first portion of the posterior material layer $14^1$ of the first flexible cuff portion 34 of the tubular body 90 of the wristwatch wrapper device 100 are both being upturned and reversed inside-out to come to the exterior surface, as shown in FIGS. 4C-4F. Concomitantly, a surface of the first portion of the first anterior material layer $12^1$ of the first flexible cuff portion 34 comes in contact with the crystal and crown 33 of the wristwatch 28 and the proximate portion of the bracelet 31, strap or band, of the wristwatch 28, and a surface of the first portion of the posterior material layer $14^1$ of the first flexible cuff portion 34 comes in contact with the distal portion of the bracelet 31, strap or band, of the wristwatch 28. In this manner, the first flexible cuff portion 34 provides a first circumambient layer enveloping the wristwatch 28 being temporarily sealed by the first elasticized selvage 20.

Subsequently, as shown in FIGS. 4C, 4D and 4F, the user can manipulate the second flexible cuff portion 36 to wrap over the first flexible cuff portion 34 of the tubular body 90 of the wristwatch wrapper device 100. As the second flexible cuff portion 36 is being upturned to be reversed in-side-out, the user starts at the second elasticized selvage 26 and folds the second flexible cuff portion 34 at the second stitched seam 27 of the second piping 24 of the second circumferential mounting portion edge of the mounting portion 38. The second flexible cuff portion 36 is wrapped around the first flexible cuff portion 34 having the wristwatch being held, therein. As the second flexible cuff portion 36 is being upturned and reversed inside-out, the third interior lining material portion $13^3$ that is coplanar with the second portion of the anterior material layer $12^2$ of the second flexible cuff portion 36 and, concomitantly, the fourth interior lining material portion $13^4$ that is coplanar to the second portion of the posterior material layer $14^2$ of the second flexible cuff portion 36 of the tubular body 90 of the wristwatch wrapper device 100 are both being upturned and reversed inside-out to come to the exterior surface as shown in FIGS. 4E and 4F. Consequently, a surface of the second portion of the second anterior material layer $12^2$ of the second flexible cuff portion 36 comes in contact with a surface of the first interior lining material portion $13^1$ of the first flexible cuff portion 34, and a surface of the second portion of the posterior material layer $14^2$ of the second flexible cuff portion 36 comes in contact with a surface of the second interior lining material portion $13^2$ of the first flexible cuff portion 34. In this manner, the second flexible cuff portion 34 provides a second circumambient layer enveloping the wristwatch 28 being temporarily sealed by the second elasticized selvage 26. The closed dual-seamed orbicular wristwatch wrapper device 100 wraps around the wristwatch 28 whereby the wristwatch 28 is temporarily stored, secured, and protected therein, as shown particularly in FIGS. 4E and 4F. In this manner, the third interior lining material portion $13^3$ provides an anterior facing cover for the closed dual-seamed orbicular wristwatch wrapper device 100 and the fourth interior lining material portion $13^4$ provides a posterior facing cover for the closed dual-seamed orbicular wristwatch wrapper device 100. The wristwatch wrapper device 100 having the closed dual-seamed orbicular wristwatch wrapper shape protects the wristwatch 28 from moisture, mildew, damage, shock, and breakage.

In this manner, as shown in FIGS. 4E and 4F, the first metal swivel carabiner hinge 82 removably coupled to the first segment of the second elasticized selvage 26 remains accessible to a user. Consequentially, the third interior lining material portion $13^3$ of the second flexible cuff portion 36 of the tubular body 90 being upturned to the exterior surface, the design or logo 32 is revealed, as shown in FIG. 4E. More particularly, the interior material lining 13 being upturned and reversed in-side out is the third interior lining material portion $13^3$ of the interior lining material 13 that is coplanar with the second portion of the anterior material layer $12^2$ which provides an anterior facing cover for the orbicular shaped wristwatch wrapper device 100 whereby the design or logo 32 is revealed imprinted on the anterior facing cover of the orbicular shaped wristwatch wrapper device 100.

With a close inspection of FIG. 4C, the front perspective view of the wristwatch wrapper device 100 in the closed dual-seamed orbicular shape is shown. The wristwatch wrapper device 100 is shown in use where the wristwatch 28 (shown in dotted lines) is being supported by the anterior face $38^1$ of the mounting portion 38 of the wristwatch wrapper device 100. In particular, with reference to FIG. 4C, the anterior face $38^1$ of the mounting portion 38 is shown supporting the case body 29 of the wristwatch 28 and the proximate portion of the bracelet 31, strap, or band, of the wristwatch 28 wherein the anterior face $38^1$ of the mounting portion 38 is integrated with the anterior gripping application 18. As mentioned above, as shown in FIG. 4 E, the design or logo 32, particularly, "OMEGA" plus design, is shown on the anterior facing cover of the orbicular shaped wristwatch wrapper device 100.

Consequently, as shown in FIG. 4F by upturning and reversing the interior material lining 13 inside-out the fourth interior lining material portion $\mathbf{13}^4$ coplanar with the second portion of the posterior material layer comes to the exterior surface and being revealed provides a posterior facing cover for the orbicular shaped wristwatch wrapper device 100.

Referring again to FIG. 4F, the housing 40 is shown in dotted lines being recessed within the fourth interior lining material portion $\mathbf{13}^4$ of the interior lining material portion 13 that is coplanar with the second portion of the posterior material layer $\mathbf{14}^2$ of the second flexible cuff portion 36 of the tubular body. The housing 40 includes the compartment having the transferable smart device 41 contained, therein, wherein the transferable smart device 41 can be easily accessed and replaced as needed by way of the 43 retractable elasticized closure 43. Further, the wristwatch wrapper device 100 being in the closed dual-seamed orbicular configuration is temporarily sealed and secured by the second elasticized selvage 26 where the second elasticized selvage 26 provides an elasticized seal around the first flexible cuff portion 34 whereby the wristwatch wrapper device 100 in the closed dual-seamed orbicular form provides the wristwatch protection against harm, and the intrusion of moisture, dust, ultraviolet rays, and damage.

FIG. 4F shows a rear perspective view of the wristwatch wrapper device 100 of FIG. 4E showing the distal portion of the bracelet 31, strap, or band, of the wristwatch 28 mounted on the mounting portion 38 of the tubular body 90 of the wristwatch wrapper device 100. The rear portion of the wristwatch wrapper device 100 shows the distal portion of the bracelet 31 of the wristwatch 28 being mounted on the posterior face $\mathbf{38}^2$ of the mounting portion 38, with reference to FIG. 4D. In addition, FIG. 4F shows the wristwatch wrapper device 100, in the closed dual-seamed orbicular shape revealing the housing 40 that is recessed into the fourth interior lining material $\mathbf{13}^4$ of the second flexible cuff portion $\mathbf{14}^2$ wherein the fourth interior lining material $\mathbf{13}^4$ provides the posterior facing cover of the orbicular shaped wristwatch wrapper device 100, as shown in FIG. 4F. As shown in FIG. 4F the transferable smart device 41 is contained therein the housing 40.

It is beneficial and strategic to wrap the first flexible cuff portion 34 prior to wrapping the second flexible cuff portion 36 so that the design or logo 32 is revealed when the closed dual-seamed orbicular wristwatch wrapper device 100 is formed, as shown in FIGS. 4E, and the housing 40 having a compartment having a retractable elasticized closure 43 recessed into the fourth interior lining material portion $\mathbf{13}^4$ wherein the compartment is configured to contain the transferable smart device 41, as shown in FIG. 4B and FIG. 4F.

With a close inspection of FIGS. 4E and 4F, the second elasticized selvage 26 as it wraps over the first flexible cuff portion 34 carries with it the first metal ring-spring gate O-ring 80 which is removably coupled to the first metal swivel carabiner hinge 82 and its first swivel connector 84. In this manner, the first metal swivel carabiner hinge 82 is available to the user to removably attach to the user's garment, pocket, handbag, bag, luggage, clothing, a pocket, a bag, pocketbook, luggage, suitcase while travelling, for example, through an airport.

In this manner, the user can safely place the wristwatch wrapper device 100 containing the wristwatch 28 therein a bin when travelling through security at an airport. And further, the user can quickly retrieve the wristwatch wrapper device 100 from the bin and removably clip the wristwatch wrapper device 100 by way of the first metal swivel carabiner hinge 82 to the user's garment, pocket, handbag, bag, luggage, clothing, a pocket, a bag, pocket book, luggage, suit case while travelling.

FIG. 4G shows another exemplary embodiment of the wristwatch wrapper device 100 having the closed dual-seamed orbicular form, the wristwatch wrapper device 100 includes a second metal ring-spring gate O-ring 96, a second metal swivel carabiner hinge 98, having a second swivel connector 99. The second metal ring-spring gate O-ring 96 is removably coupled to a second segment of the second elasticized selvage 26 of the second flexible cuff portion 36 of the tubular body 90 of the wristwatch wrapper device 100. The second metal swivel carabiner hinge 98 includes the second swivel connector 99 which is removably coupled to the second metal swivel carabiner hinge 98 such that the second metal swivel carabiner hinge 98 is readily accessible. In this manner, a cross-body strap 111 can be removably connected to each of the first metal swivel carabiner hinge 82 and the second metal swivel carabiner hinge 98 so that the user can place the cross-body strap 111 over the user's upper body or the user's waist to carry the wristwatch wrapper device 100, having the closed dual-seamed orbicular shape, devoid of the user's hands. In this manner, a first metal swivel carabiner hook clip 112 of the cross-body strap 111 is removably coupled to the first metal swivel carabiner hinge 82 of the closed dual-seamed orbicular wristwatch wrapper device 100 and a second metal swivel carabiner hook clip 114 of a second end of the cross-body strap 111 is removably coupled to the second metal swivel carabiner hinge 98 of the closed dual-seamed orbicular wristwatch wrapper device 100. In this manner, the user can, conveniently, place the cross-body strap 111 around the user's torso or the user's waist to carry the wristwatch wrapper device 100 devoid of hands.

The second metal ring-spring gate O-ring 96, the second metal swivel carabiner hinge 98 and the second swivel connector 99, the first metal swivel carabiner hook clip 112, the second metal swivel carabiner hook clip 114, of the wristwatch wrapper device 100, having the closed dual-seamed orbicular shape, can each be made with a precious metal selected from the group comprising 8K gold, 12K gold, 18K gold, 24 K gold, a white gold, rose gold, pale gold, antique gold, platinum, copper, palladium, and sterling silver, and combination of gems. In another embodiment, the second metal ring-spring gate O-ring 96, the second metal swivel carabiner hinge 98, and the second swivel connector 99, the first metal swivel carabiner hook clip 112, the second metal swivel carabiner hook clip 114, of the closed dual-seamed orbicular wristwatch wrapper device 100 can each be made with an industrial metal including iron, cast iron, gun metal, and blackened ruthenium.

The In another exemplary embodiment of the wristwatch wrapper device 100 having the closed dual seamed orbicular configuration, includes a pocket 86 having a flap 92 configured with a decorative latch 88 having a first latch component $\mathbf{88}^1$ and a second latch component $\mathbf{88}^2$. The pocket 86 can be disposed on the fourth interior lining material portion $\mathbf{13}^4$ of the interior lining material 13 of the tubular body 90 such that when the second flexible cuff portion 36 is upturned and reversed inside-out the pocket 86 is provided on the posterior facing cover of the closed dual-seamed orbicular wristwatch wrapper 100. The decorative latch 88 includes a first latch component $\mathbf{88}^1$ and a second latch component $88^2$ wherein the first latch component $88^1$ is mateable with the second latch component $88^2$. The first latch component $88^1$ is fixedly attached to a front exterior material surface of the flap 92 and the second latch component $88^2$ is fixedly attached to a compatible front exterior material surface of a body portion of the pocket 86. The first latch component $88^1$ and the second latch component $88^2$ are made from a precious metal, a precious gem, combination thereof. The first latch component $88^1$ and the second latch component $88^2$ can be configured in a logo including one or more letters of the alphabet or any one of numbers, or a combination, thereof.

FIGS. 5A-5G illustrate another exemplary embodiment of the wristwatch wrapper device 200 of the present invention. As related to the wristwatch wrapper device at 10 depicted in FIGS. 1A-3E, the like numeral designations denote like elements, as recited in the detailed description and the drawings for the wristwatch wrapper at 10 will be repeated in the following detailed description for the wristwatch wrapper device at 200 and its accompanying drawings depicted in FIGS. 5A-5G, for brevity and clarity. Herein after, the present invention of the wristwatch wrapper device 200 is, also, referred to a torus-shaped wristwatch wrapper device 200 when the wristwatch wrapper device is in a wrapped state configured having a torus-shape including a gripping ring 42. Hereinafter, the two terms wristwatch wrapper device 200 and the torus-shaped wristwatch wrapper device 200 can be used interchangeably throughout the disclosure.

Generally, and disclosed in more detail below, FIGS. 5A-5G illustrate a wristwatch wrapper device 200 including a tubular body 90 having a tubular open channel 30. The wristwatch wrapper device 200 includes a first viewing window 50, a second viewing window 56, a third viewing window 62, wherein the wristwatch wrapper device 200 in a folded state includes a torus-shaped wristwatch wrapper device 200 configuration having a gripping ring 42, as shown in FIG. 5G. A wristwatch 28 mounted on a mounting portion 38 can be viewed therethrough the first viewing window 50 and the second viewing window 56. An identification card 68 or one or more identification cards $68^{1+N}$ can be slidably inserted into a cavity of the third viewing window 62.

FIGS. 5A-5B shows the wristwatch wrapper device 200 in an unfolded state. FIG. 5A shows a front perspective view of the wristwatch wrapper device 200. FIG. 5B shows a rear perspective view of the wristwatch wrapper device 200. The wristwatch wrapper device 200 includes a tubular body 90 having an anterior material layer 12 formed joined to a posterior material layer 14 reinforced with an interior lining material 13 circumventing a tubular open channel 30. The tubular open channel 30 includes a first open end $30^1$ limited by a first circumferential tubal body edge and a second open end $30^2$ limited by a second circumferential tubal body edge. The tubular body 90 includes a lateral direction and a circumferential direction.

As shown in FIGS. 5A and 5B, a first elasticized selvage 20 is integrated with the first circumferential tubal body edge of the first open end $30^1$ of the tubular body 90 and a second elasticized selvage 26 is integrated with the second circumferential tubal body edge of the second open end $30^2$ of the tubular body 30. As shown in FIGS. 5A and 5B, the first elasticized selvage 20 and the second elasticized selvage 26 of the tubular body 90 is separated by a first flexible cuff portion 34 and a second flexible cuff portion 36 having a mounting portion 38 centrally positioned disposed therebetween the first flexible cuff portion 34 and the second flexible cuff portion 36. FIG. 5A is a front perspective view of the wristwatch wrapper device 200, and FIG. 5B is a rear perspective view of the wristwatch wrapper device 200, which illustrates the first elasticized selvage 20 circumvents the anterior material layer 12 around the first open end $30^1$ of the tubular body 90 from the anterior material layer 12 thereto the posterior material layer 14 of the first flexible cuff portion 34. Similarly, FIG. 5B shows, with reference to FIG. 5A, the second elasticized selvage 26 circumvents the anterior material layer 12 around the second open end $30^2$ of the tubular body 90 from the anterior material layer 12 thereto the posterior material layer 12 of the second flexible cuff portion 36.

FIG. 5A shows the mounting portion 38 includes an anterior face $38^1$ wherein the anterior face $38^1$ is assimilated with an anterior gripping application 18 and, as shown in FIG. 5B, the mounting portion 38 includes a posterior face $38^2$ wherein the posterior face $38^2$ of the mounting portion 38 is assimilated with a posterior gripping application 19. In this exemplary embodiment of the wristwatch wrapper device 200, the mounting portion 38 can one or more layers of material.

Particularly, as shown in FIGS. 5A and 5E, the anterior gripping application 18 is assimilated on the anterior face $38^1$ of the mounting portion 38 is configured to comport with a case body 29 of a wristwatch 28 and a proximate portion of the bracelet 31 of the wristwatch 28 being supported by the mounting portion 38 of the tubular body 90 of the wristwatch wrapper device 200 to prevent slippage of the case body 29 of the wristwatch 28.

Referring to FIG. 5B, the mounting portion 38 includes a posterior face $38^2$ wherein the posterior face $38^2$ of the mounting portion 38 is assimilated with a posterior gripping application 19. The posterior gripping application 19 is configured to comport with the distal portion of the bracelet of the wristwatch 28 to prevent slippage of the wristwatch being mounted on the mounting portion of the tubular body of the wristwatch wrapper device 200.

The anterior gripping application 18 of the anterior face $38^1$ of the mounting portion 38, as shown in FIG. 5A and partially in FIG. 5E, and the posterior gripping application 19 of the posterior face $38^2$ of the mounting portion 38, as shown in FIG. 5B, can be configured using elasticized threads, yarns, or filaments knitted or weaved into the anterior face $38^1$ of the mounting portion 38 in a raised netting pattern, applied by way of the circular knitting machine enabling the anterior gripping application 18 to be devoid of adhesives in the application thereof. In another exemplary embodiment, the anterior gripping application 19 can be flush with the exterior surface of the anterior face $38^1$ of the mounting portion 38 of the tubular body 90 of the wristwatch wrapper device 200.

The anterior gripping application 18 of the anterior face $38^1$ of the mounting portion 38 and the posterior gripping application 19 of the of the posterior face $38^2$ of the mounting portion 38 of the wristwatch wrapper device 200 can be configured in a variety of patterns including, a pattern of discrete raised gripping surfaces wherein the pattern can be selected from any one of a shape comprising a circle, a rectangle, an oval, a star shape, a heart shape, letters, numbers, dates, a logo, a vanity moniker, name, indicia, vanity initials, face of a watch, hands of a watch, a logo, a registered trademark plus a stylized design of the manufacturer of the wristwatch 28, or a registered trademark plus a stylized design of the user or owner of the wristwatch 28. The stylized design is the term implemented by the United State Trademark Office describing a design or graphic displayed in the trademark to provide a source identification of the goods or services or brand associated with the trademark.

The anterior gripping application 18 of the anterior face 38$^1$ of the mounting portion 38 and the posterior gripping application 19 of the posterior face 38$^2$ of the mounting portion 38 can include a silicone material, a non-slip material, a neoprene material, elasticized threads, yarns, or filaments, having a lazar cut pattern, or an imprinted design or a bonded design thereon. The anterior gripping application 18 provides a friction coefficient that provides protection against sliding of the case body 29 of the wristwatch 28 and the proximate bracelet portion of the wristwatch 28 positioned on the posterior face 38$^2$ of the mounting portion 38. Silicone is characterized by a coefficient of friction (CoF) which describes how hard it is to slide the silicone along a surface. Silicone is naturally quite tacky, with a coefficient of friction of approximately 1.0.

FIG. 5B shows a rear perspective view of the wristwatch wrapper device 200. The wristwatch wrapper device 200 includes the posterior material layer 14 that is formed joined with the anterior material layer 12, as shown in FIGS. 5A and 5C-5D. FIG. 5B shows the posterior material layer 14 includes a first portion of the posterior material layer 14$^1$ of the first flexible cuff portion 34 and a second portion of the posterior material layer 14$^2$ of the second flexible cuff portion 36 of the tubular body 90 having the posterior face 38$^2$ of the mounting portion 38 therebetween.

As shown in FIG. 5B the posterior face 38$^2$ of the mounting portion 38 is assimilated with a posterior gripping application 19. The posterior gripping application 19 is configured to comport with the distal portion of the bracelet 31 straps, or band, of the wristwatch 28 to prevent slippage of the wristwatch 28 that is mounted on the mounting portion 38 of the wristwatch wrapper device 200, as shown in FIG. 5E, with reference to FIG. 5B.

The posterior gripping application 19 of the posterior face 38$^2$ of the mounting portion 38 can be configured using elasticized threads, yarns, or filaments knitted or weaved into the posterior face 38$^2$ in a raised netting pattern as shown in FIG. 5B, applied by way of the circular knitting machine enabling the posterior gripping application 19 to be devoid of adhesives in the application thereof. In another exemplary embodiment, the posterior gripping application 19 can be flush with the exterior surface of the posterior face 38$^2$ of the mounting portion 38.

The posterior gripping application 19 of the posterior face 38$^2$ can include a silicone, a non-slip material, a neoprene material, elasticized threads, yarns, or filaments, having a lazar cut pattern, or an imprinted design or a bonded design thereon. The posterior gripping application 19 provides a friction coefficient that provides protection against sliding of the distal portion of the bracelet 31, strap, or band, of the wristwatch 28. As discussed above, silicone is characterized with a coefficient of friction (CoF) which describes how hard it is to slide the silicone along a surface. Silicone is naturally quite tacky, with a coefficient of friction of approximately 1.0.

In another exemplary embodiment, the anterior face 38$^1$ of the mounting portion 38 is assimilated with the anterior gripping application 18 and the posterior face 38$^2$ of the mounting portion 38 is assimilated with the posterior gripping application 19 wherein each of the anterior gripping application 18 and the posterior gripping application 19 is transferable and replaceable such that the anterior gripping application 18 that is worn and/or a worn posterior gripping application 19 that is worn can be replaced with a replacement anterior gripping application 18 that is new or a replacement posterior gripping application 19 that is new, respectively.

FIG. 5C shows a side perspective view of the wristwatch wrapper device 200 showing the first open end 30$^1$ of the tubular open channel 30 of the tubular body 90 integrated with the first elasticized selvage 20 from the perspective of the first flexible cuff portion 34 of the wristwatch wrapper device 200. FIG. 5D shows a side perspective view of the wristwatch wrapper device 200 showing the second open end 30$^2$ of the tubular open channel 30 of the tubular body 90 integrated with the second elasticized selvage 26 from the perspective of the second flexible cuff portion 36 of the wristwatch wrapper device 200.

The first flexible cuff portion 34 is configured with a first circumferential cross section and the second flexible cuff portion 36 is configured with a second circumferential cross section, and the mounting portion 38 is configured with a third circumferential cross section wherein the first circumferential cross section is equal to the second circumferential cross section, and the third circumferential cross section is equal to the first circumferential cross section and the second circumferential cross section.

Returning to FIG. 5A, the front perspective view of the wristwatch wrapper device 200, the first flexible cuff portion 34 includes a first portion of the anterior material layer 12$^1$ bound by the first elasticized selvage 20 and the second flexible cuff portion 36 includes a second portion of the anterior material layer 12$^2$ bound by the second elasticized selvage 26. Looking at FIG. 5B, the rear perspective view of the wristwatch wrapper device 200 the first flexible cuff portion 34 includes a first portion of the posterior material layer 14$^1$ including being bound by the first elasticized selvage 20 and the second flexible cuff portion 36 includes a second portion of the posterior material layer 14$^2$ including being bound by the second elasticized selvage 26.

Referring again to FIG. 5C and FIG. 5D, FIG. 5C is a side perspective view of the wristwatch wrapper device 200 from the side perspective view of the first flexible cuff portion 34, and FIG. 5D is a side perspective view of the wristwatch wrapper device 200 from the side perspective view of the second flexible cuff portion 36 of the wristwatch wrapper device 200, the interior lining material 13 is shown. The interior lining material 13 is configured with a first interior lining material portion 13$^1$ that is coplanar with a first portion of the anterior material layer 12$^1$ of the anterior material layer 12 of the first flexible cuff portion 34. The interior lining material 13 includes a second interior lining material portion 13$^2$ that is coplanar with a first portion of the posterior material layer 14$^1$ of the first flexible cuff portion 34 of the tubular body 90 of the wristwatch wrapper device 200.

Similarly, FIGS. 5C and 5D, also, shows the interior lining material 13 is configured with a third interior lining material portion 13$^3$ that is coplanar with a second portion of the anterior material layer 12$^2$ of the second flexible cuff portion 36, and the interior lining material 13 includes a fourth interior lining material portion 13*s* that is coplanar with a second posterior material layer portion 14$^2$ of the posterior material layer 14 that is coplanar with a second portion of the posterior material layer 14 of the second flexible cuff portion 36 of the tubular body 90 of the wristwatch wrapper device 200.

With a close inspection of FIG. 5C, with reference to FIG. 5A, the side perspective view of the wristwatch wrapper device 200 from the perspective of the first flexible cuff portion 34, the first viewing window 52 is shown integrated therethrough the first portion of the anterior material layer 12[1] of the first flexible cuff portion 34 therethrough to its coplanar first interior lining material portion 13[1]. In addition, as shown in FIG. 5C, the housing 40 is shown recessed into the second interior lining material portion 13[2] which is coplanar to the first portion of the posterior material layer 14[1] of the posterior material layer 14 of the first flexible cuff portion 34 of the tubular body of the wristwatch wrapper device 200.

With a close inspection of FIG. 5D, with reference to FIGS. 5A and 5C, side perspective view of the wristwatch wrapper device 200 from the perspective of the second flexible cuff portion 36, the second viewing window 56 is shown integrated therethrough the third interior lining material 13[3] which is coplanar to the second portion of the anterior material layer 12[2] of the second flexible cuff portion 36 of the tubular body 90 of the wristwatch wrapper device 200. In addition, FIG. 5D with reference to FIG. 5B, shows the third viewing window 62 integrated with the fourth interior lining material portion 13 which is coplanar with the second portion of the posterior material layer 14[2] of the second flexible cuff portion 36 of the tubular body 90 of the wristwatch wrapper device 200. The third viewing window 62 is shown with the identification card 68. The third viewing window 62 is formed from a third flexible transparent thermoplastic polyurethane sheet 64 which is fixed within a first posterior surface cut-out portion of the second portion of the posterior material layer 14[2] of the second flexible cuff portion 36. The third viewing window 62 is bound by a third framed edge 65. The third framed edge 65 can be made with silicone.

Returning to FIG. 5A, the first flexible cuff portion 34 is shown having a first viewing window 50 wherein the first viewing window 50 is formed from a first flexible transparent thermoplastic polyurethane sheet 52. The first flexible transparent thermoplastic polyurethane sheet 52 is fixed and framed within a first anterior surface cut-out portion of the first portion of the anterior material layer 12[1] of the first flexible cuff portion 34 concordant with a first cut-out portion of the first interior lining material portion 13[1] of the tubular body 90. The first viewing window 50 is bound by a first framed edge 54. The first framed edge 54 of the first viewing window 50 can include a silicone material.

FIG. 5A, also, shows a second viewing window 56 formed from a second flexible transparent thermoplastic polyurethane sheet 58 which is fixed within a second anterior surface cut-out portion of the second portion of the anterior material layer 12[2] of the second flexible cuff portion 36 concordant with a second cut-out portion of the interior lining of the tubular body 90. The second viewing window 56 is bound by a second framed edge 60. The second framed edge of the second viewing window 56 can be made with silicone material.

Referring to FIG. 5C, the first viewing window is shown configured therethrough the first interior lining material portion 13[1] of the interior lining material 13 which is coplanar with the first portion of the anterior material layer 12[1] of the tubular body 90 of the wristwatch wrapper device 200. In this manner, as shown in FIG. 5E, when the first flexible cuff portion 34 is upturned and reversed inside-out and the first interior lining material portion 13[1] that is coplanar with the first portion of the anterior material layer 12[1] of the first flexible cuff portion 34 is upturned to the exterior surface of the wristwatch wrapper device 200 the first viewing window 50 can be extended over the front portion of the wristwatch 28 being mounted on the mounting portion 38. In this manner, a surface of the first viewing window 50 comes in contact with a crystal and crown 33 of the wristwatch 28 and a proximate portion of the bracelet 31, strap, or band of the wristwatch 28. The crystal and crown 38 and proximate portion of the bracelet 31 of the wristwatch 28 can be viewed therethrough the first viewing window 50.

Subsequently, when the second flexible cuff portion 36 is upturned and reversed inside-out to envelop the first cuff portion 34, currently being wrapped around the wristwatch 28, the third interior lining material portion 13[3] which is coplanar with the second portion of the anterior material layer 12[2] of the second flexible cuff portion 36 is upturned to the exterior surface. In this manner, the second viewing window 56 can be overlaid coplanar to the first viewing window 50 such that the crystal and crown 33 of the wristwatch 28 and the proximate portion of the bracelet 31, strap, or band of the wristwatch 28 can be viewed by the user therethrough the second viewing window 56 and the first viewing window 50, as shown in FIG. 5E.

FIG. 5B is a rear perspective view of the wristwatch wrapper device 200 showing a rear perspective view of the first portion of the posterior material layer 14[1] of first flexible cuff portion 34 and the second portion of the posterior material layer 14[2] of the second flexible cuff portion 36 of the tubular body 90 of the wristwatch wrapper device 200. As shown in FIG. 5B, a third viewing window 62 is formed from a third flexible transparent thermoplastic polyurethane sheet 64 which is fixed to a portion of the fourth interior lining material portion 13[4] coplanar to the second portion of the posterior material layer 14[2] of the second flexible cuff portion 36 of the tubular body 90 of the wristwatch wrapper device 200. The third viewing window 62 is bound with a third framed edge 65. The third viewing window 62 is configured with a slot 66 having a contoured opening to slidably receive one or more identification cards 68 therein, as shown in FIGS. 5B-5C and 5F-5G. The third framed edge 65 of the third viewing window 62 can be made with a silicone material.

In this manner, when the second flexible cuff portion 36 is upturned inside-out and wrapped around the first flexible cuff portion 34 the third interior lining material portion 13[3] and the fourth interior lining material portion 13[4] are brought to the exterior surface such that the third viewing window 62 having the identification card 68 enclosed therein can be accessed by the user, as shown in FIG. 5F.

In this exemplary embodiment, the first flexible transparent thermoplastic polyurethane sheet of the first viewing window 50, the second flexible transparent thermoplastic polyurethane sheet of the second viewing window 56, and the third flexible transparent thermoplastic polyurethane sheet of the third viewing window 62, is formed from a flexible transparent thermoplastic polyurethane sheet including a thickness of at least 0.004 inch.

FIG. 5C in reference to FIG. 5B, shows the second interior lining material portion 13[2] coplanar with the second portion of the posterior material layer 14[2] of the first flexible cuff portion 34 of the tubular body 90 of the wristwatch wrapper device 200. As shown in FIG. 5B, the second interior lining material portion 13[4] of the interior lining material 13 includes a housing 40 recessed into a portion of the interior lining material 13 that is coplanar to a posterior portion of the first flexible cuff portion 34 of the tubular body 90, more particularly, the second interior lining material portion 13[2] of the interior lining material 13 that is coplanar with the first portion of the posterior material layer 14[1] of the first flexible cuff portion 34 of the tubular body 90. The housing 40 includes a compartment wherein the compartment includes a retractable elasticized closure 43 which is configured to contain a transferable smart device 41, as indicated by the dotted lines in FIG. 4F. In this manner, when the first flexible cuff portion 34 is turned inside-out and wrapped around the wristwatch 28 mounted on the mounting portion 38 the housing is available to the user whereby the user can insert the transferable smart device 41 therein, as shown in FIGS. 5B and 5C. Subsequently, when the second flexible cuff portion 36 is turned inside-out and envelops the first flexible cuff portion 34 the transferable smart device 41 being contained therein the housing 40 will be enclosed by the second flexible cuff portion 36 of the tubular body 90 of the wristwatch wrapper device 200.

The transferable smart device 41 can include, a wireless tracking device, a short-wave wireless fidelity device, a wristwatch battery, a universal serial bus charger adapter. In an exemplary embodiment of the present invention of the wristwatch wrapper device 200. The transferable smart device 41 can include software to wirelessly connect to the user's smart phone, smart watch, iWatch, iPad, or connected computing personal smart device. The transferable smart device 41 is built with a microcontroller with short range wireless fidelity (bluetooth) microchip to wirelessly connect with a user's smart device to generate information on a location of the user's wristwatch 28. In this manner, when the first flexible cuff portion 34 is folded inside-out enveloping the wristwatch 28 being mounted on the mounting portion 50 the housing 40 is exposed to an exterior surface so that the user can have access to the transferable smart device 41. Subsequently, when the second flexible cuff portion 36 is folded inside-out enveloping the first flexible cuff portion 34, the housing containing the transferable smart device 40 is enveloped and protected by the second flexible cuff portion 36.

FIGS. 5A-5B shows the mounting portion 38 of the wristwatch wrapper device 200 is framed with a vertically oriented first perimeter edge and a vertically oriented second perimeter edge wherein the first perimeter edge is integrated with a first piping 22 and the second perimeter edge is integrated with a second piping 24.

The mounting portion 38 of the wristwatch wrapper device 200, as shown in FIG. 5B, includes an anterior face $\mathbf{38}^1$ and a posterior face $\mathbf{38}^2$. The anterior face $\mathbf{38}^1$ is integrated with an anterior gripping application 18 and the posterior face $\mathbf{38}^2$ of the mounting portion 38 is integrated with a posterior gripping application 19.

The anterior gripping application 18 of the anterior face $\mathbf{38}^1$ of the mounting portion 38 of the tubular body 90 of the wristwatch wrapper device 200 can be made with a non-slip material including a netting pattern of discrete raised gripping filaments which are raised immediately adjacent to an exterior surface of the anterior face 18 of the mounting portion 38 devoid of adhesives. Similarly, the posterior gripping application 19 of the posterior face $\mathbf{38}^2$ of the mounting portion 38 comprises the netting pattern of discrete raised gripping filaments which are raised immediately adjacent to an exterior surface of the posterior face $\mathbf{38}^2$ of the mounting portion 38 devoid of adhesives.

The anterior gripping application 18 of the anterior face $\mathbf{38}^1$ of mounting portion 30 of the wristwatch wrapper device 200 can comprise a pattern of a plurality of discrete raised gripping surfaces integrated thereon an external surface of the anterior face $\mathbf{38}^1$ of the mounting portion 38. The posterior gripping application 19 of the posterior face $\mathbf{38}^2$ of the mounting portion 38 comprises a pattern of a plurality of discrete raised gripping surfaces integrated thereon an external surface of the posterior face $\mathbf{38}^2$ of the mounting portion 38 of the tubular body 90 of the wristwatch wrapper device 200.

In an embodiment of each of the anterior gripping application 18 of the anterior face $\mathbf{38}^1$ of the mounting portion 38, and the posterior gripping application 19 of the posterior face $\mathbf{38}^2$ of the mounting portion 38, of the wristwatch wrapper device 200 comprises a pattern of discrete raised gripping surfaces wherein the pattern of the discrete raised gripping surfaces can be selected from any one of a shape comprising a circle, a rectangle, an oval, a star shape, a heart shape, letters, numbers, dates, a logo, a vanity moniker, name, indicia, vanity initials, face of a wristwatch, hands of a wristwatch, a logo, a logo plus a design of a registered trademark owned by the manufacturer, or user, or owner of the wristwatch, a registered trademark including a mark plus stylized design of the manufacturer, or a registered trademark including a mark plus stylized design of the user, or owner of the wristwatch. The stylized design is the term implemented by the United State Trademark Office describing a design or graphic displayed in the trademark to provide a source identification of the goods or services or brand associated with the trademark.

The pattern of the discrete raised gripping surfaces of each of the anterior gripping application 18 of the anterior face $\mathbf{38}^1$ of the mounting portion 38, and the posterior gripping application 19 of the posterior face $\mathbf{38}^2$ of the mounting portion 38 can include a series of raised linear lines oriented in a longitudinal direction, a lateral direction, or a circular direction. In another embodiment, the pattern of the discrete raised gripping surfaces of each of the anterior gripping application 18 of the anterior face $\mathbf{38}^1$ of the mounting portion 38, and the posterior gripping application 19 of the posterior face $\mathbf{38}^2$ of the mounting portion 38 can include a non-slip material selected from the group comprising, silicone, polyurethane, synthetic rubber, natural rubber, polyamide yarn, and silicone coated yarn.

In an exemplary embodiment of the present invention, the gripping application 45 of the gripping ring 42 of the torus-shaped wristwatch wrapper device 200 can be a pattern of raised gripping surfaces comprising dots, bumps, pods, nodules, and/or the like comprising a gripping material including one or more of a combination of silicone, polyurethane, synthetic rubber, natural rubber, polyamide yarn, silicone coated yarn.

In another exemplary embodiment of the present invention, the gripping material 45 of the gripping ring 42 of the torus-shaped wristwatch wrapper device 200 can be selected from the group of materials comprising silicone, polyurethane, synthetic rubber, natural rubber, polyamide yarn, and a silicone coated yarn.

In another embodiment of the wristwatch wrapper device 200 the gripping material 45 of the gripping ring 42 of the torus-shaped wristwatch wrapper 200 is configured with a pattern of discrete raised gripping surfaces wherein the pattern can be selected from any one of a design comprising a circle, a rectangle, an oval, a star shape, a heart shape, letters, numbers, dates, a logo, a moniker, name, indicia, initials, symbols, face of a wristwatch, hands of a wristwatch, a series of letters including "W", "R", "I", "S", "T", "W", "A", "T", "C", "H", "W", "R", "A", "P", "P", "E", "R" wherein the series of letters spell "WRISTWATCH WRAPPER".

In another embodiment of the present invention, the gripping material 45 of the gripping wring 42 of the torus-shaped wristwatch wrapper device 200 can be configured having a pattern of raised gripping surfaces comprising a series of raised linear lines oriented in a longitudinal direction, a lateral direction, or a circular direction.

As shown in FIGS. 5A-5B, the first flexible cuff portion 34 extends a first length in a first direction from the first piping 22 of the mounting portion 38 to the first elasticized selvage 20 of the first circumferential tubal body edge of the first open end $30^1$ of the first flexible cuff portion 34 of the tubular body 90. The second flexible cuff portion 36 extends a second length in an opposing direction from the second piping 24 of the mounting portion 38 to the second elasticized selvage 26 of the second circumferential tubal body edge of the second open end $30^2$ of the second flexible cuff portion 36 of the tubular body 90 of the wristwatch wrapper device 200. The mounting portion 38 includes a third length measured from the first piping 22 to the second piping 24 of the mounting portion 38 of the tubular body 90 of the wristwatch wrapper device 200. The first length of the first flexible cuff portion 34 is equal to the second length of the second flexible cuff portion 36, and the third length of the mounting portion 38 is equal to the first length of the first flexible cuff portion 34 and the second length of the second flexible cuff portion 36.

FIG. 5E, with reference to FIG. 5G shows the wristwatch wrapper device 200 in the torus-shaped wristwatch wrapper configuration having a gripping ring 42. The first flexible cuff portion 34 is configured to extend laterally in a first direction to enclose the wristwatch 28 being supported on the mounting portion 38, and the second flexible cuff portion 36 is configured to extend laterally in an opposing direction to envelop the first flexible cuff portion 34 that is wrapped around the wristwatch 28 which is mounted on the mounting portion 38 of the tubular body 90 of the wristwatch wrapper device 200.

The wristwatch wrapper device 200 is maneuvered in the following manner to envelop the wristwatch 28 being mounted or supported on the mounting portion 38 of the tubular body 90. The first flexible cuff portion 34 is turned inside-out wherein the user can turn the first flexible cuff portion 34 inside-out interfaced with the second flexible cuff portion 36 such that the first open end $30^1$ of the tubular body 90 is oriented facing the second open end $30^2$ of the tubular body 90. The first flexible cuff portion 34 is extended laterally in a first direction over the wristwatch 28 which is mounted on the mounting portion 38 and envelops the wristwatch 28 whereby the first elasticized selvage 20 is extended towards the second flexible cuff portion 36 and the user folds the first flexible cuff portion 34 inside-out at the first piping 22. Consequential to the first flexible cuff portion 34 being folded in-side out to envelop the wristwatch 28, the crystal of wristwatch 28 and the proximate portion of the bracelet 31 of the wristwatch 28 is visible therethrough the first viewing window 50 of the first flexible cuff portion 34. In addition, consequential to the first flexible cuff portion 34 being folded inside-out, concomitantly, the interior lining material 13 that is coplanar with the posterior material layer 14 of the first flexible cuff portion 34 of the tubular body 90 is turned inside-out, the housing 40 containing the transferable smart device 41 is revealed.

Subsequently, the second flexible cuff portion 36 being configured to extend laterally in an opposing direction being turned inside-out from the second elasticized selvage 26 and folded at the second piping 24 the second flexible cuff portion 36 is wrapped around the first flexible cuff portion 34 such that the second viewing 56 is aligned coplanar with the first viewing window 50 whereby the wristwatch 28 is visible therethrough the second viewing window 56 and the first viewing window 50, as shown in FIG. 5E.

Consequently, as shown in FIG. 5F, with reference to FIGS. 5B and 5G, the fourth interior lining material portion $13^4$ congruent to the second portion of the posterior material layer $14^2$ of the second flexible cuff portion 36, consequently, being upturned and reversed in-side out and being wrapped over the first flexible cuff portion 34 reveals the third viewing window 62, as shown in FIG. 5F having the identification card 68 inserted therein.

The third viewing window 62 is configured to slidably receive and contain the identification card 68 therein. Referring to FIGS. 5B, 5D and 5F, the third viewing window 62 is integrated into the fourth interior lining material portion $13^4$ of the interior lining material 13 that is coplanar to the second portion of the posterior lining material $14^2$. In this manner, when the second flexible cuff portion 36 is upturned and reversed in-side out the third viewing window 62 is exposed. In this manner, the user has easy access to the identification cards 68 contained therein the third viewing window 62.

FIGS. 5E-5G shows the second cuff portion 36 being wrapped around the first flexible cuff portion 34 concomitantly provides a second circumambient layer enveloping the wristwatch 28 mounted on the mounting portion 38 of the tubular body 90 of the wristwatch wrapper device 200 whereby the wristwatch wrapper device 200 is folded into a torus-shaped wristwatch wrapper device 200 wherein the torus-shaped wristwatch wrapper device 200 is configured with an anterior facing cover provided by the second viewing window 56, as shown in FIG. 5E, and a posterior facing cover provided by the third viewing window 62, as shown in FIG. 5F, as discussed in more detail, below. The torus-shaped wristwatch wrapping device 200 circumscribes a gripping ring 42, as shown in FIG. 5G. The user can pass the user's fingers therethrough the gripping ring 42 whereby the user can hold the torus-shaped wristwatch wrapper device 200 having the wristwatch 28 secured and safeguarded therein the torus-shaped wristwatch wrapper device 200. The first flexible cuff portion 34, when the wristwatch wrapper device 200 is in the torus-shaped configuration, is secured abound the wristwatch 28 mounted on the mounting portion 38 by the first elasticized selvage 20 of the first flexible cuff portion 34. The first elasticized selvage 20 forms an elasticized seal around the wristwatch 28 being supported on the mounting portion 38 of the wristwatch wrapper device 200. The second flexible cuff portion 36, when the wristwatch wrapper 200 is in the torus-shaped configuration, is secured around the first flexible cuff portion 34 by the second elasticized selvage 26 as shown in FIGS. 5E and 5F.

With a close inspection of FIG. 5E, the front perspective view of the wristwatch wrapper device 200 in the torus-shaped wristwatch wrapper device 200 configuration is shown. The first interior lining material portion $13^1$ of the interior lining material 13 that is coplanar with the first portion of the anterior material layer $12^1$ of the first flexible cuff portion 34 provides an anterior facing material layer of a first circumambient layer wrapped around the wristwatch 28, and a second interior lining material portion $13^2$ of the interior lining material 13 of the tubular body 90 that is coplanar with the first portion of the posterior material layer $14^1$ of the first flexible cuff portion provides a posterior facing material layer of the first circumambient layer wrapped around the wristwatch 28. The first circumambient layer provided by the first flexible cuff portion 34 is secured around the wristwatch 28 by the first elasticized selvage 20. Subsequently, wherein when the second flexible cuff portion 36 of the tubular body 90 of the wristwatch wrapper device 200 is manipulated upturned in-side-out and wrapped around the first flexible cuff portion 34 of the first circumambient layer a second exterior surface of a second portion of the anterior material layer $12^2$ of the second flexible cuff portion 36 comes in contact with the anterior facing surface of the first circumambient layer wrapped around the wristwatch 28, and concomitantly a second exterior surface of a second portion of the posterior material layer $14^2$ of the second flexible cuff portion 36 comes in contact with the posterior facing surface of the first circumambient layer.

Consequentially, a third interior lining material portion $13^3$ of the interior lining material 13 that is coplanar with the second portion of the anterior material layer $12^2$ of the second flexible cuff portion 36 provides an anterior facing wristwatch wrapper material layer of the second circumambient layer, and a fourth interior lining material portion $13^4$ of the interior lining material 13 that is coplanar with the second portion of the posterior material layer $14^2$ of the second flexible cuff portion 36 concomitantly provides a posterior facing wristwatch wrapper material layer of the second circumambient layer wrapped around the wristwatch 28 secured by the second elasticized selvage 26.

As discussed above, the torus-shaped wristwatch wrapper device 200 is formed circumscribing a gripping ring 42 through which a user's fingers passes, wherein the gripping ring 42 is bonded with a gripping material 45.

As shown in FIGS. 5E and 5F, the gripping ring 42 includes a fifth interior lining material portion $13^5$ of the interior lining material 13 that is coplanar with the anterior face $38^1$ of the mounting portion 38 and, additionally, includes a sixth interior lining material portion $13^1$ of the interior lining material 13 that is coplanar with the posterior face $38^2$ of the mounting portion 38.

FIG. 5G, with reference to FIG. 5E, shows a perspective view of a first side of the formed torus-shaped wristwatch wrapper device 200 having a gripping ring 42, as a result of wrapping the first flexible cuff portion 34 around the wristwatch 28 being mounted on the mounting portion 38 of the tubular body 90, and the subsequent wrapping of the second flexible cuff portion 36 being wrapped around the first flexible cuff portion 34 and having the wristwatch 28 secured therein by way of an elasticized seal provided by the first elasticized selvage 20 of the first flexible cuff portion 34 and the second elasticized selvage 26 of the second flexible cuff portion 36. The torus-shaped wristwatch wrapper device 200 is wrapped around the wristwatch 28 with the anterior face $38^1$ of the mounting portion 38 configured to comport with a case body 29 of the wristwatch 28 and a proximate portion of the bracelet 31 of the wristwatch 28. The anterior face $38^1$ of the mounting portion 38 includes the anterior gripping application 18 so that the wristwatch 28 is prevented from slipping. The crystal 33 or face of the wristwatch 28 can be viewed through the second viewing window 56 which is aligned over the first viewing window 50. The proximate portion of the bracelet 31, strap, or band, of the wristwatch 28 can, also, be viewed through the second viewing window 56 being aligned over the first viewing window 50.

In this manner, the second viewing window 56, as shown in FIG. 5G, with reference to FIG. 5D, provides the anterior facing cover of the torus-shaped wristwatch wrapper device 200. FIG. 5B shows the rear perspective view of the tubular body of FIG. 5G shows the third viewing window 62 is shown including the identification card 68 that can be slidable therein the third viewing window 62. In this manner, the third viewing window 62 provides the posterior facing cover of the torus-shaped wristwatch wrapper device 200.

FIG. 5G shows the torus-shaped wristwatch wrapper device 200 includes the gripping ring 42 includes the gripping material 45. The gripping ring 42 includes the gripping material 45 to prevent the user's fingers from slipping away from the gripping ring 42. The gripping material 45 can include a silicone material, a non-slip material, a neoprene material, elasticized threads, yarns, or filaments, having a lazar cut pattern, or an imprinted design or a bonded design thereon.

The gripping material 45 can be configured using elasticized threads, yarns, or filaments knitted or weaved into the gripping ring 42 in a raised netting pattern, as shown in FIG. 5G, applied by way of the circular knitting machine enabling the gripping ring 42 to be devoid of adhesives in the application thereof. In another exemplary embodiment, the gripping material 45 can be permanently applied to the gripping ring 42 by way of heat, or bonding. In another exemplary embodiment, the gripping material 45 can be flush with the exterior surface of the gripping ring 42 of the torus-shaped wristwatch wrapper device 200.

The gripping material 45 of the gripping ring 42 can be configured in a variety of patterns including, comprises a pattern of discrete raised gripping surfaces wherein the pattern can be selected from any one of a shape comprising a circle, a rectangle, an oval, a star shape, a heart shape, letters, numbers, dates, a logo, a vanity moniker, name, indicia, vanity initials, face of a watch, hands of a watch, a logo, a trademark logo of the manufacturer of the wristwatch 28. In addition, the gripping material 45 of the gripping ring 42 can be configured with a pattern of discrete raised gripping surfaces wherein the pattern comprises letters spelling "W", "R", "I", "S", "T", "W", "A", "T", "C", "H", "W", "R", "A", "P", "P", "E", "R". The gripping material 45 of the gripping ring 42 can be configured with a pattern of discrete raised gripping surfaces wherein the pattern comprises a series of raised linear lines oriented in a longitudinal direction, a lateral direction, or a circular direction.

The materials used in constructing or forming the wristwatch wrapper device 10, the wristwatch wrapper device 100 and the wristwatch wrapper device 200 will be discussed, herein, below. Each of the elements of the wristwatch wrapper device 10, the wristwatch wrapper device 100 and the wristwatch wrapper device 200 will be described with reference to each of the numerals identified with the elements where the numerals of the elements are the same.

In one exemplary embodiment, the anterior material layer 12, the posterior material layer 14 and the interior lining material 13, the one or more transferable mounting panels $16^{1+N}$ can be integrated into a seamless tubular body 90 that is formed using a plurality of warp yarns and a plurality of weft yarns circumferentially seamlessly knitted together integrated with elastic yarns, elastic threads, or elastic filaments, by way of a circular knitting machine, as discussed in more detail, below. The elastic yarns, elastic threads, or elastic filaments, are utilized to provide elasticity to the first flexible cuff portion 34 and the second flexible cuff portion 36 of the tubular body. The plurality of warp yarns and the plurality of weft yarns can be fed into the circular sewing machine, including any one of the circular knitting machine, the circular weaving machine, the circular hosiery machine. Each of the circular sewing machines, circular knitting machine, the circular weaving machine, the circular hosiery machine, include computer software that is programmable by the user for a particular pattern of warp yarns, weft yarns, elasticized yarns, elasticized threads, elasticized filaments, to form the anterior material layer 12, the posterior material layer 14, the interior lining material 13, the first elasticized selvage 20, the second elasticized selvage 26, the first piping 22, the second piping 24, the one or more transferable mounting panels $\mathbf{16}^{1+N}$.

The tubular body 90 can be seamlessly formed as a single unit tubular body 90 implementing the plurality of warp yarns and the plurality of weft yarns wherein the plurality of warp yarns each includes an elastic warp filament and a non-elastic warp filament, and the plurality of weft yarns each includes an elastic weft filament and a non-elastic weft filament. The plurality of warp yarns and the plurality of weft yarns are actuated with a circular sewing machine having a cylinder of at least 4 inches in diameter, wherein the circular sewing machines is selected from the group comprising a circular knitting machine, a circular weaving machine, and a circular hosiery sewing machine.

The circular knitting machines or circular weaving machines can be provided by Santoni circular knitting machines, Santoni SpA, Via Carlo Fenzi, 14-25135 Brescia, Italy, available at Circular electronic knitting machines seamless wear, Santoni. Also, the circular knitting machines are available from the following companies: Vanguard Pailung, based in Monroe, N.C., a division of Pailung Machinery Mill, at Innovations In Knitting Textile World; Sintelli, Machine Manufacturer Sintelli (xdknitmachinery.com); Mayer & Cie Circular Knitting Machines; Shima Seiki MFG., LTD.; Terrot GmbH; and Stoll by Karl Meyer. The circular sewing machine may be selected from a Santoni, a Vanguard Pailung KDFPS-HW Knitted 3-Layer High Pile circular knitting or weaving machine; Sintelli, at Circular Knitting Machine Manufacturer Sintelli (xdknitmachinerv-.com); Mayer & Cie Circular Knitting Machines; Shima Seiki MFG., LTD.; Terrot GmbH; and Stoll by Karl Meyer.

The Vanguard Pailung provides the KDFPS-HW Knitted 3-Layer High Pile machine and the KRTDC J6 Segue Jacquard machine. The KDFPS-HW knitted 3-layer high-pile technology, simultaneously, knits three or more layers of material, for example, the anterior material layer 12, the posterior material layer 14, the inner lining material 13, therebetween, and, separately, the one or more transferable mounting panels $\mathbf{13}^{1+N}$ on a single circular knitting machine. The Vanguard Pailung is equipped with state-of-the-art technology that releases yarn, thread, or filaments, including elasticized yarn, elasticized thread, or elasticized filaments, as needed, for the wristwatch wrapper device 10, the wristwatch wrapper device 100, and the wristwatch wrapper device 200, rather than all at once. A circular knitting machine KRTDCJ6 can knit up to eight different types, including different colors of yarns, threads, or filaments, including different types of elasticized yarns, elasticized threads, or elasticized filaments in varying colors, materials, and denier values, segue jacquard knits with vibrant patterns, and create knits with embossed patterns.

Therefore, when forming the wristwatch wrapper devices 10, 100, 200, the anterior material layer 12, the posterior material layer 14, the interior lining material 13 can be formed using a variety of different types and colors of yarns, threads, filaments, and colors of yarns, threads, filaments, including elasticized yarns, threads, and filaments that are fed into anyone of the circular knitting machines, including the circular knitting machine, the circular weaving machine, the circular hosiery machine. The operator of the warp knitting machine can download a computer generated sewing pattern to anyone of the circular knitting machine, the circular weaving machine, the circular hosiery machine to form a seamless tubular body 90 of the wristwatch wrapper devices 10, 100, 200.

The Santoni circular knitting machine, can produce a wristwatch wrapper device 10, 100, 200, and the one or more transferable mounting panels $\mathbf{16}^{1+N}$ where the Santoni S.p.A. is the well-known circular knitting machine to produce seamless tubular apparel, socks, pantyhose, sports ware, athletic ware, implementing seamless technology in the manufacture thereof. Santoni is an Italian leader in the production of seamless apparel, including socks and pantyhose machines seamless technology, especially the Santonin TOP2 series of machines. The circular knitting machine is ideally suited for use of nylon yarns, threads, or filaments, and elasticized yarns, elasticized threads, or elasticized filaments, which can be implemented in the making of the embodiments of the wristwatch wrapper device 10, the wristwatch wrapper device 100, and the wristwatch wrapper device 200 because of the available variants of yarns, threads, or filaments, including their fineness, luster, filament shape, elasticity and high stretch and recovery which can be fed into the circular knitting machines to provide the anterior material layer 12, the posterior material layer 14, the interior lining material 13 of the tubular body 90 of each of the wristwatch wrapper devices 10, 100, 200.

Santoni's technology is based on knitting tubular fabrics without seams and can apply different knit stitches to incorporate pre-shaped structures, which limits costs including labor, waste, fabric stocks, and energy—things associated with the alternative cut-and-sew manufacturing method. A Santoni circular knitting machine that can be used to form the tubular body 90 of each of the wristwatch wrapper devices 10, 100, 200 can be a high-productivity eight feed single jersey electronic circular knitting machine with two needle-by-needle selections on feeds with 3 technical ways—configuration with 16 actuators. With the high-productivity eight feed single jersey electronic circular knitting machine the anterior material layer 12, the posterior material layer 14, the interior lining material 13, and the one or more transferable mounting panels $\mathbf{16}^{1+N}$, of each of the wristwatch wrapper devices 10, 100, 200, can be integrated with a knit floated plating design, and inlaid elastic yarn in a variety of patterns and designs, including the registered trademark plus design of the manufacturer, or the registered trademark plus design of the user or owner of the wristwatch 28.

The Santoni system enables the knitting of eight (8) feed patterns with high definition and extremely sharp color in production of the seamless tubular body 90 of each of the wristwatch wrapper devices 10, 100, 200. The Santoni's XT circular knitting machine has intarsia technology for efficient production including single-cylinder intarsia electronic knitting machine with four reciprocating feeds and two selection points—three technical ways—per feed and per rotation sense for the production of intarsia products with breathable mesh areas with cushioning and/or transfer stitch areas knitted in sculpted fabrics. The machine knitting head is equipped with cams, as well as a special chain linking system, which allows for preselected needles to be driven to the stitch cam for knitting the anterior material layer 12 and seamlessly knitting the anterior material layer 12 integrated into the posterior material layer 14 and seamlessly integrated into the interior lining material 13 of the tubular body 90 of each of the wristwatch wrapper devices 10, 100, 200. In addition, the Santoni has circular knitting machines to knit 4-feed high-definition colored logo patterns on the wristwatch wrapper device 10, as well as 3D patterns on the same course as intarsia, sculpted fabric and transfer stitch areas.

Another means to provide a seamless wristwatch wrapper device 10, 100, 200 can be provide on a weft knitting sphere circular knitting machine which allows knitting of the anterior material layer 12, the posterior material layer 14 and the interior lining material 13, and the one or more transferable mounting panels $\mathbf{13}^{1}$N. The Mayer & Cie Spinit 3.0, from Germany-based Terrot GmbH and Pailung Machinery Mill, is a weft knitting spere circular knitting machine. The Mayer & Cie's Spinit 3.0 processes polyester, is capable of a high working speed allowing for a combined spinning and knitting machine to make the seamless wristwatch wrapper device 10, 100, 200. The 3-in-1 Spinit weft knitting machine combines three processes—spinning, knitting and cleaning—in one machine and thereby saving time, space and energy. The weft knitting sphere circular knitting machine can produce a spin knit fabric for the anterior material layer 12, the posterior material layer 14, and the interior lining material 13 of the wristwatch wrapper devices, 10, 100, 200 in a unified seamless tubular body 90. In addition, the 3-in-1 Spinit weft knitting machine can produce the one or more transferable mounting panels $\mathbf{16}^{1+N}$, of the wristwatch wrapper device 10, in a seamless band shape.

The wristwatch wrapper devices 10, 100, 200 can be designed with thick and thin yarns allowing for different thickness and thinness for each of the anterior fabric layer 12 and the posterior material layer 14 and the interior lining material 13 and, further, the first elasticized selvage 20 and the second elasticized selvage 26 of the first flexible cuff portion 34 and the second flexible cuff portion 36 and the mounting portion 38.

The wristwatch wrapper device 10, 100, 200, can, also, be made by means of a warp knitting machine provided by Karl Mayer Textilmaschinenfabrik GmbH. The Textilmaschinefabrik GmbH warp knitting machine offers a first three-bar HKS model with electronic guide bar control which allows for immediate pattern changes in the anterior material layer 12, the posterior material layer 14, and the interior lining material 13, without one or more mechanical modifications, and no delay in production.

With use of the Karl Mayer HKS 3-M-ON warp knitting machine can run to a variety of patterns. Germany-based Karl Mayer Textilmaschinenfabrik GmbH allows a warp knitting machine to make the wristwatch wrapper devices, 10, 100, 200 which allows for immediate pattern changes without any mechanical modification and no delay in production. The operator only needs to download the required information software including a pattern from a secured cloud, to the anyone of the circular knitting machine, the circular weaving machine, and the circular hosiery machine, and a new fabric design and dimensions of the tubular body 90 of the wristwatch wrapper devices 10, 100, 200, can be immediately produced. In times of rapidly changing market requirements, it is an asset to be able to react quickly to such demands and be able to access a library of designs.

The wristwatch wrapper devices, 10, 100, 200, which include the anterior material portion 12, the posterior material portion 14, the interior lining material 13, the first elasticized selvage 20, the second elasticized selvage 26, the first piping 22, the second piping 24, and the one or more transferable mounting panels $\mathbf{16}^{1+N}$, can each be formed separately and formed joined together with as a knitted material, woven material, made from natural or synthetic fibers that are integrally seamlessly formed and joined together by a circular sewing machine selected from the group of circular sewing machines comprising a circular knitting machine, circular weaving machine, and a hosiery sewing machine, as discussed above.

The wristwatch wrapper devices 10, 100, 200, which include the anterior material layer 12, the posterior material layer 14 and the interior lining material 13 of the tubular body 90 can be integrally seamlessly formed and joined together on any one of the circular sewing machines, including the circular knitting machine, the circular weaving machine, the circular hosiery machine, having a cylinder of at least 4 inches in diameter around which any one of circular sewing, circular knitting or circular weaving is performed. Similarly, the one or more transferable mounting panels $\mathbf{16}^{1+N}$ of the wristwatch wrapper device 10, can be formed in the band having an annular configuration by way of any one of the circular sewing machines, including the circular knitting machine, the circular weaving machine, the circular hosiery machine, having a cylinder of at least 4 inches in diameter around which any one of circular sewing, circular knitting or circular weaving is performed.

In this exemplary embodiment the wristwatch wrapper devices 10, 100, 200 which include the anterior material layer 12, the posterior material layer 14, the interior lining material 13, the first elasticized selvage 20, the second elasticized selvage 26, the first piping 22 and the second piping 24, and the one or more transferable mounting panels $\mathbf{16}^{1+N}$ of wristwatch wrapper device 10, can be made with a plurality of warp threads, yarns, or filaments, and a plurality of weft threads, yarns, or filaments, that are woven together. The warp threads, yarns, or filaments, include one or more elastic warp filaments and one or more non-elastic warp filaments. Similarly, the weft threads, yarns, or filaments, can include one or more elastic weft filaments and one or more non-elastic weft filaments. The respective materials of the yarns, threads, or filaments are selected such that the materials of the anterior material layer 12, the posterior material layer 14, the one or more transferable mounting portion panels $\mathbf{16}^{1+N}$, the first elastic selvage 20, the second elastic selvage 26, the first piping 22, the second piping 24, are formed with a high elastic stretchability in one or both of a weft direction and a warp direction. Also, at least one of the elastic warp filaments, the non-elastic warp filaments, the elastic weft filaments, and the non-elastic weft filaments includes (e.g., are formed of, are coated with, are treated with) at least one hydrophobic material. The inclusion of the hydrophobic material increases the hydrophobicity of the textile, and thus increases the ability of the textile to repel water during wet conditions.

As known in the art, the warp threads or warp yarns and the weft threads or the weft yarns are the two basic components used in knitting and weaving to turn the thread or yarn into a material or fabric. The lengthwise or longitudinal warp yarns are held stationary in tension on the frame or loom of the circular knitting machine or circular weaving machine while the transverse weft threads or yarns (sometimes woof) are drawn through and inserted over and under the warp threads or yarns. A single thread of the weft crossing the warp is called a pick. Terms vary (for instance, in North America, the weft is sometimes referred to as the fill or the filling yarn). Each individual warp thread in a fabric is called a warp end or end.

The warp yarns or threads are the surface threads or ends which are stretched vertically on the loom of the circular knitting machine or the circular weaving machine and are therefore made of stronger, coarser fibers than the weft threads. The term "warp" comes from the Old Norse word "varp", meaning "the cast of a net". The warp threads or yarns are the lengthwise threads of the fabric loom and are held stationary to provide support and structure as the weft threads or weft yarns are knitted or weaved though in a horizontal direction by way of the circular knitting machine or circular weaving machine. The warp threads lie parallel with the first elasticized selvage 20 and the second elasticized selvage 26 of the tubular body 90 of the wristwatch wrapper devices, 10, 100, 200. The warp threads are the support network for the weft threads or weft yarns.

The weft yarns are the weft or filling threads or yarns that are created by the horizontal threads or yarns that are passed through the warp threads via the shuttle of the circular knitting machine or the circular weaving machine during the knitting process or the weaving process. The term "weft" is derived from the Old English word "wefan" meaning "to weave".

The anterior material layer 12 the posterior material layer 14 and the interior lining material 13 can be seamlessly knitted or woven together to form the tubular body 90 of the wristwatch wrapper devices 10, 100, 200 by way of any one of the circular knitting machine, a weaving knitting machine, a circular hosiery machine, and programmed through a user interface incorporated with any one of the circular knitting machine, the circular weaving machine, or the circular hosiery machine, which can include a predetermined number of warp yarn threads per inch and/or a predetermined number of weft yarn threads per inch. In some embodiments, for example, the number of warp yarn threads per inch, and/or the number of weft yarns per inch, can be between 130 and 200 threads per inch; between 130 and 180 threads per inch; or between 150 and 250 threads per inch; or threads between 250 threads and 350 threads per inch. Each of the anterior material layer 12 and the posterior material layer 14 can have between 150 threads and 250 threads per inch, and the interior lining material 13 can have between 250 threads to 350 threads per inch. The anterior material layer 12 and the posterior material layer 14 can be configured with a surface density (e.g., a mass per square meter) that can vary depending on one or more design considerations and the amount of flexibility.

Denier is a unit for measuring the linear mass density of filament yarns (man-made fiber). Polyester and Nylon yarn quality (fineness) is measured by the unit of Denier (D). It falls under the direct yarn count system. Denier is defined as the mass in grams for every 9000 m of yarn. The rule recites Tex=Denier/9 such that 150 Denier filament yarn is equivalent to 16 Tex and 300 Denier filament yarn is equivalent to 33 Tex.

In an exemplary embodiment of the wristwatch wrapper devices 10, 100, 200, the linear density of the warp elastic threads, and the weft elastic threads, yarns, or filaments, can be anywhere from 20 denier-600 denier to form the anterior material layer 12, the posterior material layer 14, and the interior lining material 13, and the one or more transferable mounting panels $\mathbf{16}^{1+N}$ of the embodiment of the present invention in the wristwatch wrapper device 10. In this exemplary embodiment, the mounting portion 38 of the tubular body 90 can include warp elastic threads and weft elastic threads that are configured with a higher denier than the warp elastic threads and the weft elastic threads that are implemented in the anterior material layer 12, the posterior material layer 14, the interior lining material 13, and the one or more transferable mounting panels $\mathbf{16}^{1+N}$. The content of the elastomer in the fabric can be, for example, from about 30% to about 85%. The non-elastic threads can be formed of a variety of materials, including, but not limited to: nylon, polyester, wool, acrylic, and/or regenerative fiber such as rayon, acetate, and/or cellulosic fiber like cotton, or a combination of any of the above.

In an exemplary embodiment of the wristwatch wrapper devices 10, 100, 200, the anterior material layer 12, the posterior material layer 14, and the interior lining material 13 can include warp yarns and/or the weft yarns that are texturized using one or more known texturizing techniques (e.g., draw texturizing, air texturizing). Such texturing can be advantageous in that it can provide the anterior material layer 12, the posterior material layer 14 and the interior lining material 13 with a soft surface. Here, and when used herein the disclosure, the soft surface means that the surface is not coarse and does not include a rough surface and is flexible.

In addition, the anterior material layer 12, the posterior material layer 14 and the interior lining material 13, of the wristwatch wrapper devices 10, 100, 200, can be made with a mixture of elastic warp filaments, elastic weft filaments, and non-elastic warp filaments and non-elastic weft filaments. The elastic warp filaments and the elastic weft filaments can be made of elastic materials. Acceptable materials for the elastic warp filaments and the elastic weft filaments include, but are not limited to, an elastane, elasticized polyurethane, spandex, or LYCRA®. The non-elastic warp filaments and the non-elastic weft filaments can be made of a variety of different non-elastic threads or yarns. In some embodiments, the non-elastic filaments and/or non-elastic weft filaments include at least one filament made of a synthetic material, and/or at least one filament made of a natural material.

In an exemplary embodiment, the anterior material layer 12 and the posterior material layer 14 and the interior lining material 13 and the mounting portion 38 can include elastic warp filaments and elastic weft filaments in various percentages when formed by the circular knitting machine or the circular weaving machine. In an exemplary embodiment, the anterior material layer 12, the posterior material layer 14, and the interior lining material 13 and the mounting portion 38 which are knitted on the circular knitting machine or circular weaving machine including warp threads, yarns, or filaments include elastane, elasticized polyurethane, spandex, or LYCRA®, and the weft threads, yarns, or filaments, include non-elastic warp filaments made of polyester, nylon, silk, polyamide, a polypropylene, wool, rayon, acrylic, regenerative fiber, acetate, cellulose fiber, cotton, or combination thereof.

In another exemplary embodiment, the first portion of the anterior material layer $\mathbf{12}^1$ and the first portion of the first posterior material layer $\mathbf{14}^1$ of the first flexible cuff portion 34, and the second portion of the anterior material layer $\mathbf{12}^2$ and the second portion of the posterior material layer $\mathbf{14}^2$ can be knitted or weaved by way of the circular knitting machine, the circular weaving machine, the circular hosiery machine, with warp threads, yarns, or filaments including elastane, elasticized polyurethane, spandex, or LYCRA®, and the mounting portion 38 can be knitted or weaved with the warp threads, yarns, or filaments and the weft threads, yarns or filaments with non-elastic weft threads, yarns or filaments. In this manner, the first flexible cuff portion 34 and the second flexible cuff portion 36 are elasticized and enabled to be upturned and reversed inside-out and stretch over the wristwatch 28 which is mounted on the mounting portion 38. The mounting portion 38 being knitted or weaved with non-elastic warp and weft threads, knits, or filaments provides a stable non-elasticized mounting portion to support the wristwatch 28 thereon. The anterior material layer 12, the posterior material layer 14, and the interior lining material 13 is knitted or weaved such that the elastic threads, yarns, or filaments are hidden within the knitting construction of the anterior material layer 12, the posterior material layer 14, and the interior lining material 13 and not exposed to the exterior. In contrast, the mounting portion 38 and the one or more transferable mounting panels $16^{1+N}$ can be knitted or weaved to form a fabric that the elastomeric threads, yarns, or filaments are exposed to an exposed side of the fabric such that elastic threads, yarns, or filaments are exposed.

In other embodiments, the non-elastic warp threads, yarns, or filaments and/or the non-elastic weft threads, yarns, or filaments, are all made of a synthetic material. Acceptable synthetic materials for the non-elastic warp filaments and the non-elastic weft filaments include, but are not limited to, a polyester, a polyamide (e.g., nylon), a polypropylene, denim. Acceptable natural materials include, but are not limited to, abaca, bamboo, cotton, coir, hemp, kapok, linen, ramie, wool, silk. Kapok is a white fiber that comes from the seeds of the tree *Ceiba pentandra*. Kapok is known as a "silk cotton" because of its gloss that resembles silk. Kapok is naturally resistant to moisture.

In addition, the anterior material layer 12, the posterior material layer 14, the interior lining material 13, the first elasticized selvage 20, the second elasticized selvage 26, the first piping 22, the second piping 24, can be made with thread, yarn, or filaments, that can be coated or treated with a hydrophobic material before the warp threads, yarns, or filaments, can be coated with a hydrophobic material before or after the warp threads, yarns, or filaments and the weft threads, yarns, or filaments are woven together to form the anterior material layer 12, the posterior material layer 14, the interior material layer 13, the first elasticized selvage 20, the second elasticized selvage 26, the first piping 22, the second piping 24 in a seamless tubular body 90 of the wristwatch wrapper devices 10, 100, 200.

In another exemplary embodiment of the present invention, the wristwatch wrapper devices 10, 100, 200 include the anterior material layer 12, the posterior material layer 14, the interior lining material 13, and the one or more transferable mounting panels $16^{1+N}$ of the wristwatch wrapper device of embodiment 10, can be made in a textile or fabric including a double reverse plated loop, double three-thread jersey, interlock stitched stretch jersey, layered computerized jersey, double jersey jacquard pattern, computerized color auto-striper jacquard knit.

In another embodiment of the wristwatch wrapper devices 10, 100, 200, the anterior material layer 12, the posterior material layer 14, the interior lining material 13, the first elasticized selvage 20, the second elasticized selvage 26, the first piping 22, the second piping 24, the one or more transferable mounting panel $16^{1+N}$, can be treated with a hydrophobic durable water repellent. The hydrophobic durable water repellent is a coating added to make each of the anterior material layer 12, the posterior material layer 14, the interior lining material 13 and the first elasticized selvage 20, the second elasticized selvage 26, the first piping 22, the second piping 24, the or more transferable mounting panel $16^{1+N}$, whereby the hydrophobic durable water repellant provides water-resistance to the wristwatch wrapper devices 10, 100, and 200 such that the wristwatch wrappers 10, 100, 200, are water proofed.

The application of the hydrophobic durable water repellant on each of the anterior material layer 12, the posterior material layer 14, the interior lining material 13 and the first elasticized selvage 20, the second elasticized selvage 26, the first piping 22, the second piping 24, the or more transferable mounting panel $16^{1+N}$, can be performed by spray coating, dip coating, foam coating, blade coating, exhaustion, plasma enhanced chemical vapor deposition, screen printing, ink jet printing, curing, a solution of a the durable water repellant onto a surface of each of the anterior material layer 12, the posterior material layer 14, the interior lining material 13 and the first elasticized selvage 20, the second elasticized selvage 26, the first piping 22, the second piping 24 of the formed tubular body 90, and the more transferable mounting panel $16^{1+N}$, of the wristwatch wrapper devices 10, 100, 200. The durable water repellant can include a variety of chemicals or combinations of chemicals, including, for example, fluorinated polymers, polyurethanes, silicones, paraffins, stearic acid-melamine, and dendrimers.

In addition, the anterior material layer 12, the posterior material layer 14, the interior lining material 13 and the first elasticized selvage 20, the second elasticized selvage 26, the first piping 22, the second piping 24 of the formed tubular body 90, and the one or more transferable mounting panels $16^{1+N}$, as a unit of the wristwatch wrapper devices, 10, 100, 200, can be treated to provide a water repellant layer by way of vacuum vapor deposition of a thin layer with high light transmissibility of a oleophobic or oil repellant material. The oleophobic or oil repellant material can be a sol-gel that contains fluorinated functional groups and/or monomers including a fluoropolymer-based solids and other non-polar polymers which create a nanostructure on the surface of the anterior material layer 12, the posterior material layer 14, the interior lining material 13, the first flexible selvage 20, the second flexible selvage 26, the first piping 22, the second piping 24, and the one or more mounting portion panels 16.

The hydrophobicity of the anterior material layer 12, the posterior material layer 14, the interior lining material 13 and the first elasticized selvage 20, the second elasticized selvage 26, the first piping 22, the second piping 24 or the formed tubular body 90 as a unit of the wristwatch wrapper devices, 10, 100, 200, can be tested by a spray test according to the American Association of Textile Chemists and Colorists (AATCC) having an AATCC 22 standard. In an exemplary embodiment, the anterior material layer 12, the posterior material layer 14, the interior lining material 13 and the first elasticized selvage 20, the second elasticized selvage 26, the first piping 22, the second piping 24 or the formed tubular body 90 as a unit of the wristwatch wrapper devices, 10, 100, 200, and the one or more transferable mounting panels $16^{1+N}$, can be sprayed and treated having a characteristic score of at least 80 after 50 sprays of the oleophobic or oil repellant material to provide the water repellant layer. In an exemplary embodiment of the present invention, the anterior material layer 12, the posterior material layer 14, the interior lining material 13 and the first elasticized selvage 20, the second elasticized selvage 26, the first piping 22, the second piping 24 or the formed tubular body 90 as a unit of the wristwatch wrapper devices, 10, 100, 200, has a contact angle for water that is at least 100°, and/or the textile has an oil repellency level of at least 3 according to the ISO 14419 standard of the International Organization for Standardization (ISO).

The wristwatch wrapper devices, 10, 100, 200, wherein the anterior material portion 12, the posterior material portion 14, the interior lining material 13, the first elasticized selvage 20, the second elasticized selvage 26, the first piping 22, the second piping 24, the one or more mounting panel layers $16^{1+N}$ can be made with a nonwoven material made from natural or synthetic fibers, a liquid impermeable stretchable textile composite or fabric, neoprene material configured in neoprene panels, a scuba fabric, a scuba crepe fabric, a 400 denier high density coated pack-cloth nylon fabric panel. Neoprene is a thick synthetic flexible rubber and fabric hybrid material that is durable, flexible, bendable, waterproof, and ultraviolet (U.V.) resistant. The scuba fabric is a type of double knit made from polyester and spandex, with a very fine gauge thread, and smooth texture. The scuba fabric is flexible, springy, and is characterized with a very smooth fabric surface.

In another embodiment of the present invention, the wristwatch wrappers 10, 100, 200, the anterior material layer 12, the posterior material layer 14, the interior lining material 13, the first elasticized selvage 20, the second elasticized selvage 26, the first piping 22, the second piping 24, of each of the wristwatch wrapper devices, 10, 100, 200, and the one or more transferable mounting panels $\mathbf{16}^{1+N}$ can, also, be formed from a scuba crepe fabric called scuba crepe which is a lighter version of scuba, more like a traditional LYCRA® but with a crepe textured finish. The scuba crepe can be provided in layers of fabric to form the anterior material layer 12, the posterior material layer 14, the interior lining material 13, the first elasticized selvage 20, the second elasticized selvage 26, the first piping 22, the second piping 24, of each of the wristwatch wrapper devices, 10, 100, 200, and the one or more transferable mounting panels $\mathbf{16}^{1+N}$.

The tubular body 90 of each of the wristwatch wrapper devices, 10, 100, 200, can be formed by injection molding as a single unit including the anterior material layer 12, the posterior material layer 14. The one or more transferable mounting panels $\mathbf{16}^{1+N}$ can be formed as a single unit configured in an annular shape or a circular band shape by way of any one of the circular knitting machines.

The wristwatch wrapper devices 10, 100, 200, which includes the anterior material layer 12, the posterior material layer 14, the interior lining material 13, the first elasticized selvage 20, the second elasticized selvage 26, the first piping 22, the second piping 24, the one or more transferable mounting panels $\mathbf{16}^{1+N}$ of the wristwatch wrapper device 10, wherein are each formed with any one of the materials selected from the group comprising, a neoprene, polychloroprene, soft neoprene materials, soft neoprene rubber, neoprene foam, reversible neoprene, embossed neoprene, neoprene spandex, neoprene waterproof scuba material, neoprene polyester, neoprene stretch, microfiber material, microfiber polyester material, stretchable material, neoprene sponge, foam rubber, elastomer, elastic, nitrile rubber, silicone rubber, polybutadiene, polyisoprene, ethylene/vinyl acetate, polyester, polypropylene, polyethylene, polyvinyl chloride, polyimide, polyamide, polytetrafluoroethylene, polyvinyl alcohol, polyurethane, polyvinyl fluoride, and copolymers, and combinations thereof.

More particularly, the wristwatch wrapper devices 10, 100, 200, include the anterior material layer 12, the posterior material layer 14, the interior lining material 13, the one or more transferable mounting panels $\mathbf{16}^{1+N}$ of the wristwatch wrapper device 10, can be formed from a stretchable neoprene fabric including 80% polyester, and 20% spandex.

In another exemplary embodiment, any one of the wristwatch wrapper devices 10, 100, 200, which includes the anterior material layer 12, the posterior material layer 14, interior lining material 13, and the one or more transferable mounting panels $\mathbf{16}^{1+N}$ can be formed from a faux fur material. In another exemplary embodiment, any one of the wristwatch wrapper devices 10, 100, 200, includes the interior lining material 13 being formed from a quilted material including denim, faux leather.

The wristwatch wrapper devices 10, 100, 200, which includes the first elasticized selvage 20, the second elasticized selvage 26, the first piping 22, the second piping 24, can be made with a polyurethane based elastomeric material, a silicone-based elastomeric material, or a combination thereof. In another embodiment of the wristwatch devices 10, 100, 200, the first elasticized selvage 20, the second elasticized selvage 26, the first piping 22, the second piping 24, can be formed with a four-way stretch denim fabric, wherein the exterior surface of the four-way stretch denim fabric is soft and smooth.

In another exemplary embodiment of the present invention, the wristwatch wrapper devices 10, 100, 200, which include the first elasticized selvage 20, the second elasticized selvage 26, the first piping 22, the second piping 24, can be made with a four-way stretch soft leather, a four-way stretch synthetic leather, a four-way stretch pleather, a four-way stretch poromeric imitation leather, a four-way stretch koskin, a four-way stretch leatherette, a four-way stretch flexible vinyl, a four-way stretch suede.

In another exemplary embodiment of the present invention, the wristwatch wrapper devices 10, 100, 200, which include the first elasticized selvage 20, the second elasticized selvage 26, the first piping 22, the second piping 24, can be made with a reflective material selected from the group comprising, fluorescent yellow-silver stripe, orange-silver stripe, grey reflective material, yellow-green-silver stripe, orange reflective material, green reflective material, chartreuse reflective material, white reflective material.

In another embodiment of the wristwatch wrapper devices 10, the one or more transferable mounting panels $\mathbf{16}^{1+N}$ is formed with a material backed with any one of the following materials or the materials, alone, selected from the group comprising, a neoprene, polychloroprene, soft neoprene materials, soft neoprene rubber, neoprene foam, reversible neoprene, embossed neoprene, neoprene spandex, neoprene waterproof scuba material, neoprene polyester, neoprene stretch, microfiber material, microfiber polyester material, stretchable material, neoprene sponge, foam rubber, elastomer, elastic, nitrile rubber, silicone rubber, polybutadiene, polyisoprene, ethylene/vinyl acetate, polyester, polypropylene, polyethylene, polyvinyl chloride, polyimide, polyamide, polytetrafluoroethylene, polyvinyl alcohol, polyurethane, polyvinyl fluoride, and copolymers, and/or combinations thereof.

In another exemplary embodiment of each of the wristwatch wrapper devices 10, 100, 200, any one of the anterior material layer 12, the posterior material layer 14, the interior lining material 13, the one or more transferable mounting panels $\mathbf{16}^{1+N}$, the first elasticized selvage 20, the second elasticized selvage 26, the first piping 22, the second piping 24, can each be made from a four-way stretch leather material, a four-way stretch flexible vinyl material, a four-way stretch suede material, a four-way stretch artificial leather material, a four-way stretch synthetic leather material, a four-way stretch pleather material, a four-way stretch poromeric imitation leather material, a four-way stretch koskin material, a four-way stretch leatherette material, a four-way stretch carbon fiber material, a 3-way stretch air mesh material, four-way stretch air mesh material, a four-way stretch spin bound fabric, a four-way stretch spun bound hygienic fabric, a four-way stretch polyurethane material, a four-way stretch welded polyurethane film material, a four-way stretch nylon material, and a four-way stretch polyester material, and combinations thereof.

In another exemplary embodiment of each of the wristwatch wrapper devices 10, 100, 200, any one of the anterior material layer 12, the posterior material layer 14, the interior lining material 13, the one or more transferable mounting panels $\mathbf{16}^{1-N}$, the first elasticized selvage 20, the second elasticized selvage 26, the first piping 22, the second piping 24, can be formed from a material comprising silicone, polyurethane, synthetic rubber, natural rubber.

In another exemplary embodiment of each of the wristwatch wrapper devices 10, 100, 200, any one of the anterior material layer 12, the posterior material layer 14, the interior lining material 13, the one or more transferable mounting panels $\mathbf{16}^{1+N}$, the first elasticized selvage 20, the second elasticized selvage 26, the first piping 22, the second piping 24, can be made from a soft surfaced ballistic nylon.

In another exemplary embodiments, the anterior material layer 12, the posterior material layer 14, the interior lining material 13 of the wristwatch wrappers 10, 100, 200, and the one or more transferable mounting panels $\mathbf{16}^{1+N}$ can be made from organic material and/or inorganic material that provide additional functionality. The organic material and/or the inorganic materials that provide the additional functionality can include, antimicrobial materials formed from monomers and/or sol-gels with antimicrobial functional groups and/or encapsulated antimicrobial agents (including chlorinated aromatic compounds and naturally occurring antimicrobials); fire retardant materials formed from monomers and/or sol-gels with a brominated functional group; self-cleaning materials formed from monomers and/or sol gels with photo-catalytically active chemicals present (including zinc oxide, titanium dioxide, tungsten dioxide and other metal oxides); and ultraviolet (UV) protective materials formed from monomers and/or sol-gels that contain UV absorbing agents (including highly conjugated organic compounds and metal oxide compounds).

Figure 6A:
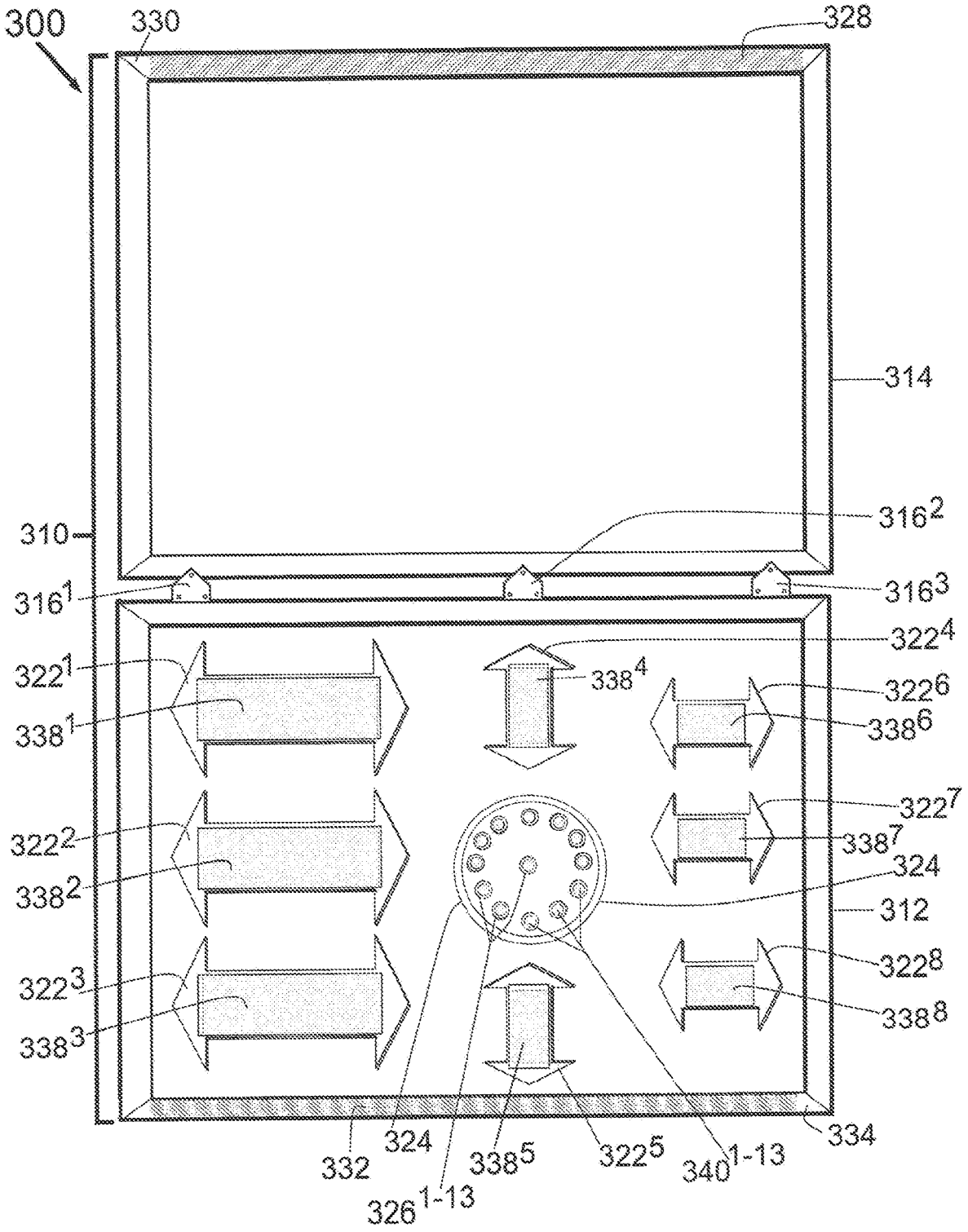
FIG. 6A is an illustration of a kit, including a storage box, according to an embodiment of the present invention.
Figure 6B:
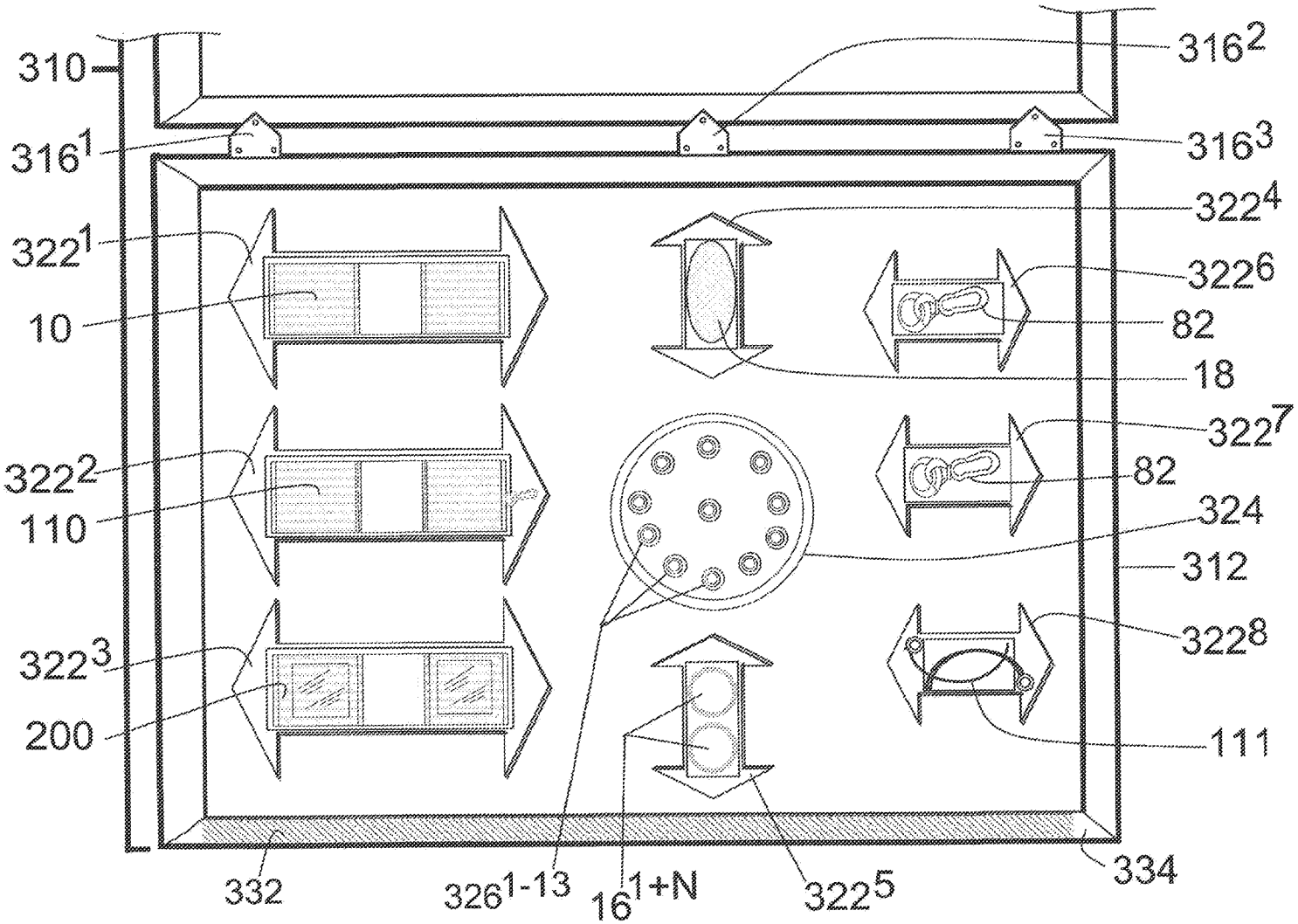
FIG. 6B is an illustration of the kit of FIG. 6A, showing the storage box with a lid and a bottom structure housing one or more wristwatch wrappers; one or more anterior gripping applications, one or more transferable mounting panels, one or more one or more metal ring-spring gate O-rings $\mathbf{80}^{1+N}$, one or more cross-body straps 111, according to an embodiment of the present invention.
Figure 6C:
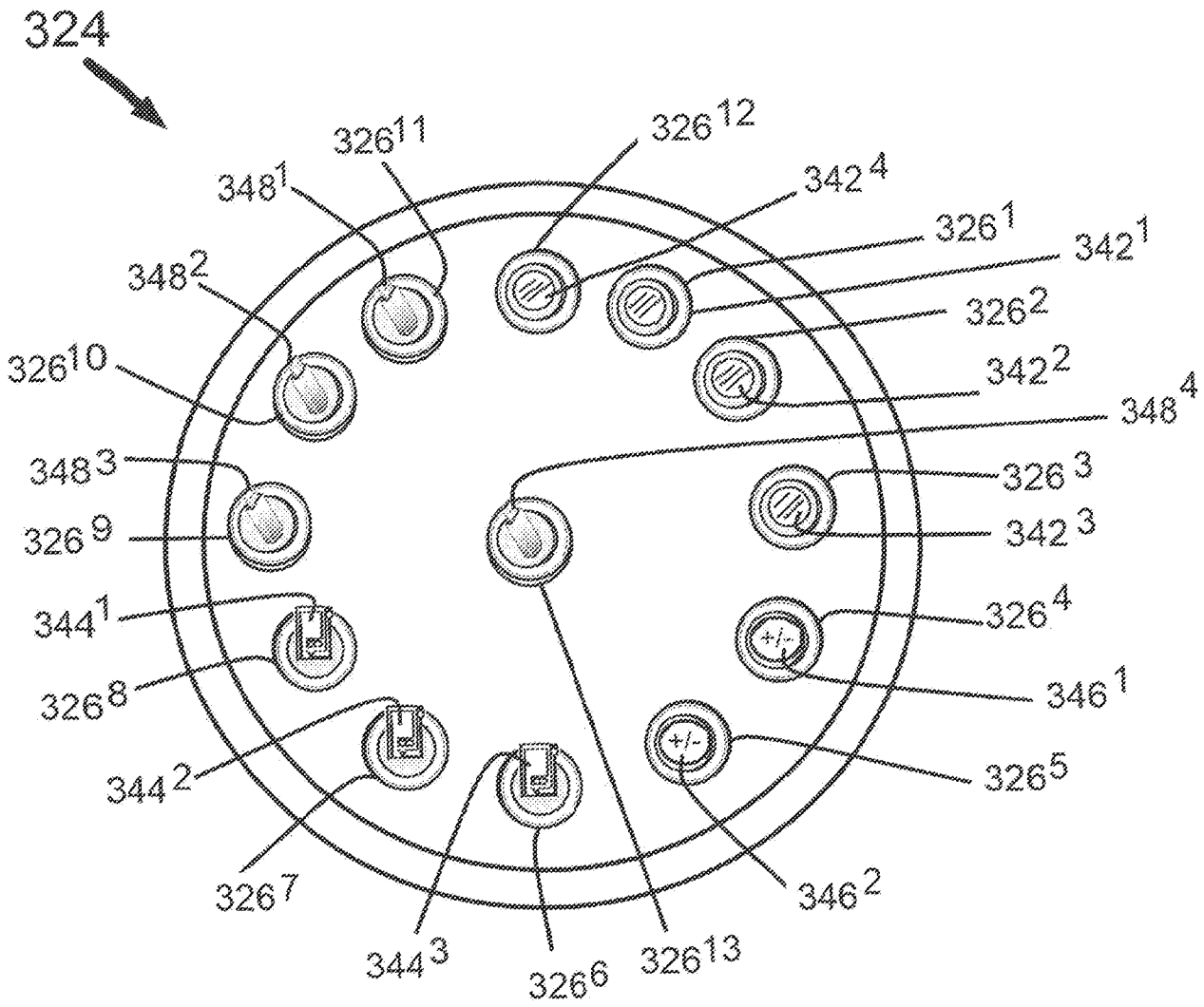
FIG. 6C is an illustration of a partial view of the kit of FIG. 6A, showing a circular containment structure of the bottom structure of the storage box housing one or more tracking devices, one or more short-wave wireless fidelity device, one or more batteries, one or more universal serial bus adapters, according to an embodiment of the present invention.

FIG. 6A-6C shows another exemplary embodiment of the present invention, a kit 300. FIGS. 6A-6C shows the kit 300 comprises, a storage box 310 configured for housing one or more of the wristwatch wrapper devices $\mathbf{10}^{1}$, 100, 200, as described above, one or more transferable mounting panels $\mathbf{16}^{1+N}$, as described above, and one or more anterior gripping applications $\mathbf{18}^{1+N}$ and one or more posterior gripping applications $\mathbf{19}^{1+N}$, as described above, one or more metal ring-spring gate O-rings $\mathbf{80}^{1+N}$ removably coupled to a metal swivel carabiner hinge 82 having a swivel connector 84; one or more cross-body straps $\mathbf{11}^{1+N}$; one or more metal swivel carabiner hook clips $\mathbf{112}^{1+N}$; one or more transferable smart devices $\mathbf{41}^{1+N}$; a storage container 400 to house the one or more wristwatch wrappers 10, 100, 200, the one or more anterior gripping applications $\mathbf{18}^{1+N}$; the one or more posterior gripping applications $\mathbf{19}^{1+N}$; the one or more cross-body straps $\mathbf{311}^{1+N}$; one or more metal swivel carabiner hook clips $\mathbf{112}^{1+N}$.

The one or more smart devices 41 can be selected from the group comprising one or more wireless tracking device $\mathbf{342}^{1+N}$, one or more short-wave wireless fidelity device $\mathbf{344}^{1+N}$, one or more wristwatch batteries $\mathbf{346}^{1+N}$, one or more universal serial bus charger adapter $\mathbf{348}^{1+N}$. The transferable smart device 41 is configured with a microprocessor with short range wireless fidelity microchip to enable communication with the user's smart phone, smart wristwatch, laptop, iPad, computing device to track the user's wristwatch 28.

The one or more anterior gripping applications $\mathbf{18}^{1+N}$ and the one or more posterior gripping applications $\mathbf{19}^{1+N}$ are transferable such that a worn anterior gripping application 18 or a worn posterior gripping application 19 is worn, they can readily be replaced with a new anterior gripping application 18 and/or a new posterior gripping application 19. In addition, the one or more anterior gripping applications $\mathbf{18}^{1+N}$ are interchangeable with one another such that an anterior gripping application $\mathbf{19}^{1+N}$ can be used in place of the posterior gripping application and visa versa.

FIG. 6A shows a perspective view of the storage box 310 of the kit. The storage box 310 is a portable such the storage box 310 can be stored in a user's drawer or closet, or transported with the user when travelling. The storage box 310 comprises a bottom structure 312, a lid 314 rotationally connected to the bottom structure 312 by way of two or more hinges $\mathbf{316}^{1+N}$, and a lock 318. The bottom structure 312 includes a plurality of containment structures to maintain the one or more of the wristwatch wrapper devices $\mathbf{10}^{1}$, 100, 200, the one or more transferable mounting panels $\mathbf{16}^{1+N}$, the one or more anterior gripping applications $\mathbf{18}^{1+N}$ and one or more posterior gripping applications $\mathbf{19}^{1+N}$, the one or more metal ring-spring gate O-rings $\mathbf{80}^{1+N}$ removably coupled to a metal swivel carabiner hinge 82 having a swivel connector 84; the one or more cross-body straps $\mathbf{11}^{1+N}$; the one or more metal swivel carabiner hook clips $\mathbf{112}^{1+N}$; the one or more transferable smart devices $\mathbf{41}^{1+N}$. In the exemplary embodiment the one or more anterior gripping applications $\mathbf{18}^{1+N}$ can be readily interchangeable with the one or more posterior gripping applications $\mathbf{19}^{1+N}$ and thereby, only the one or more anterior gripping applications are shown in FIG. 6B.

The storage box is shown including the bottom structure 312 of the storage box 310 and the lid 314 of the storage box 310 can be made of any material that is sufficiently strong, hard, and durable. Materials that can be used to manufacture the bottom portion of the storage box and the lid of the storage box can include but not limited to bamboo, sapele, walnut, mahogany, walnut, zebra wood, padauk African wood, a laminated wood, metal, fiberglass, polymers, copolymers, carbon fiber, or plexiglass.

Referring to FIGS. 6A and 6B, the bottom structure 310 is configured with a plurality of cut-out containment structures $\mathbf{320}^{1+N}$. Each of the plurality of cut-out containment structures $\mathbf{320}^{1+N}$ includes one or more arrow-shaped containment structures $\mathbf{322}^{1+n}$, and a circular containment structure 324 configured with one or more circular receptacles $\mathbf{326}^{1+12}$. Each of the arrow-shaped containment structures $\mathbf{320}^{1+N}$ are configured with a cavity to receive one or more wristwatch wrappers of any one of the wristwatch wrapper 10, 100, 200. Each of the arrow-shape containment structures can be dimensioned with a variety of lengths, widths and depths. The arrow-shape is beneficial as a containment structure shape because when the wristwatch wrappers 10, 100, 200 are contained, therein, in a flat unfolded rectangular shape there exists a triangular open space at each of the first elasticized selvage 20 and the second elasticized selvage 26 of the wristwatch wrappers 10, 100, 200. In this manner, the user can insert the user's finger into the triangular open space of the one or more arrow-shaped containment structures $\mathbf{322}^{1+n}$, and readily pick up a selected wristwatch wrapper 10, 100, 200, or anterior gripping application 18, or posterior gripping application 19, or cross-body strap 111, or the one or more metal ring-spring gate O-rings $\mathbf{80}^{1+N}$. Similarly, the arrow-shaped configuration is beneficial when the user selects anyone of the one or more metal swivel carabiner hook clips $\mathbf{112}^{1+N}$ or the cross-body strap 111, or the one or more transferable mounting panels $\mathbf{16}^{1+N}$, contained, therein, as shown in FIG. 6.

FIG. 6A, shows the circular containment structure 324 includes thirteen (13) circular receptacles $\mathbf{326}^{1-13}$ each configured with an interior cup. Each of the interior cups of the one or more circular receptacles $\mathbf{326}^{1+12}$ are configured to contain any one of the one or more transferable smart devices $\mathbf{41}^{1+N}$, the one or more of the transferable smart devices $\mathbf{41}^{1+N}$ including one or more wireless tracking devices $\mathbf{342}^{1+N}$, one or more short-wave wireless fidelity devices $\mathbf{344}^{1+N}$, one or more wristwatch batteries $\mathbf{346}^{1+N}$, one or more universal serial bus charger adapters $\mathbf{348}^{1+N}$.

Each of the interior cups of the thirteen circular receptacles 326$^{1-13}$ can be configured with a variety of circumferences, diameters, and depths. The circular containment structure 324 is configured in a circle assimilated with thirteen (13) circular receptacles 326$^{1-13}$ wherein twelve of the thirteen circular receptacles 326$^{1-13}$ of the circular containment structure 324 are arranged in a circumferential pattern along an inner circumferential rim of the circular containment structure 324 having a thirteenth circular receptacle 326$^{13}$ arranged in the center of the circumferential pattern of the twelve circular receptacles 326$^{1-12}$ to demonstrate a visual depiction of the face of a wristwatch 28. In like fashion, the one or more arrow-shaped containment structures 324$^{1+N}$ are each configured with the arrow shape to demonstrate a visual depiction of the hands of the wristwatch 28.

FIG. 6A shows each of the cavities of the one or more arrow-shaped containment structures 322$^{1+N}$ is integrated with a layer of a non-slip material or a grip surface 338$^{1-N}$ to aid in the retention of the one or more wristwatch wrappers 10, 100, 200, the one or more transferable mounting panels 16$^{1+N}$, the one or more anterior gripping applications 18$^{1+N}$ and one or more posterior gripping applications 19$^{1+N}$, the one or more metal ring-spring gate O-rings 80$^{1+N}$ removably coupled to a metal swivel carabiner hinge 82 having a swivel connector 84; the one or more cross-body straps 111$^{1+N}$; the one or more metal swivel carabiner hook clips 112$^{1+N}$; the one or more transferable smart devices 41$^{1+N}$ contained therein. Similarly, each of the interior cups of the thirteen circular receptacles 326$^{1+13}$ of the circular containment structure 324 is layered with a circular non-slip or a circular grip surface 340$^{1+13}$. The layer of non-slip material or grip surface 338$^{1-N}$ may be formed from plastic, silicone, leather, polyurethane, synthetic rubber, natural rubber, soft neoprene, but not limited to.

FIGS. 6A and 6B shows the bottom structure 312 of the storage box 310 including the arrangement of the one or more arrow-shaped containment structures 322$^{1+N}$ and the thirteen circular receptacles 326$^{1-13}$ of the circular containment structure 324. FIG. 6A shows the one or more arrow-shaped containment structures 322$^{1+N}$ include a first arrow-shaped containment structures 322$^{1}$ including a first layer of a non-slip material or grip surface 338$^{1}$ positioned in a horizontal orientation; a second arrow-shaped containment structures 322$^{2}$ including a second layer of non-slip material or grip surface 338$^{2}$ positioned in a horizontal orientation; third arrow-shaped containment structures 3223 including a third layer of non-slip material or grip surface 338$^{3}$ positioned in a horizontal orientation; a fourth arrow-shaped containment structures 322$^{4}$ including a fourth layer of non-slip material or grip surface 338$^{4}$ positioned in a vertical orientation; a fifth arrow-shaped containment structures 3225 including a fifth layer of non-slip material or grip surface 3385 positioned in a horizontal orientation; a sixth arrow-shaped containment structures 322$^{6}$ including a sixth layer of non-slip material or grip surface 338$^{6}$ positioned in a horizontal orientation; a seventh arrow-shaped containment structures 3227 including a seventh layer of non-slip material or grip surface 338$^{2}$ positioned in a horizontal orientation; an eighth second arrow-shaped containment structures 322$^{8}$ including an eighth layer of non-slip material or grip surface 338$^{8}$ positioned in a horizontal orientation.

FIGS. 6A-6B shows the thirteen circular receptacles 326$^{1-13}$ of the circular containment structure 324 of the bottom structure 312 of the storage box 310, arranged to parody a face of a wristwatch. The circular containment structure includes a first circular receptacle 326$^{1}$ having a first circular non-slip or a circular grip surface 340$^{1}$; a second circular receptacle 326$^{2}$ having a second circular non-slip or a circular grip surface 340$^{2}$; a third circular receptacle 326$^{3}$ having a third circular non-slip or a circular grip surface 340$^{3}$; a third circular receptacle 326$^{3}$ having a third circular non-slip or a circular grip surface 340$^{3}$; a fourth circular receptacle 326$^{4}$ having a fourth circular non-slip or a circular grip surface 340$^{4}$; a fifth circular receptacle 326$^{5}$ having a fifth circular non-slip or a circular grip surface 340$^{5}$; a sixth circular receptacle 326$^{6}$ having a sixth circular non-slip or a circular grip surface 340$^{6}$; a seventh circular receptacle 326$^{7}$ having a seventh circular non-slip or a circular grip surface 340$^{7}$; and eighth circular receptable 326$^{8}$ having an eighth circular non-slip or a circular grip surface 340$^{8}$; a ninth circular receptable 326$^{9}$ having a ninth circular non-slip or a circular grip surface 340; a tenth circular receptable 326$^{8}$ having an tenth circular non-slip or a circular grip surface 340$^{10}$; an eleventh circular receptable 326$^{11}$ having an eleventh circular non-slip or a circular grip surface 340$^{11}$; a twelfth circular receptable 326$^{12}$ having an eighth circular non-slip or a circular grip surface 340$^{12}$; a thirteenth circular receptable 326$^{13}$ having a thirteenth circular non-slip or a circular grip surface 340$^{13}$.

FIG. 6C shows the bottom structure 312 of the storage box 310 without the lid 314 to better illustrate the contents contained therein each of the one or more arrow-shaped containment structures 322$^{1+N}$ and the thirteen circular receptacles 326$^{1-13}$ of the circular containment structure 324. The bottom structure 312 is shown including the first arrow-shaped containment structures 322$^{1}$ containing a wristwatch wrapper device 10 contained therein; a second arrow-shaped containment structures 322$^{2}$ including a wristwatch wrapper device 100 contained therein; the third arrow-shaped containment structures 3223 containing a wristwatch wrapper 200 contained therein; a fourth arrow-shaped containment structures 322$^{4}$ including one or more anterior gripping applications 18$^{1+N}$ contained therein; a fifth arrow-shaped containment structures 3225 including one or more transferable mounting panels contained therein; a sixth arrow-shaped containment structures 322$^{6}$ including a first metal ring-spring gate O-rings 80$^{1}$ removably coupled to a first metal swivel carabiner hinge 82$^{1}$ having a first swivel connector 84$^{1}$ contained therein; a seventh arrow-shaped containment structures 3227 including a second metal ring-spring gate O-rings 802 removably coupled to a second metal swivel carabiner hinge 82$^{2}$ having a second swivel connector 84$^{2}$ contained therein; an eighth second arrow-shaped containment structures 322$^{8}$ including a cross-body strap 111 contained therein.

Referring back to FIG. 6A, the lid 314 is a cover that is placed over the bottom structure 312 to enclose the bottom structure 314 and each of the one or more arrow-shaped containment structures 324$^{1+N}$, and the circular containment structure 324 configured with each of the twelve circular receptacles 326$^{1+12}$ and the contents held therein. The lid 314 is configured with a geometric shaped structure having an open face. The open face of the geometric shaped structure of the lid 314 is geometrically similar to an open face of the rectangular shape of the bottom structure 312 wherein the lid 314 attaches to the bottom structure 312 such that the open face of the lid 314 encloses the open face of the bottom structure 312.

Each of the two or more hinges 316$^{1+N}$ is a fastening structure that rotatably attaches the lid 314 to the bottom structure 312. Each of the two or more hinges 316$^{1+N}$ is a rotating structure that allows the lid 314 to rotate relative to the bottom structure 312 as the user opens and closes the lid 314 against the bottom structure 312.

The lock 318 includes a first lock component 318[1] and a second lock component 318[2]. The first lock 318[1] component is mateable with the second lock component 318[2]. The first lock component 318[1] is fixedly attached to a front wall of the lid 314 and the second lock component 318[2] is fixedly attached to a corresponding front wall of the bottom structure 312. The first lock component 318[1] and the second lock component 318[2] can be made from a precious metal, a precious gem, combination thereof. The first lock component 318[1] and the second lock component 318[2] can be configured in a logo including one or more letters of the alphabet or any one of numbers, or a combination, thereof.

In addition, to urge the closure of the lid 314 against the bottom structure 312 of the storage box 310, a first magnetic strip 328 is integrated with an interior top edge 330 of the lid 314 and a second magnetic strip 332 is integrated with an interior bottom edge 334 of the bottom structure 312 wherein the second magnetic strip 332 is attracted to the first magnetic strip 328 such that the lid 314 closes securely against the bottom structure 312. A magnetic attraction force is established between the first magnetic strip 328 of the lid 314 and the second magnetic strip 332 of the bottom structure 312 such that the magnetic attraction force allows for the lid 314 to be released from the bottom structure 312 with a normal or reasonable amount of exertion of force from the user so that the user can readily access the contents of the storage box 310.

The foregoing description of the subject matter has been presented for purposes of illustration and description. It is not intended to be exhaustive or to limit the subject matter to the precise form disclosed, and other modifications and variations may be possible in light of the above teachings. Further, it is to be understood that the various features described herein may be used in combination with one another, even if not expressly stated or shown being used in combination. The embodiments were chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments except insofar as limited by the prior art.

What is claimed is:

1. A wristwatch wrapper device, comprising:

a tubular body having an anterior material layer formed joined to a posterior material layer reinforced with an interior lining material circumventing a tubular open channel, the tubular body having a first open end limited by a first circumferential tubular body edge and a second open end limited by a second circumferential tubular body edge, the tubular body having a lateral direction and a circumferential direction;

a first elasticized selvage is integrated with the first circumferential tubular body edge of the first open end and a second elasticized selvage is integrated with the second circumferential tubular body edge of the second open end of the tubular body;

wherein the first elasticized selvage and the second elasticized selvage of the tubular body are separated by a first flexible cuff portion and a second flexible cuff portion having a mounting portion centrally disposed therebetween the first flexible cuff portion and the second flexible cuff portion, wherein the mounting portion includes an anterior face and a posterior face;

a housing including a compartment having a retractable opening, wherein the housing is recessed into a portion of the interior lining material that is coplanar with the posterior material layer of the second flexible cuff portion of the tubular body wherein the compartment is configured to contain a transferable smart device;

a design imprinted on a portion of the interior lining material that is coplanar with the anterior material layer of the second flexible cuff portion of the tubular body;

one or more transferable mounting panels assimilated with the mounting portion extends perpendicularly to the lateral direction of the tubular body circumventing the anterior face of the mounting portion and the posterior face of the mounting portion, wherein the one or more transferable mounting panels include an annular configuration having an anterior portion and a posterior portion;

wherein the first flexible cuff portion is configured with a first circumferential cross section, the second flexible cuff portion is configured with a second circumferential cross section equal to the first circumferential cross section, the mounting portion is configured with a third circumferential cross section which is equal to the first circumferential cross section and second circumferential cross section;

wherein the mounting portion is framed with a first circumferential mounting edge and a second circumferential mounting edge wherein the first circumferential mounting edge is integrated with a first piping and the second circumferential mounting edge is integrated with a second piping;

wherein the anterior portion of the one or more transferable mounting panels is integrated with an anterior gripping application, wherein the anterior gripping application is configured to comport with a case body of a wristwatch and a proximate portion of a bracelet of the wristwatch being supported by a transferable mounting panel of the one or more transferable mounting panels assimilated with the mounting portion of the tubular body to prevent slippage of the wristwatch;

wherein the posterior portion of the one or more transferable mounting panels is integrated with a posterior gripping application, wherein the posterior gripping application is configured to comport with a distal portion of the bracelet of the wristwatch to prevent slippage of the wristwatch;

wherein the first flexible cuff portion extends a first length in a transverse direction from the first piping of the mounting portion to the first elasticized selvage of the first circumferential tubular body edge of the tubular body, the second flexible cuff portion extends a second length in an opposing transverse direction from the second piping of the mounting portion to the second elasticized selvage of the second circumferential tubular body edge of the tubular body, the mounting portion extends a third length from the first piping to the second piping, wherein the first length is equal to the second length and the third length is equal to the first length and the second length;

wherein the first flexible cuff portion of the tubular body is manipulated being upturned and reversed inside-out at the first elasticized selvage and folded at the first piping, the first flexible cuff portion is wrapped around the wristwatch mounted on the transferable mounting panel assimilated with the mounting portion whereby a first circumambient layer is formed enveloping the wristwatch such that a first portion of the anterior material layer of the first flexible cuff portion comes in contact with a crystal of a face of the wristwatch and a proximate portion of the bracelet of the wristwatch, concomitantly, a first portion of the posterior material layer of the first flexible cuff portion comes in contact with the distal portion of the bracelet of the wristwatch, consequentially, a first interior lining material portion of the interior lining material that is coplanar with the first portion of the anterior material layer of the first flexible cuff portion provides an anterior facing material layer of the first circumambient layer wrapped around the wristwatch, and a second interior lining material portion of the interior lining material that is coplanar with the first portion of the posterior material layer of the first flexible cuff portion provides a posterior facing material layer of the first circumambient layer wrapped around the wristwatch wherein the first circumambient layer around the wristwatch is secured by the first elasticized selvage, subsequently, wherein the second flexible cuff portion of the tubular body is manipulated being upturned and reversed inside-out at the second elasticized selvage and folded at the second piping, the second flexible cuff portion is wrapped around the first circumambient layer whereby a second circumambient layer is provided being secured by the second elasticized selvage such that a torus-shaped wristwatch wrapper is formed, wherein a second portion of the anterior material layer of the second flexible cuff portion comes in contact with the anterior facing material layer of the first circumambient layer wrapped around the wristwatch, and, concomitantly, a second portion of the posterior material layer of the second flexible cuff portion comes in contact with the posterior facing surface of the first circumambient layer, consequentially, a third interior lining material portion of the interior lining material being upturned and reversed inside-out that is coplanar with the second portion of the anterior material layer of the second flexible cuff portion provides an anterior facing cover of the torus-shaped wristwatch wrapper, and, concomitantly, a fourth interior lining material portion of the interior lining material that is coplanar with the second portion of the posterior material layer of the second flexible cuff portion provides a posterior facing cover of the torus-shaped wristwatch wrapper;

wherein the third interior lining material portion being upturned and reversed inside-out reveals the design being imprinted on the anterior facing cover of the torus shaped wristwatch wrapper;

wherein the fourth interior lining material portion being upturned and reversed inside-out reveals the housing on the posterior facing cover of the torus-shaped wristwatch wrapper; and wherein the torus-shaped wristwatch wrapper is formed circumscribing a gripping ring through which a user's fingers pass, wherein the gripping ring is bonded with a gripping material.

2. The wristwatch wrapper device of claim 1, wherein the anterior material layer, the posterior material layer, the interior lining material, the one or more transferable mounting panels is made with material including natural or synthetic fibers, that is knitted material, woven material, or nonwoven material.

3. The wristwatch wrapper device of claim 1, wherein the first flexible cuff portion, the second flexible cuff portion, and the mounting portion are each configured with dimensions having a height of at least 3.50 inches, a length of at least 2.50 inches, and wherein the tubular body includes a tubular open channel having a diameter of at least 4.00 inches diameter therethrough.

4. The wristwatch wrapper of claim 1, wherein each of the anterior material layer, the posterior material layer, the interior lining material, the one or more transferable mounting panels, are formed from a plurality of warp yarns and a plurality of weft yarns wherein the plurality of warp yarns each includes an elastic warp filament and a non-elastic warp filament, and the plurality of weft yarns each includes an elastic weft filament and a non-elastic weft filament.

5. The wristwatch wrapper device of claim 4, wherein each of the plurality of warp yarns and each of the plurality of weft yarns includes a hydrophobic coating that is water proof.

6. The wristwatch wrapper device of claim 4, wherein the plurality of warp yarns and the plurality of weft yarns include one or more polyamide yarns.

7. The wristwatch wrapper device of claim 4, wherein the plurality of warp yarns and the plurality of weft yarns include one or more silicone coated yarns.

8. The wristwatch wrapper of claim 1, wherein each of the anterior material layer, the posterior material layer, and the interior lining material, of the tubular body are seamlessly formed together as a single unit tubular body with a plurality of warp yarns and a plurality of weft yarns by way of a circular sewing machine, wherein the circular sewing machine is selected from the group of circular sewing machines consisting of a circular knitting machine, circular weaving machine, and a circular hosiery sewing machine.

9. The wristwatch wrapper device of claim 8, wherein the tubular body is seamlessly formed as the single unit tubular body wherein the plurality of warp yarns each includes an elastic warp filament and a non-elastic warp filament, and the plurality of weft yarns each includes an elastic weft filament and a non-elastic weft filament, wherein the plurality of warp yarns and the plurality of weft yarns are actuated with any of the circular sewing machine having a cylinder of at least 4 inches in diameter, wherein the circular sewing machines is selected from the group consisting of the circular knitting machine, the circular weaving machine, and the circular hosiery sewing machine.

10. The wristwatch wrapper device of claim 1, wherein the tubular body is formed by injection molding.

11. The wristwatch wrapper device of claim 1, wherein the anterior material layer, the posterior material layer, the interior lining material, the one or more transferable mounting panels, are each formed from a soft surfaced ballistic nylon having shock absorbing characteristics.

12. The wristwatch wrapper device of claim 1, wherein the anterior material layer, the posterior material layer, the interior lining material, the one or more transferable mounting panels, are each formed with any one of the materials selected from the group consisting of, a neoprene fabric, a polychloroprene fabric, a soft neoprene fabric, a soft neoprene rubber fabric, a neoprene foam fabric, reversible neoprene fabric, embossed neoprene fabric, neoprene spandex fabric, neoprene waterproof scuba fabric, neoprene polyester fabric, microfiber fabric, microfiber polyester fabric, neoprene sponge fabric, foam rubber fabric, elastomer fabric, elastic fabric, nitrile rubber fabric, silicone rubber fabric, polybutadiene fabric, polyisoprene fabric, ethylene/vinyl acetate fabric, polyester fabric, polypropylene fabric, polyethylene fabric, polyvinyl chloride fabric, polyimide fabric, polyamide fabric, polytetrafluoroethylene fabric, polyvinyl alcohol fabric, polyurethane fabric, and polyvinyl fluoride fabric.

13. The wristwatch wrapper device of claim 1, wherein the anterior material layer, the posterior material layer, the interior lining material, the one or more transferable mounting panels, are each formed from a stretchable neoprene fabric including 80% polyester, and 20% spandex.

14. The wristwatch wrapper device of claim 1, wherein any one of the anterior material layer, the posterior material layer, the interior lining material, the one or more transferable mounting panels, is made from a four-way stretch material selected from the group consisting of, a four-way stretch leather material, a four-way stretch flexible vinyl material, a four-way stretch suede material, a four-way stretch artificial leather material, a four-way stretch synthetic leather material, a four-way stretch pleather material, a four-way stretch poromeric imitation leather material, a four-way stretch koskin material, a four-way stretch leatherette material, a four-way stretch carbon fiber material, a four-way stretch air mesh material, a four-way stretch spin bound fabric, a four-way stretch spun bound hygienic fabric, a four-way stretch polyurethane material, a four-way stretch welded polyurethane film material, a four-way stretch nylon material, and a four-way stretch polyester material, and combinations thereof.

15. The wristwatch wrapper device of claim 1, wherein any one of the anterior material layers, the posterior material layer, the interior lining material, the one or more transferable mounting panels is formed with a faux fur material.

16. The wristwatch wrapper device of claim 1, wherein any one of the anterior material layer, the posterior material layer, the interior lining material, and the one or more transferable mounting panels, is formed from a quilted material including denim and/or leather.

17. The wristwatch wrapper device of claim 1, wherein the one or more transferable mounting panels is replaceable whereby when the anterior gripping application or the posterior gripping application of an implemented transferable mounting panel of the one or more transferable mounting panels becomes worn a new transferable mounting panel of the one or more transferable mounting panels can replace the worn transferable mounting panel.

18. The wristwatch wrapper device of claim 1, wherein each of the anterior material layer, the posterior material layer, the interior lining material, the one of the one or more transferable mounting panels, includes a thickness of at least 0.20 mm.

19. The wristwatch wrapper device of claim 1, wherein the anterior material layer is made from a first fabric, the posterior material layer is made from a second fabric, and the interior lining material is made from a third fabric, wherein the first fabric is different from the second fabric, and the third fabric is different from each of the first fabric and the second fabric.

20. The wristwatch wrapper device of claim 1, wherein the anterior material layer, the posterior material layer, and the interior lining material, are each formed with a variety of colored fabrics wherein the anterior material layer is formed with a first colored fabric, the posterior material layer is formed with a second colored fabric, and the interior lining material is formed with a third colored fabric, and the one or more transferable mounting panels is formed with a fourth colored fabric, wherein the first colored fabric is different from the second colored fabric, and the third colored fabric is different from the first colored fabric and the second colored fabric, and the fourth colored fabric is different from each of the first colored fabric, the second colored fabric, and the third colored fabric.

21. The wristwatch wrapper device of claim 1, wherein the anterior material layer, the posterior material layer, the interior material layer, the one or more transferable mounting panels, are each bonded with a laminate wherein the laminate is selected from the group consisting of, polymers, viscoelastic polymers, rubber, silicone, and neoprene.

22. The wristwatch wrapper device of claim 1, wherein the anterior material layer, the posterior material layer, the interior lining material, the one or more transferable mounting panels, are each formed with a fireproof material.

23. The wristwatch wrapper of claim 1, wherein each of the anterior material layer, the posterior material layer, the interior lining material, the one or more transferable mounting panels, are each formed from a fabric that is characterized by resistance to moisture absorption, and resistance to mold/mildew whereby the fabric is an elasticized wicking fabric.

24. The wristwatch wrapper device of claim 1, wherein the anterior material layer, the posterior material layer, the interior lining material, the one or more transferable mounting panels are each formed from a marine vinyl material that is mold, mildew resistant integrated with an elastomer fiber.

25. The wristwatch wrapper device of claim 1, wherein each of the anterior material layer, the posterior material layer, the interior lining material, the one or more transferable mounting panels, are each formed from an ultraviolet blocking fabric.

26. The wristwatch wrapper device of claim 1, wherein the anterior material layer, the posterior material layer, the interior lining material, the one or more transferable mounting panels, are each embossed with a registered trademark plus a stylized design wherein the registered trademark is owned by a manufacturer of the wristwatch.

27. The wristwatch wrapper device of claim 1, wherein the anterior material layer, the posterior material layer, the interior lining material, the one or more transferable mounting panels, are each embossed with a registered trademark plus a stylized design wherein the registered trademark is owned by the owner of the wristwatch.

28. The wristwatch wrapper device of claim 1, wherein the first elasticized selvage, the second elasticized selvage, the first piping, and the second piping, are each formed with a polyurethane based elastomeric material, a silicone-based elastomeric material, or a combination thereof.

29. The wristwatch wrapper device of claim 1, wherein the first elasticized selvage, the second elasticized selvage, the first piping, and the second piping, are each formed with a four-way stretch denim fabric.

30. The wristwatch wrapper device of claim 1, wherein the first elasticized selvage, the second elasticized selvage, the first piping, the second piping, are each formed with a four-way stretch material selected from the group consisting of, a four-way stretch soft leather, a four-way stretch synthetic leather, a four-way stretch pleather, a four-way stretch poromeric imitation leather, a four-way stretch koskin, a four-way stretch leatherette, a four-way stretch flexible vinyl, and a four-way stretch suede.

31. The wristwatch wrapper device of claim 1, wherein the first elasticized selvage, the second elasticized selvage, the first piping, and the second piping, are each formed with a reflective material selected from the group consisting of, fluorescent yellow—silver stripe, orange—silver stripe, grey reflective material, yellow—green—silver stripe, orange reflective material, green reflective material, chartreuse reflective material, and white reflective material.

32. The wristwatch wrapper of claim 1, wherein the anterior gripping application of the anterior portion of the transferable mounting panel of the one or more transferable mounting panels, and the posterior gripping application of the posterior portion of the one or more transferable mounting panels, comprises a netting mesh pattern of discrete raised gripping filaments which are raised immediately adjacent to an exterior surface of the anterior portion of the transferable mounting panel and the posterior portion of the transferable mounting panel, respectively, which are knitted or weaved therethrough devoid of adhesives.

33. The wristwatch wrapper of claim 1, wherein the anterior gripping application of the anterior portion of the transferable mounting panel of the one or more transferable mounting panels, and the posterior gripping application of the posterior portion of the transferable mounting panel of the one or more transferable mounting panels comprises a pattern of discrete raised gripping surfaces wherein the pattern is selected from any one of a shape comprising a circle, a rectangle, an oval, a star, a heart, letters, numbers, dates, a logo, a vanity moniker, name, indicia, vanity initials, face of a wristwatch, hands of a wristwatch, a logo, a registered trademark plus a stylized design of a manufacturer of the wristwatch, a registered trademark plus stylized design of an owner of the wristwatch.

34. The wristwatch wrapper of claim 1, wherein the anterior gripping application of the anterior portion of the transferable mounting portion of the one or more transferable mounting panels, and the posterior gripping application of the posterior portion of the transferable mounting panel of the one or more transferable mounting panels comprises a pattern of raised gripping surfaces comprising a series of raised linear lines oriented in a longitudinal direction, a lateral direction, or a circular direction.

35. The wristwatch wrapper of claim 1, wherein the gripping application of the anterior portion of the transferable mounting panel of the one or more transferable mounting panels, and the posterior gripping application of the posterior portion of the transferable mounting panel of the one or more transferable mounting panels, is formed from a material selected from the group comprising, silicone, polyurethane, synthetic rubber, and natural rubber.

36. The wristwatch wrapper of claim 1, wherein the anterior gripping application of the anterior portion of the transferable mounting panel of the one or more transferable mounting panels, and the posterior gripping application of the posterior portion of the one or more transferable mounting panels is a pattern of raised gripping surfaces comprising dots, bumps, pods, nodules, comprising a material including one or more of a combination of silicone filaments, polyurethane filaments, synthetic rubber filaments, natural rubber filaments, polyamide filaments, silicone coated filaments.

37. The wristwatch wrapper of claim 1, wherein the gripping application of the anterior gripping portion of the transferable mounting panel of the one or more transferable mounting panels, and the posterior gripping application of the posterior portion of the transferable mounting panel of the one or more transferable mounting panels is integrated with the anterior portion and the posterior portion, respectively, by way of knitting a gripping yarn into each of an exterior surface area of the anterior portion of the transferable mounting panel, and an exterior surface of the posterior portion of the transferable mounting panel implementing any one of a circular knitting machine, a circular weaving machine, a circular hosiery knitting machine.

38. The wristwatch wrapper device of claim 1, wherein the one or more transferable mounting panels, are formed from a fabric backed with any one of the materials selected from the group consisting of, polyester, polypropylene, polyethylene, polyvinyl chloride, polyimide, polyamide, polystyrene polytetrafluoroethylene, polyvinyl alcohol, polyurethane, polyvinyl fluoride, copolymers of an elastomer, elastic polymer, elastomeric compound, and thermoplastic elastomer.

39. The wristwatch wrapper device of claim 1, wherein the gripping material of the gripping ring is selected from anyone of the group comprising an elastomer, spandex, rubber, synthetic rubber, vinyl, polyvinyl chloride, thermoplastic, and silicone.

40. The wristwatch wrapper device of claim 1, wherein the gripping material of the gripping ring can comprise a non-slip coating adhered to a circumferential surface of the gripping ring by way of bonding, laminating, melting, curing, spraying, or fusing.

41. The wristwatch wrapper of claim 1, wherein the gripping material of the gripping ring of the torus-shaped wristwatch wrapper is configured with a pattern of discrete raised gripping surfaces wherein the pattern is selected from any one of a shape comprising a circle, a rectangle, an oval, a star shape, a heart shape, letters, numbers, dates, a logo, a moniker, name, indicia, initials, symbols, face of a wristwatch, hands or a wristwatch.

42. The wristwatch wrapper of claim 1, wherein the gripping material of the gripping ring of the torus-shaped wristwatch wrapper is configured with a pattern of discrete raised gripping surfaces wherein the pattern comprises letters spelling "W", "R", "I", "S", "T", "W", "A", "T", "C", "H", "W", "R", "A", "P", "P", "E", "R".

43. The wristwatch wrapper of claim 1, wherein the gripping material of the gripping ring of the torus-shaped wristwatch wrapper is configured having a pattern of raised gripping surfaces comprising a series of raised linear lines oriented in a longitudinal direction, a lateral direction, or a circular direction.

44. The wristwatch wrapper of claim 1, wherein the gripping material of the of the gripping ring of the torus-shaped wristwatch wrapper is configured in a pattern of raised gripping surfaces comprising dots, bumps, pods, nodules, and/or the like comprising a gripping material including one or more of a combination of silicone, polyurethane, synthetic rubber, natural rubber, polyamide yarn, silicone coated yarn.

45. The wristwatch wrapper device of claim 1, whereby the transferable smart device is selected from the group comprising a wireless tracking device, a short-wave wireless fidelity device, a battery, and a universal serial bus charger adapter.

46. The wristwatch wrapper device of claim 1, wherein the transferable smart device is configured with a microprocessor with a short-range wireless fidelity microchip to wirelessly connect with a user's smart device to generate information on a location of the user's wristwatch.

47. The wristwatch wrapper device of claim 46, wherein the user's smart device comprises any one of a smart phone, smart wristwatch, laptop, iPad, computing device.

* * * * *